US009131305B2

(12) United States Patent
Li et al.

(10) Patent No.: US 9,131,305 B2
(45) Date of Patent: Sep. 8, 2015

(54) CONFIGURABLE THREE-DIMENSIONAL SOUND SYSTEM

(71) Applicants: Qi Li, New Providence, NJ (US); Yin Ding, Brooklyn, NY (US); Manli Zhu, Pearl River, NY (US)

(72) Inventors: Qi Li, New Providence, NJ (US); Yin Ding, Brooklyn, NY (US); Manli Zhu, Pearl River, NY (US)

(73) Assignee: LI Creative Technologies, Inc., Florham Park, NJ (US)

( * ) Notice: Subject to any disclaimer, the term of this patent is extended or adjusted under 35 U.S.C. 154(b) by 372 days.

(21) Appl. No.: 13/743,551

(22) Filed: Jan. 17, 2013

(65) Prior Publication Data

US 2014/0198918 A1 Jul. 17, 2014

Related U.S. Application Data

(60) Provisional application No. 61/631,979, filed on Jan. 17, 2012, provisional application No. 61/690,754, filed on Jul. 5, 2012.

(51) Int. Cl.

| | |
|---|---|
| ***H04R 5/00*** | (2006.01) |
| ***H04R 5/027*** | (2006.01) |
| ***H04S 7/00*** | (2006.01) |

(Continued)

(52) U.S. Cl.

CPC *H04R 5/027* (2013.01); *H04S 7/30* (2013.01); *H04R 3/005* (2013.01); *H04R 2201/401* (2013.01); *H04S 3/008* (2013.01);

(Continued)

(58) Field of Classification Search

None

See application file for complete search history.

(56) References Cited

U.S. PATENT DOCUMENTS

| | | | | |
|---|---|---|---|---|
| 7,391,876 | B2 | 6/2008 | Cohen et al. | |
| 2014/0146970 | A1 * | 5/2014 | Kim et al. | 381/17 |

(Continued)

FOREIGN PATENT DOCUMENTS

| | | |
|---|---|---|
| EP | 0880871 B1 | 11/2003 |
| EP | 2168396 A2 | 3/2010 |
| EP | 1466498 B1 | 3/2011 |

OTHER PUBLICATIONS

Brungart, D. S.; Rabinowitz, W. M. Auditory localization of nearby sources I: Head-related transfer functions. Journal of the Acoustical Society of America. 1999, vol. 106, pp. 1465-1479.

(Continued)

*Primary Examiner* — Tan X Dinh

(74) *Attorney, Agent, or Firm* — Ash Tankha; Lipton, Weinberger & Husick

(57) ABSTRACT

A method and a system for simultaneously generating configurable three-dimensional (3D) sounds are provided. A 3D sound processing application (3DSPA) in operative communication with a microphone array system (MAS) is provided on a computing device. The MAS forms acoustic beam patterns and records sound tracks from the acoustic beam patterns. The 3DSPA generates a configurable sound field on a graphical user interface using recorded or pre-recorded sound tracks. The 3DSPA acquires user selections of configurable parameters associated with sound sources from the configurable sound field. The 3DSPA dynamically processes the sound tracks using the user selections to generate a configurable 3D binaural sound, surround sound, and/or stereo sound. The 3DSPA measures head related transfer functions (HRTFs) in communication with a simulator apparatus that simulates a human's upper body. The 3DSPA generates the binaural sound by processing the sound tracks with the HRTFs based on the user selections.

40 Claims, 39 Drawing Sheets

(51) Int. Cl.
*H04R 3/00* (2006.01)
*H04S 3/00* (2006.01)

(52) U.S. Cl.
CPC ..... *H04S 2400/01* (2013.01); *H04S 2400/15* (2013.01); *H04S 2420/01* (2013.01)

(56) References Cited

U.S. PATENT DOCUMENTS

| | | | | |
|---|---|---|---|---|
| 2014/0146983 | A1* | 5/2014 | Kim et al. | 381/306 |
| 2014/0328505 | A1* | 11/2014 | Heinemann et al. | 381/303 |
| 2014/0355766 | A1* | 12/2014 | Morrell et al. | 381/18 |
| 2014/0355794 | A1* | 12/2014 | Morrell et al. | 381/303 |

OTHER PUBLICATIONS

Farina, Angelo. Simultaneous Measurement of Impulse Response and Distortion with a Swept-sine Technique. J.AES. 2000, vol. 48.

B. C.J. Moore, An Introduction to the Psychology of Hearing, Fifth Edition, Elsevier, 2004, pp. 233-367.

Q. Li, M. Zhu, and W. Li, "A portable USB-based microphone array device for robust speech recognition", IEEE International Conference on Acoustics, Speech, and Signal Processing, Taipei, Apr. 2009.

* cited by examiner

CONFIGURABLE THREE-DIMENSIONAL SOUND SYSTEM

CROSS REFERENCE TO RELATED APPLICATIONS

This application claims the benefit of the following patent applications:

1. Provisional patent application No. 61/631,979 titled "Highly accurate and listener configurable 3D positional audio System", filed on Jan. 17, 2012 in the United States Patent and Trademark Office.
2. Provisional patent application No. 61/690,754 titled "3D sound system", filed on Jul. 5, 2012 in the United States Patent and Trademark Office.
3. Non-provisional patent application Ser. No. 13/049,877 titled "Microphone Array System", filed on Mar. 16, 2011 in the United States Patent and Trademark Office.

The specifications of the above referenced patent applications are incorporated herein by reference in their entirety.

BACKGROUND

Sounds are a constant presence in everyday life and offer rich cues about the environment. Sounds come from all directions and distances, and individual sounds can be distinguished by pitch, tone, loudness, and by their location in space. Three-dimensional (3D) sound recording and synthesis are topics of interest in scientific, commercial, and entertainment fields. With the popularity of 3D movies, and even emerging 3D televisions and 3D computers, spatial vision is no longer a phantasm. In addition to cinema and home theaters, 3D technology is found in applications, for example, from a simple videogame to sophisticated virtual reality simulators.

Three-dimensional (3D) sound is often termed as spatial sound. The spatial location of a sound is what gives the sound a three-dimensional aspect. Humans use auditory localization cues to locate the position of a sound source in space. There are eight sources of localization cues: interaural time difference, head shadow, pinna response, shoulder echo, head motion, early echo response, reverberation, and vision. The first four cues are considered static and the other four cues dynamic. Dynamic cues involve movement of a subject's body affecting how sound enters and reacts with the subject's ear. There is a need for accurately synthesizing such spatial sound to add to the immersiveness of a virtual environment.

In order to gain a clear understanding of spatial sound, there is a need for distinguishing monaural, stereo, and binaural sound from three-dimensional (3D) sound. A monaural sound recording is a recording of a sound with one microphone. There is no sense of sound positioning in monaural sound. Stereo sound is recorded with two microphones positioned several feet apart and separated by empty space. When a stereo recording is played back, the recording from one microphone goes into the subject's left ear, while the recording from the other microphone is channeled into the subject's right ear. This gives a sense of the position of the sound as recorded by the microphones. Listeners of stereo sound often perceive the sound sources to be at a position inside their heads. This is due to the fact that humans do not normally hear sounds in the manner they are recorded in stereo, separated by empty space. The human head acts as a filter to incoming sounds.

Generally, human hearing localizes sound sources in a three-dimensional (3D) spatial field, mainly by three cues: an interaural time difference (ITD) cue, an interaural level difference (ILD) cue, and a spectral cue. The ITD is the difference of arrival times of transmitted sound between the two ears. The ILD is the difference in level and/or intensity of the transmitted sound received between the two ears. The spectral cue describes the frequency content of the sound source, which is shaped by the ear. For example, when a sound source is located exactly and directly in front of a human, the ITD and the ILD of the sound is approximately zero, since the sound arrives at the same time and level. If the sound source shifts to the left, the left ear receives the sound earlier and louder than the right ear. This helps humans determine from where the sound is being emitted. When a sound is emitted by a sound source from the left of a listener, the ITD from the left to the right reaches its maximum value. The combination of these factors is modeled by two sets of filters on the left ear and the right ear separately in order to describe the spatial effect which is recognizable by human hearing. The transfer functions of such filters are called head related transfer functions (HRTFs). Since different effects are caused by different locations of the sound source, the HRTFs are a bank by positions.

Binaural recordings sound more realistic as they are recorded in a manner that more closely resembles the human acoustic system. To achieve three-dimensional (3D) spatial effects on audio, for example, music, earlier binaural recording also referred to as dummy head recording, was obtained by placing two microphones in inner ear locations of an artificial life, average sized human head. However, in such a case, many specific details such as reflection and influence from shoulders and the human torso on the acoustic performance were not considered. Currently, binaural sound is recorded by measuring head related transfer functions using a human head simulator with two microphones inside the ears. Binaural recordings sound closer to what humans hear in the real world as the human head simulator filters sound in a manner similar to the human head. In existing technology, the human head simulator is too large to be mounted on a portable device and is also expensive. Moreover, the recorded binaural sound can only be used for headsets and cannot be used for a surround sound system. Furthermore, the recorded binaural sound cannot be modified or configured during reproduction. Although the existing technologies are able to achieve a few enhancements on the 3D spatial audio experience for a user, they do not provide an option for the user to adjust the source locations and directions of the recorded audio.

Professional studio recordings are performed on multiple sound tracks. For example, in a music recording, each instrument and singer are recorded on individual sound tracks. The sound tracks are then mixed to form stereo sound or surround sound. Currently, surround sound is created using multiple different methods. One method is to use a surround sound recording microphone technique, and/or to mix in surround sound for playback on an audio system with speakers that encircle the listener to play audio from different directions. Another method is to process the audio with psychoacoustic sound localization methods to simulate a two-dimensional (2D) sound field with headphones. Another method, based on Huygens' principle, attempts to reconstruct recorded sound field wave fronts within a listening space, for example, in an audio hologram form. One form, for example, wave field synthesis (WFS), produces a sound field with an even error field over the entire area. Commercial WFS systems require many loudspeakers and significant computing power. Moreover, current surround sound cannot be recorded by a portable device and is not configurable by users.

Because of the complex nature of current state-of-the-art systems, several concessions are required for feasible implementations, especially if the number of sound sources that have to be rendered simultaneously is large. Recent trends in consumer audio show a shift from stereo to multi-channel audio content, as well as a shift from solid state devices to mobile devices. These developments cause additional constraints on transmission and rendering systems. Moreover, consumers often use headphones for audio rendering on a mobile device. To experience the benefit of multi-channel audio, there is a need for a compelling binaural rendering system.

Hence, there is a long felt but unresolved need for a method and a configurable three-dimensional (3D) sound system that perform 3D sound recording, processing, synthesis and reproduction to enhance existing audio performance to match a vivid 3D vision field, thereby enhancing a user's experience. Moreover, there is a need for a method and a configurable 3D sound system that accurately measure head related transfer functions using a simulator apparatus that considers specific details such as reflection and influence from shoulders and the human torso on the acoustic performance. Furthermore, there is a need for a method and a configurable 3D sound system that simultaneously generates a configurable three-dimensional binaural sound, a configurable three-dimensional stereo sound, and a configurable three-dimensional surround sound on a mobile computing device or other device using selections acquired from a user. Furthermore, there is a need for a method and a configurable 3D sound system that generates a configurable three-dimensional binaural sound from a stereo sound and a multi-channel sound.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The method and the configurable three-dimensional (3D) sound system disclosed herein address the above stated needs for performing 3D sound recording, processing, synthesis and reproduction to enhance existing audio performance to match a vivid 3D vision field, thereby enhancing a user's experience. The method and the configurable 3D sound system disclosed herein consider specific details such as reflection and influence from shoulders and a human torso on acoustic performance for accurately measuring head related transfer functions (HRTFs) using a simulator apparatus. The method and the configurable 3D sound system simultaneously generates a configurable three-dimensional binaural sound, a configurable three-dimensional stereo sound, and a configurable three-dimensional surround sound on a mobile computing device or other device using selections acquired from a user. The method and the configurable 3D sound system also generate a configurable three-dimensional binaural sound from a stereo sound and a multi-channel sound.

The method and the configurable 3D sound system disclosed herein provide a simulator apparatus for accurately measuring head related transfer functions (HRTFs). The simulator apparatus is configured to simulate an upper body of a human. The simulator apparatus comprises a head with detailed facial characteristics, ears, a neck, and an anatomical torso with full shoulders. As used herein, the term "facial characteristics" refers to parts of a human face, for example, lips, a nose, eyes, cheekbones, a chin, etc. The simulator apparatus is configured to texturally conform to the flesh, skin, and contours of the upper body of a human. The simulator apparatus is adjustably mounted on a turntable that can be automatically controlled and rotated for automatic measurements. The method and the configurable 3D sound system disclosed herein provide a three-dimensional (3D) sound processing application on a computing device operably coupled to a microphone. The microphone is positioned in an ear canal of each of the ears of the simulator apparatus. The 3D sound processing application is executable by at least one processor configured to measure head related transfer functions, to simultaneously generate configurable three-dimensional (3D) sounds in communication with a microphone array system, to simultaneously generate configurable 3D sounds using pre-recorded sound tracks and pre-recorded stereo sound tracks, to generate a configurable 3D binaural sound from a stereo sound or a multi-channel sound, and to generate a configurable 3D surround sound.

The method and the configurable 3D sound system disclosed herein also provide a loudspeaker configured to emit an impulse sound. As used herein, the term "impulse sound" refers to a sound wave used for recording head related impulse responses (HRIRs). As disclosed herein, the loudspeaker is configured to emit a swept sine sound signal as the impulse sound for recording HRIRs. The loudspeaker is adjustably mounted at predetermined elevations and at a predetermined distance from a center of the head of the simulator apparatus. Each microphone records responses of each of the ears to the swept sine sound signal reflected from the head, the neck, the shoulders, and the anatomical torso of the simulator apparatus for multiple varying azimuths and multiple positions of the simulator apparatus. The simulator apparatus is automatically rotated via the turntable for varying the azimuths and positions of the simulator apparatus for enabling the microphone to record the HRIRs. The 3D sound processing application receives the recorded responses from each microphone and computes HRIRs for each position of the loudspeaker. The 3D sound processing application truncates the computed HRIRs using a filter and applies a Fourier transform on the truncated HRIR to generate final head related transfer functions (HRTFs). The HRTF is also referred to as a filter. For each loudspeaker position in a three-dimensional (3D) space, the 3D sound processing application measures a pair of HRTFs for the left ear and the right ear.

The method and the configurable 3D sound system disclosed herein also simultaneously generates configurable 3D sounds, for example, a configurable 3D binaural sound, a configurable 3D stereo sound, and a configurable 3D surround sound. The method and the configurable 3D sound system disclosed herein provide a microphone array system embedded in a computing device. The microphone array system is in operative communication with the 3D sound processing application in the computing device. The microphone array system comprises an array of microphone elements positioned in an arbitrary configuration in a 3D space. The microphone array system is configured to form multiple acoustic beam patterns pointing in different directions in the 3D space. The microphone array system is also configured to form multiple acoustic beam patterns pointing to different positions of multiple sound sources in the 3D space. As used herein, the term "sound sources" refers to similar or different sound generating devices or sound emitting devices, for example, musical instruments, loudspeakers, televisions, music systems, home theater systems, theater systems, a person's voice, pre-recorded multiple sound tracks, pre-recorded stereo sound tracks, etc. The sound sources may also comprise sources from where sound originates and can be transmitted. In an embodiment, the sound source is a microphone or a microphone element that records a sound track. The microphone array system records sound tracks from the acoustic beam patterns. As used herein, the term "sound track" refers an output of an acoustic beam pattern of a microphone element of the microphone array system. Each of the recorded sound tracks corresponds to one direction in the 3D space.

The 3D sound processing application generates a configurable sound field on a graphical user interface (GUI) provided by the 3D sound processing application using the recorded sound tracks. The configurable sound field comprises a graphical simulation of similar and different sound sources in the 3D space, on the GUI. The configurable sound field is configured to allow a configuration of positions and movements of the sound sources. The 3D sound processing application acquires user selections of one or more of multiple configurable parameters associated with the sound sources from the generated configurable sound field via the GUI. The configurable parameters associated with the sound sources comprise, for example, a location, an azimuth, a distance, an evaluation, a quantity, a volume, a sound level, a sound effect, and a trace of movement of each of the sound sources. The 3D sound processing application dynamically processes the recorded sound tracks using the acquired user selections to generate a configurable 3D binaural sound, a configurable 3D surround sound, and/or a configurable 3D stereo sound. In an embodiment, the 3D sound processing application dynamically processes the recorded sound tracks with the head related transfer functions (HRTFs) based on the acquired user selections to generate the configurable 3D binaural sound. In another embodiment, the 3D sound processing application maps the recorded sound tracks to corresponding sound channels of the sound sources based on the acquired user selections to generate the configurable 3D surround sound. In another embodiment, the 3D sound processing application maps two of the recorded sound tracks to the corresponding sound channels of the sound sources based on the acquired user selections to generate the configurable 3D stereo sound.

In another embodiment, the method and the configurable 3D sound system disclosed herein also simultaneously generates configurable 3D sounds using sound tracks acquired from sound sources positioned in a 3D space without using the microphone array system. In this embodiment, the 3D sound processing application acquires the sound tracks from pre-recorded multiple sound tracks or pre-recorded stereo sound tracks. Each sound track corresponds to one direction in the 3D space. The 3D sound processing application generates the configurable sound field on the GUI using the acquired sound tracks. The 3D sound processing application acquires user selections of one or more of the configurable parameters associated with the sound sources from the generated configurable sound field via the GUI. The 3D sound processing application dynamically processes the acquired sound tracks using the acquired user selections to generate the configurable 3D sounds, for example, the configurable three-dimensional binaural sound, the configurable three-dimensional surround sound, and/or the configurable three-dimensional stereo sound as disclosed above.

The method and the configurable 3D sound system disclosed herein also generates a configurable 3D binaural sound from a sound input, for example, a stereo sound or a multi-channel sound. In this method, the 3D sound processing application acquires a sound input, for example, a stereo sound or a multi-channel sound in one of multiple formats from multiple sound sources positioned in a 3D space. In an embodiment, the microphone array system is replaced by multiple microphones positioned in a 3D space to record the sound input. The microphones positioned in the 3D space record a sound input, for example, a stereo sound or a multi-channel sound in multiple formats. The microphones are operably coupled to the 3D sound processing application. In another embodiment, the 3D sound processing application acquires any existing or pre-recorded stereo sound or multiple track sound. The 3D sound processing application segments the recorded or the pre-recorded sound input into multiple sound tracks. Each sound track corresponds to one of the sound sources. In an embodiment, the 3D sound processing application segments the recorded or pre-recorded stereo sound into multiple sound tracks by applying pre-trained acoustic models to the recorded or pre-recorded stereo sound to recognize and separate the recorded or pre-recorded stereo sound into sound tracks. The 3D sound processing application is configured to train the pre-trained acoustic models based on pre-recorded sound sources.

In another embodiment, the 3D sound processing application is configured to decode the recorded or pre-recorded multi-channel sound to identify and separate sound tracks from multiple sound channels associated with the multi-channel sound. Each of the sound channels corresponds to one of the sound sources. The 3D sound processing application generates the configurable sound field on the GUI using the sound tracks. The 3D sound processing application acquires user selections of one or more of the configurable parameters associated with the sound sources from the generated configurable sound field via the GUI. The 3D sound processing application measures multiple head related transfer functions in communication with the simulator apparatus as disclosed above. The 3D sound processing application dynamically processes the sound tracks with the measured head related transfer functions based on the acquired user selections to generate the configurable 3D binaural sound from the sound input, that is, from the stereo sound or the multi-channel sound.

The method and the configurable 3D sound system disclosed herein also generate a configurable 3D surround sound. In this embodiment, the microphone array system embedded in the computing device is configured to form multiple acoustic beam patterns pointing in different directions in the 3D space, or to different positions of the sound sources in the 3D space. The microphone array system records sound tracks from the acoustic beam patterns output from sound channels of the microphone elements in the microphone array system. Each of the recorded sound tracks corresponds to one of the positions of the sound sources. The 3D sound processing application generates the configurable sound field on the GUI using the recorded sound tracks. The 3D sound processing application acquires user selections of one or more of the configurable parameters associated with the sound sources from the generated configurable sound field via the GUI. The 3D sound processing application maps the recorded sound tracks with corresponding sound channels of the sound sources based on the acquired user selections to generate the configurable 3D surround sound. In an embodiment, the 3D sound processing application has one sound track corresponding to one sound channel as defined by the 3D surround sound, that is, each sound track corresponds to one sound source direction.

The method and the configurable 3D sound system disclosed herein implement advanced signal processing technology for generating configurable 3D sounds. The method and the configurable 3D sound system disclosed herein enable recording of 3D sound with handheld devices, for example, a smart phone, a tablet computing device, etc., in addition to professional studio recording equipment. The method and the configurable 3D sound system disclosed herein facilitate 3D sound synthesis and reproduction to allow users to experience 3D sound, for example, through a headset or a home theater loudspeaker system. Since signal processing computation is performed by the 3D sound processing application provided on a handheld device, for example, on a smart phone or a tablet computing device, users can configure the 3D sound arrangements on their handheld device. For example, a user listening to a multiple instrument musical recording can focus in on a single instrument using the configurable 3D sound system disclosed herein. In another example, a listener can have a singer sing a song around him/her using the configurable 3D sound system disclosed herein. The listener can also assign musical instruments to desired locations using the configurable 3D sound system disclosed herein. Users can control the configurations, for example, using a touch screen on their handheld devices. While 3D video has already had an enormous impact on the film, home theater, gaming, and television markets, the configurable 3D sound system disclosed herein extends 3D sound to recorded music and provides users with an enhanced method of experiencing music, movies, video games, and their own recorded 3D sounds on their handheld devices.

The configurable 3D sound system disclosed herein can enhance economic growth in the media industry by consumer demand in all things 3D. The configurable 3D sound system disclosed herein supports products on next generation 3D music, 3D home video, 3D television (TV) programs, and 3D games. Furthermore, the configurable 3D sound system disclosed herein can have a commercial impact on the smart phone and tablet markets. The configurable 3D sound system disclosed herein can be implemented in all handheld computing devices to allow users to record and play 3D sound. The configurable 3D sound system disclosed herein allows individual users to record and reproduce 3D sound for playback on their headsets and home theater speaker systems, thereby allowing users to experience immersive 3D sound.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION OF THE INVENTION

Figure 1:
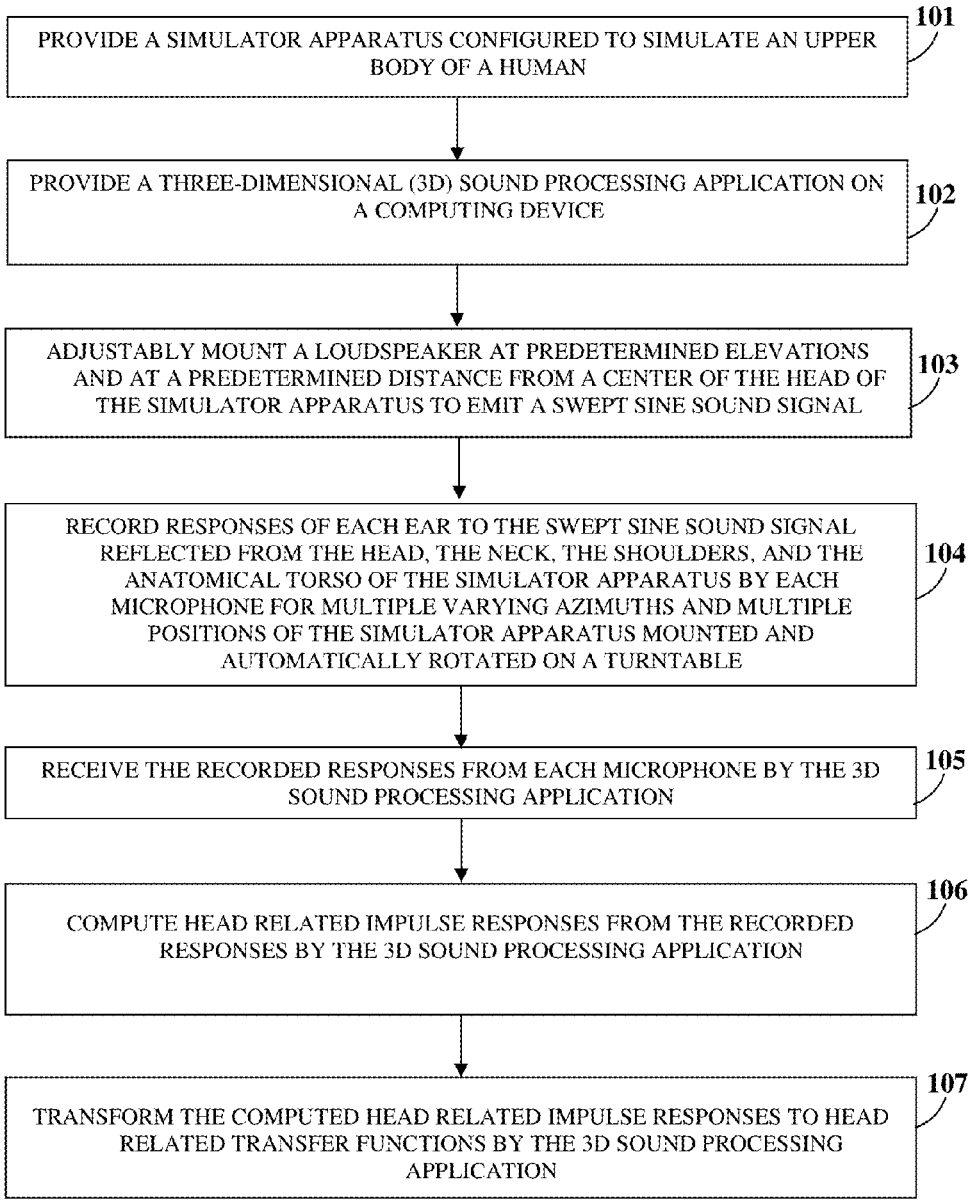
FIG. 1 illustrates a method for measuring head related transfer functions using a simulator apparatus and a loudspeaker.

FIG. 1 illustrates a method for measuring head related transfer functions (HRTFs) using a simulator apparatus and a loudspeaker. The method disclosed herein provides 101 a simulator apparatus configured to simulate an upper body of a human. The simulator apparatus comprises a head with detailed facial characteristics, ears, a neck, and an anatomical torso with full shoulders as exemplarily illustrated in FIGS. 3A-3C. As used herein, the term "facial characteristics" refers to parts of a human face, for example, lips, a nose, eyes, cheekbones, a chin, etc. The simulator apparatus is configured to texturally conform to the flesh, skin, and contours of the upper body of a human. The materials customized for the simulator apparatus comprise artificial soft skin and flesh for the entire exposed area, that is, the head and the neck. A microphone, for example, a pressure microphone is positioned inside each ear canal of each ear corresponding to the location of the ear canals of an actual average size human with acoustic regard to the pinnae shape and size. The simulator apparatus is mounted on a turntable to allow automatic measurements at all angles and in all directions. The simulator apparatus is automatically rotated via the turntable for varying azimuths and positions of the simulator apparatus.

The method disclosed herein also provides 102 a three-dimensional (3D) sound processing application on a computing device. The computing device is, for example, a portable device such as a mobile phone, a smart phone, a tablet computing device, a personal digital assistant, a laptop, a network enabled device, a touch centric device, an image capture device such as a camera, a camcorder, a recorder, a gaming device, etc., or a non-portable device such as a personal computer, a server, etc. The 3D sound processing application is operably coupled to the microphones positioned in the ear canals of the simulator apparatus. The 3D sound processing application is executable by at least one processor configured to measure the head related transfer functions.

The method disclosed herein adjustably mounts 103 a loudspeaker at predetermined elevations and at a predetermined distance from a center of the head of the simulator apparatus. The loudspeaker is configured to emit an impulse sound. As used herein, the term "impulse sound" refers to a sound wave used for recording head related impulse responses (HRIRs). Also, as disclosed herein, the loudspeaker is configured to emit a swept sine sound signal as the impulse sound for recording head related impulse responses. In theory, an impulse response can be measured by applying an impulse sound; however in practice, since there is no ideal impulse sound, a swept sine sound signal is used to obtain a reliable measurement of the head related impulse response. The microphones positioned in the ear canals of the simulator apparatus detect the swept sine sound signal emitted by the loudspeaker.

Each microphone records 104 responses of each ear to the swept sine sound signal reflected from the head, the neck, the shoulders, and the anatomical torso of the simulator apparatus for multiple varying azimuths and multiple positions of the simulator apparatus. The simulator apparatus is automatically rotated on the turntable for varying the azimuths and the positions of the simulator apparatus for enabling the microphone to record the responses. The microphones record the responses to the swept sine sound signal in a quiet sound treated room free of impulsive background noise using, for example, 72 different horizontal azimuths ranging, for example, from about 0° to about 355° in about 5° increments and at elevations ranging, for example, from about 0° to about 90° in about 10° increments. Furthermore, the microphones record the responses at each elevation for each horizontal azimuth, thereby completely covering head related transfer function (HRTF) measurements in a 180° hemisphere looking from the top of the head of the simulator apparatus down. This involves a total of 648 measurements, 72 azimuths by 9. The 3D sound processing application receives 105 the recorded responses from each microphone and computes 106 head related impulse responses (HRIR) from the recorded responses.

Figure 2:
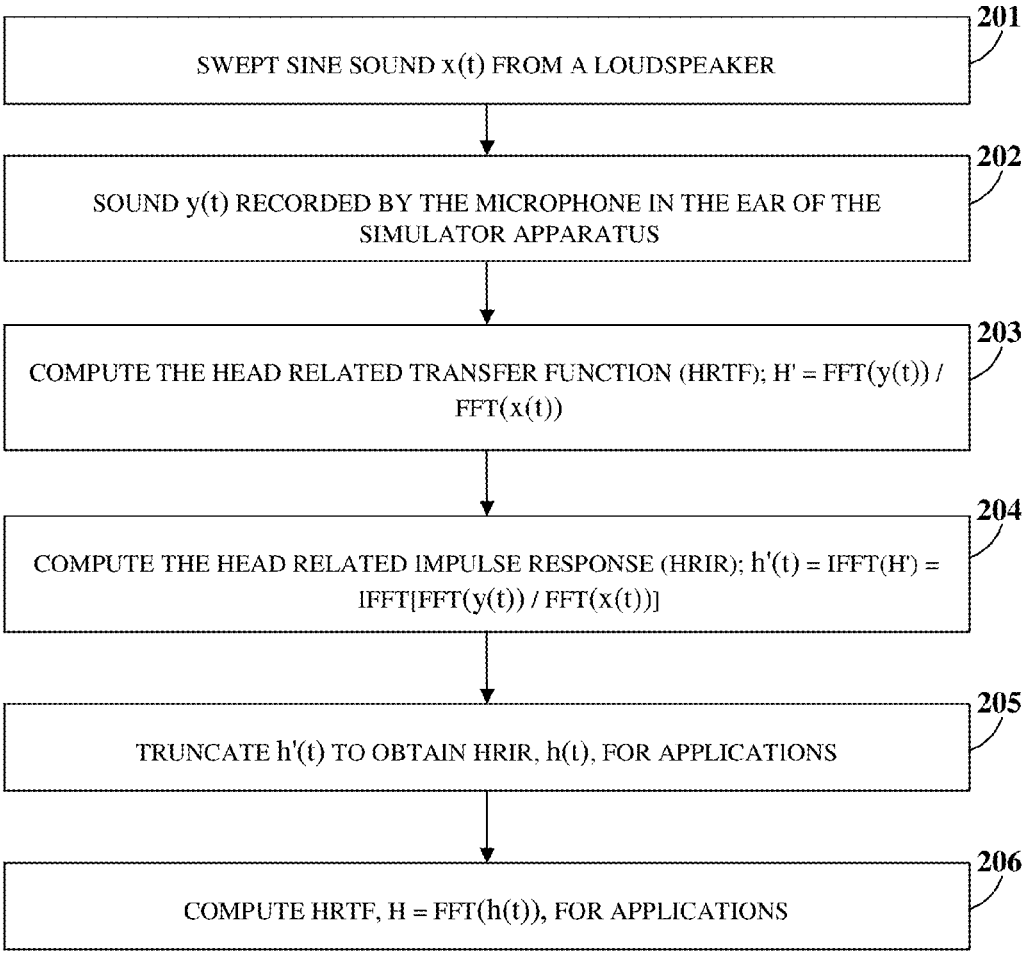
FIG. 2 exemplarily illustrates a process flow diagram comprising the steps for measuring head related transfer functions using a simulator apparatus, a loudspeaker, and a three-dimensional sound processing application.

The 3D sound processing application transforms 107 the computed head related impulse responses (HRIRs) to head related transfer functions (HRTFs) as disclosed in the detailed description of FIG. 2. For example, the 3D sound processing application applies a Fourier transform to the computed HRIR to generate the HRTF. The Fourier transform of the head related impulse response (HRIR) is referred to as the head related transfer function (HRTF). The 3D sound processing application truncates the computed HRIRs using a filter prior to the measurement of the HRTFs. Both the HRIR and the HRTF can be used as filters to compute three-dimensional (3D) binaural sound. In a time domain, the computation of filtering performed by the 3D sound processing application is a convolution of the HRIR with a recorded sound track. In a frequency domain, the computation performed by the 3D sound processing application is a multiplication of the HRTF with the recorded sound track. The implementations of the HRTF or the HRIR are, for example, digital filters or analog filters in a hardware implementation or a software implementation. The 3D sound processing application measures the HRTFs once and stores the measured HRTFs in an HRTF database for further use.

FIG. 2 exemplarily illustrates a process flow diagram comprising the steps for measuring head related transfer functions (HRTFs) using the simulator apparatus, the loudspeaker, and the three-dimensional (3D) sound processing application. The loudspeaker is adjustably mounted at 10° elevations from 0° to 90° and at a one meter distance from the center of the head of the simulator apparatus at each elevation. At each elevation, the loudspeaker is configured to emit a swept sine sound signal x(t). The microphone positioned in each ear canal of the simulator apparatus receives 201 the swept sine sound signal x(t) from the loudspeaker and records 202 the sound or response y(t) of each ear to the swept sine sound signal reflected from the head, the neck, the shoulders, and the anatomical torso of the simulator apparatus as disclosed in the detailed description of FIG. 1. The 3D sound processing application operably coupled to the microphones applies a fast Fourier transform (FFT) to the received swept sine sound signal x(t) and to the response y(t) and computes 203 an intermediate head related transfer function represented as H' using the formula below:

$$H'=\mathrm{FFT}(y(t))/\mathrm{FFT}(x(t))$$

The 3D sound processing application then computes 204 an intermediate head related impulse response (HRIR) represented as h'(t) by applying an inverse fast Fourier transform (IFFT) to the computed intermediate head related transfer function (HRTF) using the formula below:

$$h'(t)=\mathrm{IFFT}(H')=\mathrm{IFFT}[\mathrm{FFT}(y(t))/\mathrm{FFT}(x(t))]$$

The 3D sound processing application then truncates 205 the computed intermediate head related impulse response (HRIR) to obtain the resultant HRIR represented as h(t) for applications. The 3D sound processing application truncates the HRIR to reduce environmental reflections and other distortions and for future implementation. The 3D sound processing application then computes 206 the resultant head related transfer function (HRTF) represented as H for applications by applying the fast Fourier transform (FFT) to the resultant HRIR using the formula below:

$$H=\mathrm{FFT}[h(t)]$$

To differentiate between the first set of measurements and the second set of measurements, the terms HRIR' and HRTF' are used as the originals without truncating and the terms HRIR and HRTF are used as the truncated resultants for further use in applications.

The configurable three-dimensional (3D) sound system disclosed herein renders 3D sound with binaural effects or surround sound effects through the head related transfer functions (HRTFs) to synthesis virtual sound sources. The configurable 3D sound system disclosed herein uses HRTFs to place the virtual sound sources, which are output, for example, from regular stereo or 5.1 surround sound, on a certain location to achieve 3D spatial effects. By using banks of HRTFs, the configurable 3D sound system disclosed herein enables positioning of sound sources on a two-dimensional (2D) plane for mixing 5.1 or 7.1 channel surround sounds from recorded dry sound, in the process of audio post production.

Figure 3A:
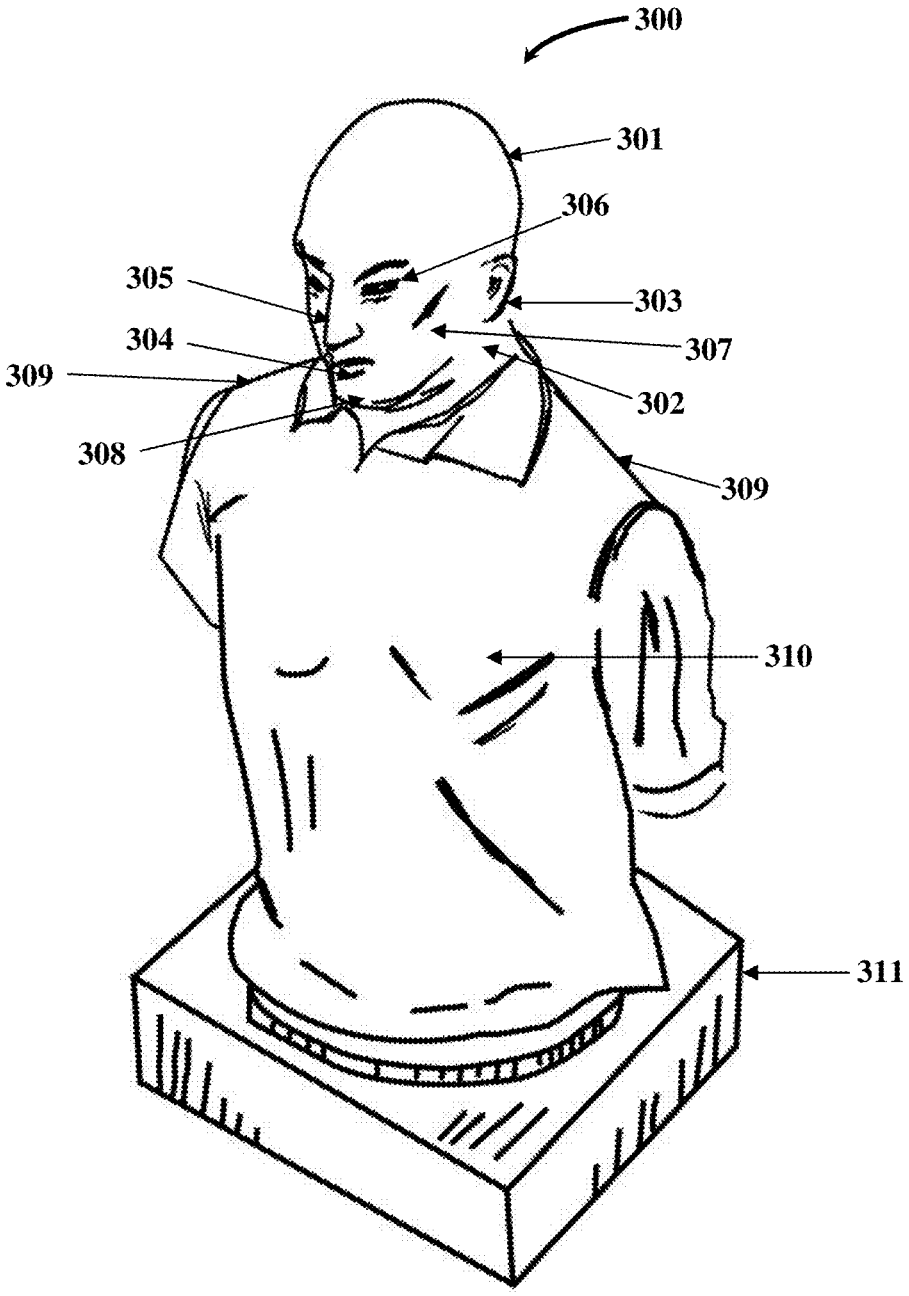
FIG. 3A exemplarily illustrates a perspective view of the simulator apparatus configured to simulate an upper body of a human, where the simulator is adjustably mounted on a turntable.
Figure 3B:
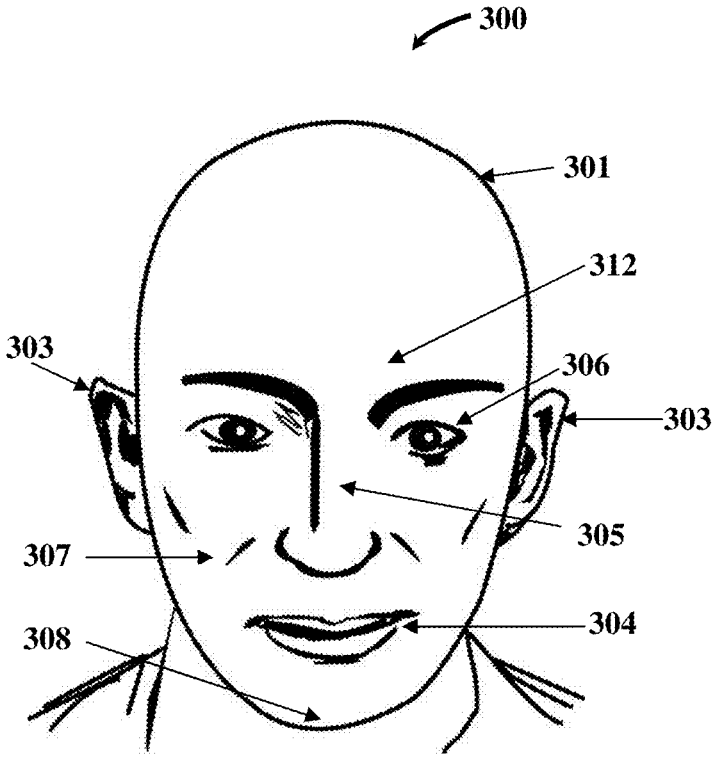
FIG. 3B exemplarily illustrates a front elevation view of the simulator apparatus.
Figure 3C:
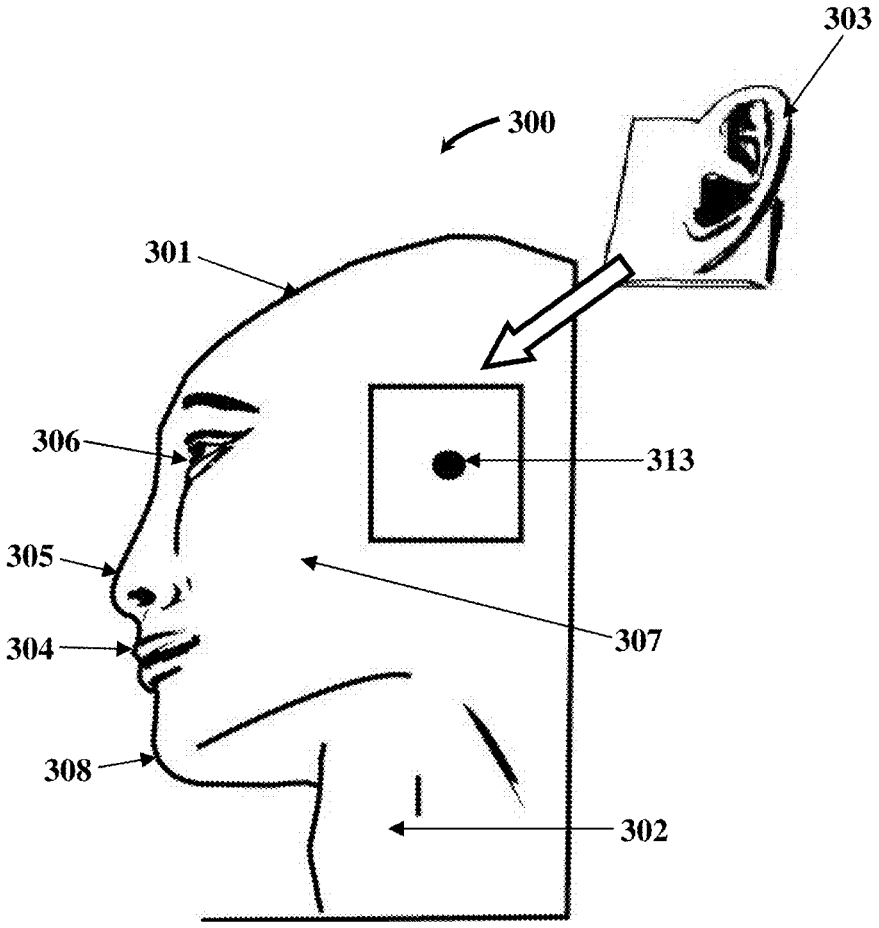
FIG. 3C exemplarily illustrates a cutaway side perspective view of the simulator apparatus, showing a microphone positioned in an ear of the simulator apparatus.

FIGS. 3A-3C exemplarily illustrate different views of the simulator apparatus 300 configured to simulate an upper body of a human. FIG. 3A exemplarily illustrates a perspective view of the simulator apparatus 300 adjustably mounted on a turntable 311 and configured for automatic measurement of head related transfer functions (HRTFs). The simulator apparatus 300 is configured to accurately reflect the anthropometric dimensions of a typical human. The simulator apparatus 300 has a life size head 301, a neck 302, shoulders 309, an upper anatomical torso 310, and realistic and detailed facial characteristics comprising, for example, lips 304, a nose 305, eyes 306, cheekbones 307, a chin 308, etc. The head 301 of the simulator apparatus 300 is configured to have a detailed face 312 with dimensions that match closely with the American National Standards Institute (ANSI) S3.36-1985 reaffirmed by ANSI in 2006, the International Telecommunication Union Telecommunication (ITU-T) Standardization Sector ITU-T P. 58, the International Electrotechnical Commission (IEC) 60659, and applicable dimensions of the 1988 anthropometric study.

FIG. 3B exemplarily illustrates a front elevation view of the simulator apparatus 300, showing details of the face 312, that is, the facial characteristics of the simulator apparatus 300. FIG. 3C exemplarily illustrates a cutaway side perspective view of the simulator apparatus 300, showing a microphone 313 positioned in an ear 303 of the simulator apparatus 300. Each ear 303 of the simulator apparatus 300 accurately resembles the human ear with regards to the pinnae shape and size, and acoustics. The simulator apparatus 300 exemplarily illustrated in FIGS. 3A-3C provide a precise simulation of a human head, the human torso, human ears, and flesh and skin texture, and contours for HRTF measurement and binaural recording. The shape of the face 312, the reflection of the shoulders 309, soft skin, clothes, and the full anatomical torso 310 of the simulator apparatus 300 are taken into consideration to measure accurate HRTFs.

Figure 4:
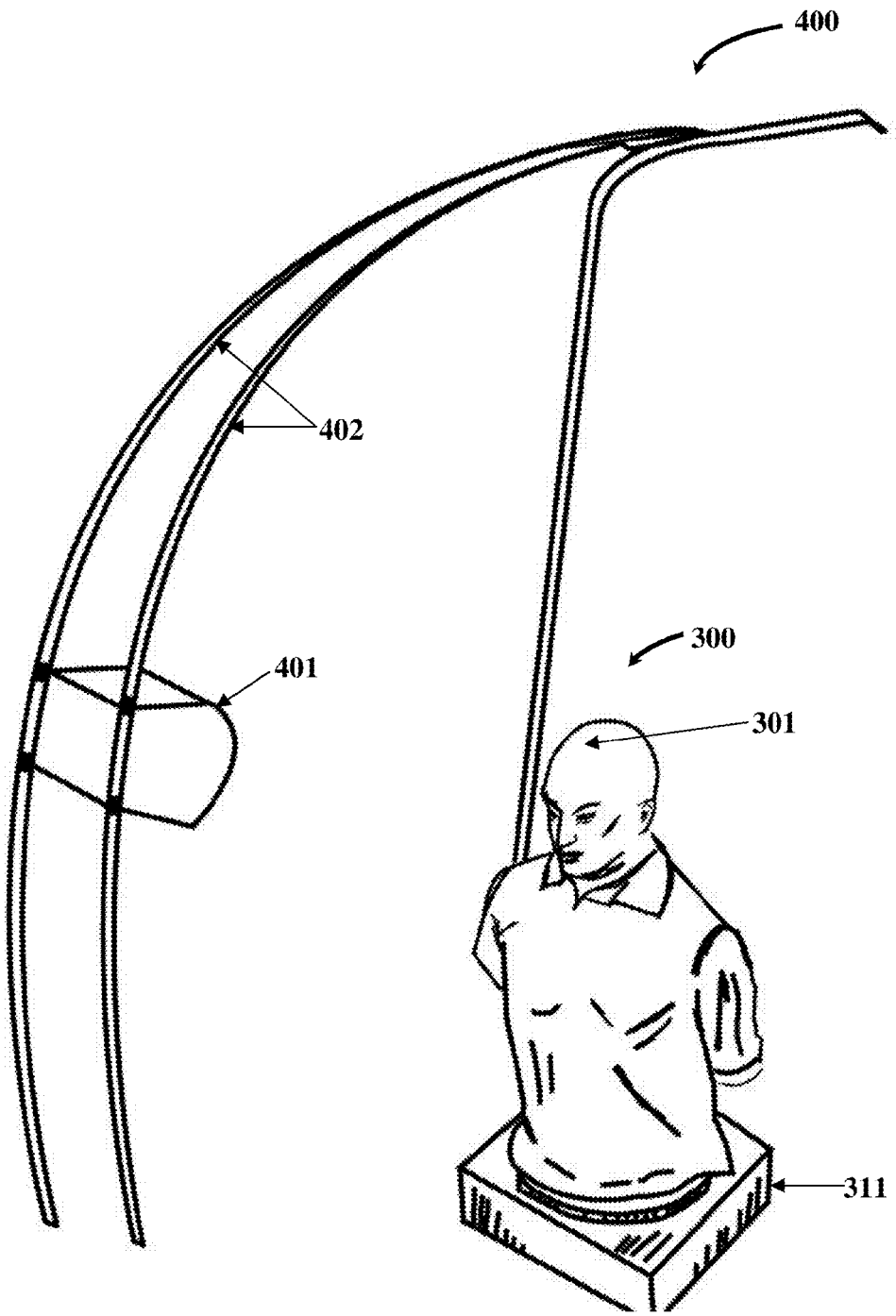
FIG. 4 exemplarily illustrates a head related transfer function measurement system comprising the simulator apparatus and a loudspeaker adjustably mounted at an 80° elevation with the simulator apparatus at a 0° horizontal azimuth.

FIG. 4 exemplarily illustrates a head related transfer function (HRTF) measurement system 400 comprising the simulator apparatus 300 and a loudspeaker 401 adjustably mounted at an 80° elevation with the simulator apparatus 300 at a 0° horizontal azimuth. The loudspeaker mounting hardware 402 allows precise mounting of the loudspeaker 401 at 10° elevations from 0° to 90° and at a one meter distance from the center of the head 301 of the simulator apparatus 300 at each elevation for enabling accurate measurement of the HRTFs as disclosed in the detailed description of FIG. 1.

Figure 5:
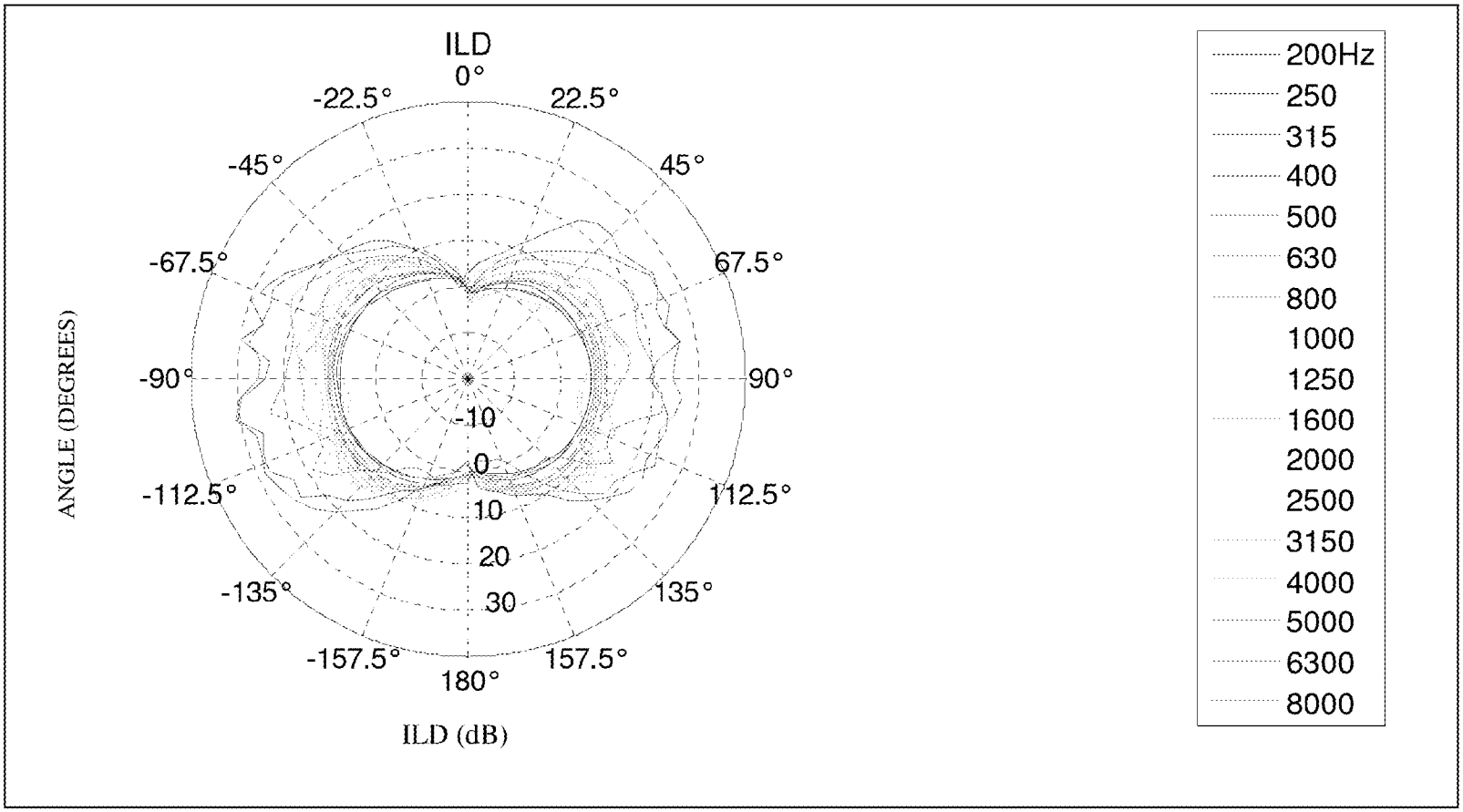
FIG. 5 exemplarily illustrates a graphical representation showing interaural level differences measured at different frequencies.

FIG. 5 exemplarily illustrates a graphical representation showing interaural level differences (ILDs) measured at different frequencies. In the graphical representation exemplarily illustrated in FIG. 5, the polar axis is in degrees azimuth and the concentric axis is in decibels (dB). The interaural level difference (ILD) is one of the three cues that help humans localize sound sources in a three-dimensional (3D) spatial field. The interaural level difference is the difference in level and/or intensity of transmitted sound received between the two ears. The other cues are interaural time difference (ITD) and spectral cue. The combination of the three cues are modeled by a pair of filters on the left ear and the right ear of a human being separately in order to describe the spatial effect which is recognizable by human hearing. The transfer functions of these filters are the head related transfer functions (HRTFs). The interaural level difference of the anatomical torso 310 of the simulator apparatus 300 exemplarily illustrated in FIG. 3A, closely mimics the average head related transfer function (HRTF) of a median human. Since different effects are caused by different locations of sound sources, the HRTFs are a bank by positions. The 3D sound processing application computes the HRTFs by obtaining the head related impulse response (HRIR) of each ear 303 of the simulator apparatus 300 exemplarily illustrated in FIGS. 3A-3C at varying azimuths as disclosed in the detailed description of FIGS. 1-2. These azimuths are chosen based on symmetry and also because they provide a fine structure to the HRTF.

Consider an example where a loudspeaker 401 exemplarily illustrated in FIG. 4, plays a 5-second swept sine sound signal. The microphone 312 in each of the ears 303 of the simulator apparatus 300 exemplarily illustrated in FIG. 3C, records the 5-second swept sine sound signal at one position of the simulator apparatus 300. After the recording at one position of the simulator apparatus 300 is obtained, an operator or a software controlled motor repeatedly rotates the simulator apparatus 300 on the turntable 311 to the next position as per the instructions of the turntable 311 and records the head related impulse response (HRIR). The 3D sound processing application collects and computes the HRIR at all the azimuths. The recorded response signal for each azimuth is a distorted signal received from the generated swept sine sound signal. In order to compute the HRIR, the loudspeaker 401 transmits a swept sine sound signal x(t) as disclosed in the detailed description of FIG. 2. The 3D sound processing application transforms the computed HRIR by applying a fast Fourier transform to the HRIR to generate the head related transfer function (HRTF). The scope of the method and the configurable 3D sound system disclosed herein is not limited to obtaining an HRIR using the swept sine sound signal but may be extended to obtain the HRIR using, for example, a white noise signal or other types of signals or sound waves to obtain the HRIR.

Figure 6A:
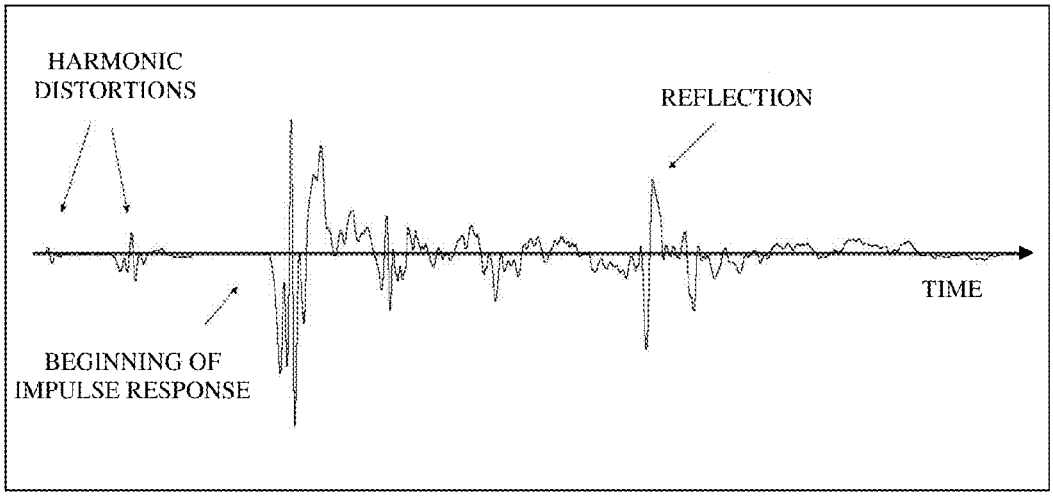
FIGS. 6A-6B exemplarily illustrate graphical representations showing a head related impulse response of an ear of the simulator apparatus, recorded and computed by the three-dimensional sound processing application.
Figure 6B:
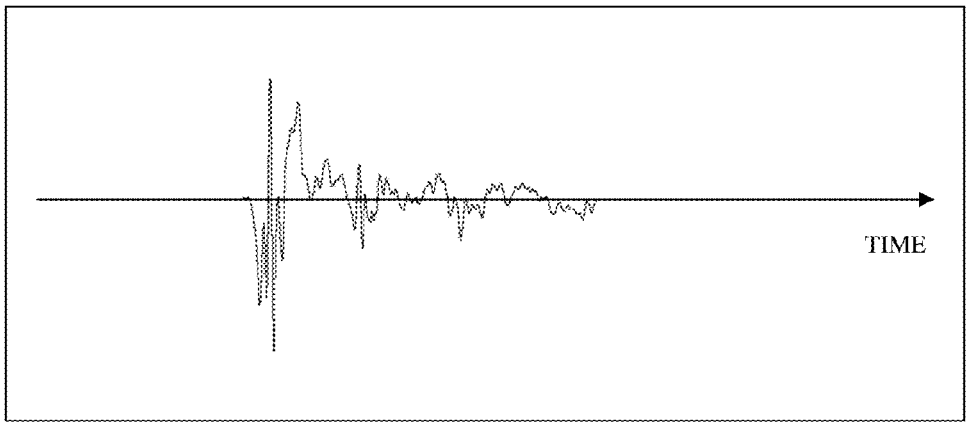

FIGS. 6A-6B exemplarily illustrate graphical representations showing a head related impulse response (HRIR) of an ear 303 of the simulator apparatus 300 exemplarily illustrated in FIGS. 3A-3C, recorded and computed by the three-dimensional (3D) sound processing application. Each microphone 313 exemplarily illustrated in FIG. 3C, records the HRIR of the corresponding ear 303 of the simulator apparatus 300 as disclosed in the detailed description of FIG. 2. The actual HRIR occurs at the largest spike as exemplarily illustrated in FIG. 6A. A small transient appearing before the main spike is considered a distortion or noise. Any significant large spikes appearing more than 2 milliseconds (ms) away from the main spike in the shape of the head related impulse response, that is, for example, 0.68 meters further than the direct sound, is considered a reflection or an echo from other objects other than that from the simulator apparatus 300 itself. Any smaller significant spikes appearing before the main spike are considered as distortions or noise and must be removed from the signal. FIG. 6B exemplarily illustrates the truncated HRIR generated by the 3D sound processing application. The 3D sound processing application utilizes the truncated HRIR and the corresponding HRTF to generate or synthesize 3D binaural sound. The 3D sound processing application truncates the unwanted distortions and reflections.

The microphones 313 record the primary acoustic reflections from the shoulders 309 of the simulator apparatus 300 in order to accurately mimic the binaural acoustic situation in a real human being. In general, the distance between the ear 303 and the shoulder 309 is about 177 millimeter and sound travels at 340 meters per second. Therefore, it takes about 0.5 milliseconds for the refection off the shoulder 309 to reach the ear 303 and give a peak very close to the main spike. Consider an example where the ears 303 of the simulator apparatus 300 are about 790 millimeters from the ground which is the closest non-simulator reflecting surface. The main acoustic reflection is displayed in recordings at roughly more than at least about 2 ms after the main spike and is used as a reference to choose the length of the head related impulse response (HRIR).

Figure 7:
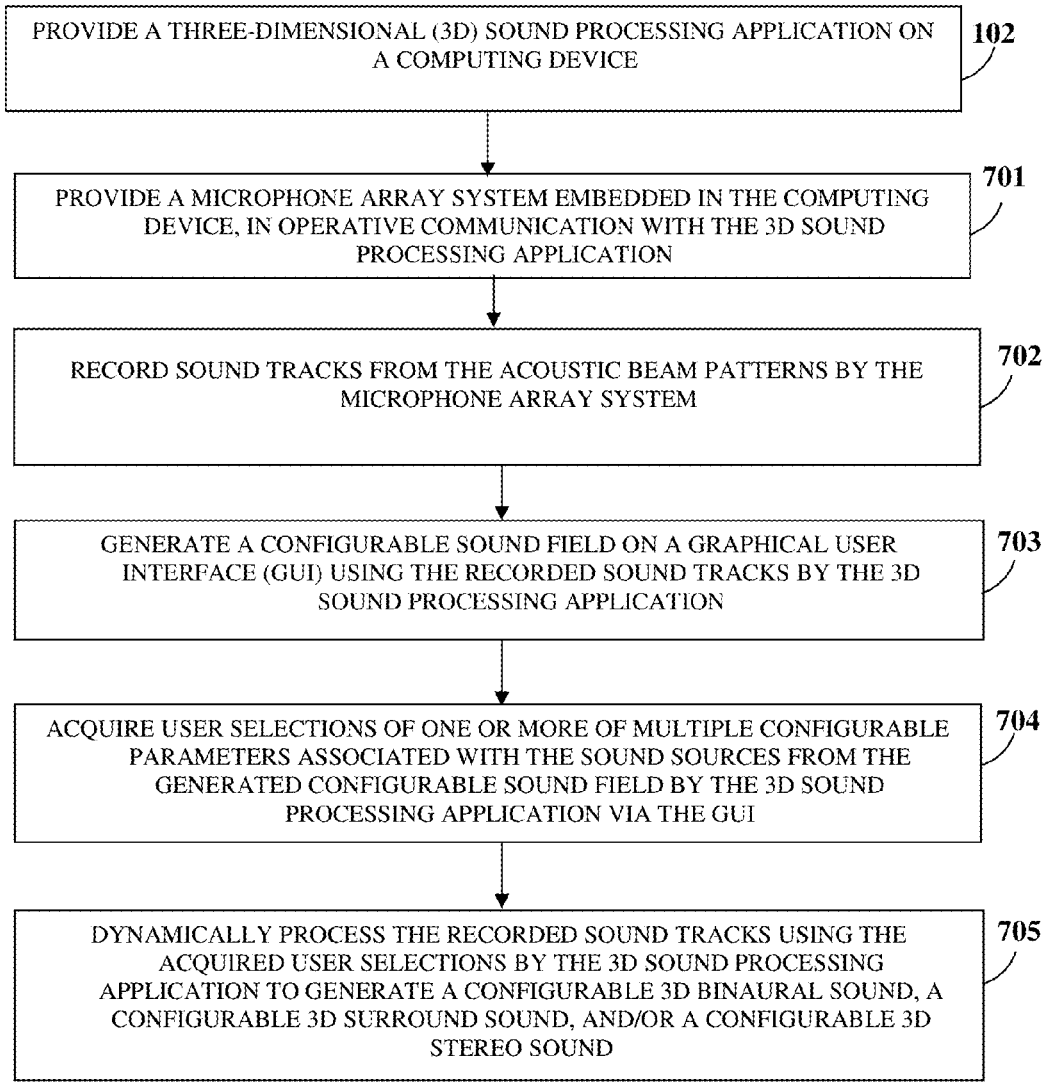
FIG. 7 illustrates a method for simultaneously generating configurable three-dimensional sounds using a microphone array system.

FIG. 7 illustrates a method for simultaneously generating configurable three-dimensional (3D) sounds using a microphone array system. Three-dimensional (3D) sound comprises 3D surround sound, 3D binaural sound, and 3D stereo sound. 3D sound comprises, for example, music, speech, any audio signal, etc., and is used with or without 3D images, 3D movies, and 3D videos. 3D sound allows a user to experience sound in a 3D space. As used herein, the term "user" refers to a listener of a sound recording, or a person receiving an audio signal on audio media. The 3D sound is represented as a 3D binaural sound when used with a headset or as a 3D surround sound when used with multiple loudspeakers, for example, in a home theater speaker system. The 3D stereo sound is considered as a special case of the 3D sound.

As exemplarily illustrated in FIG. 7, the method disclosed herein for simultaneously generating configurable 3D sounds provides 102 the 3D sound processing application on a computing device, for example, a smart phone, a tablet computing device, a laptop, a camera, a recorder, etc. The 3D sound processing application is executable by at least one processor configured to simultaneously generate the configurable 3D sounds. The method disclosed herein also provides 701 a microphone array system embedded in the computing device. The microphone array system is in operative communication with the 3D sound processing application in the computing device. The microphone array system comprises an array of microphone elements positioned in an arbitrary configuration in a 3D space as disclosed in the co-pending non-provisional U.S. patent application Ser. No. 13/049,877 titled "Microphone Array System" filed on Mar. 16, 2011 in the United States Patent and Trademark Office.

The microphone array system is configured to form multiple acoustic beam patterns pointing in different directions in the 3D space. The microphone array system is also configured to form multiple acoustic beam patterns pointing to different positions of multiple sound sources in the 3D space. As used herein, the term "sound sources" refers to similar or different sound generating devices or sound emitting devices, for example, musical instruments, loudspeakers, televisions, music systems, home theater systems, theater systems, a person's voice such as a singer's voice, pre-recorded multiple sound tracks, pre-recorded stereo sound tracks, etc. The sound sources may also comprise sources from where sound originates and can be transmitted. Each of the acoustic beam patterns are configured to point in a direction in the 3D space. In an embodiment, the microphone array system is configured with 8 acoustic beam patterns as exemplarily illustrated in FIGS. 11A-11H with corresponding 8 output sound tracks, where each sound track corresponds to one direction to record sound from the corresponding direction. As used herein, the term "sound track" refers an output of an acoustic beam pattern of a microphone element of the microphone array system.

The microphone array system records 702 sound tracks from the acoustic beam patterns. Each of the sound tracks corresponds to one of the different directions in the 3D space. One direction refers to a region in the 3D space with or without a sound source. The 3D sound generation is affected when a region in the 3D space does not include a sound source, because more than one microphone element receives a cue of the sound source. The 3D sound processing application generates 703 a configurable sound field on a graphical user interface (GUI) provided by the 3D sound processing application using the recorded sound tracks. The configurable sound field comprises a graphical simulation of the sound sources in the 3D space on the GUI. The configurable sound field comprises user related sound information in a 3D space, for example, the sound sources, locations of instruments, a moving track of the sound or the user, etc. The configurable sound field is configured to allow a configuration of positions and movements of the sound sources.

Figure 8:
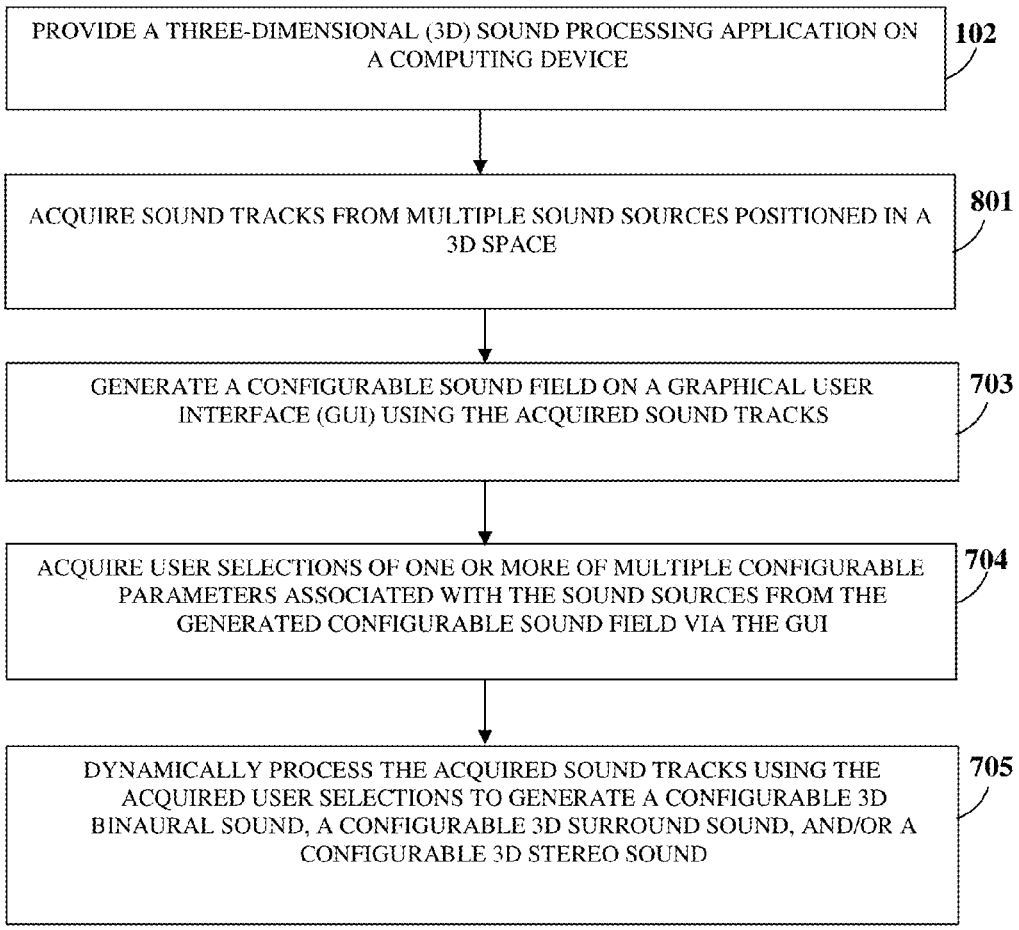
FIG. 8 illustrates an embodiment of the method for simultaneously generating configurable three-dimensional sounds without a microphone array system.

The configurable sound field comprises multiple sound sources. Each sound source can be represented by one or more than one sound track in the configurable sound field. The 3D sound processing application generates the configurable sound field from the recorded sound tracks using multiple different methods. For example, the method disclosed in the detailed description of FIG. 8 is suitable for professional recording in studios. The multiple sound tracks are recorded separately or simultaneously from a sound source, for example, a musical instrument, a singer, a speaker, etc. Each one of the sound sources has one sound track. Another method as disclosed in the detailed description of FIG. 7 utilizes sound tracks recorded by the microphone array system with multiple acoustic beam patterns pointing in different directions. The output of each acoustic beam pattern is one sound track. This second method is suitable, for example, for consumer and personal recording. In each method, the sound field can be configured by a user.

The 3D sound processing application provides the graphical user interface (GUI), for example, a touch screen user interface on the computing device. The 3D sound processing application provides the GUI to allow the user the freedom to configure the positions and movements of sound sources, in order to generate customized 3D sound. The 3D sound processing application acquires 704 user selections of one or more of multiple configurable parameters associated with the sound sources of the configurable sound field via the GUI. The configurable parameters associated with the sound sources comprise, for example, a location, an azimuth, a distance, an evaluation, a quantity, a volume, a sound level, a sound effect, and a trace of movement of each of the sound sources. The user enters the selections on the generated configurable sound field via the GUI to configure generation of the configurable 3D sounds based on user preferences. The users can configure the sound effects on the generated configurable sound field via the GUI. For example, the user can place the sound sources in specific locations, dynamically move the sound sources, focus on or zoom in on one sound source and reduce others, etc., on the generated configurable sound field via the GUI. The 3D sound processing application dynamically processes 705 the recorded sound tracks using the acquired user selections to generate one or more of a configurable 3D binaural sound, a configurable 3D surround sound, and a configurable 3D stereo sound.

In an embodiment as disclosed in the detailed description of FIGS. 1-5, the 3D sound processing application measures multiple head related transfer functions (HRTFs) in communication with the simulator apparatus 300 exemplarily illustrated in FIGS. 3A-3C and FIG. 4. The 3D sound processing application dynamically processes the recorded sound tracks with the measured head related transfer functions based on the acquired user selections to generate the configurable 3D binaural sound. With respect to music listening, when a user wants a sound track to come from one particular direction, the user enters his/her preference by placing an icon on a corresponding location on the generated configurable sound field via a touch screen of the user's computing device. The 3D sound processing application then applies the corresponding HRIR for convolution in the time domain or applies the corresponding HRTF for a multiplication in the frequency domain. Using a bank of measured HRIRs or HRTFs, the 3D sound processing application accurately positions the acoustic sound source on the spot that the user prefers. Thus, the user can place musical instruments where he/she prefers or imagines on the generated configurable sound field via the GUI, and enjoy true 3D binaural sound on a headset or true 3D sound on multiple speakers. The user, for example, can have an experience similar to that of sitting in the front row, walking through the stage, sitting among the musicians, or being in a music hall surrounded by live instruments.

In another embodiment, the 3D sound processing application maps the recorded sound tracks to corresponding sound channels of the sound sources based on the acquired user selections to generate a configurable 3D surround sound as disclosed in the detailed description of FIGS. 13A-13B, FIG. 14A, and FIG. 27. In this embodiment, each acoustic beam pattern points in one direction corresponding to one sound direction of a sound channel of a sound source for surround sound. In another embodiment, the 3D sound processing application maps two of the recorded sound tracks to corresponding sound channels of the sound sources based on the acquired user selections to generate the configurable 3D stereo sound as disclosed in the detailed description of FIG. 14B. In this embodiment, the two acoustic beam patterns point in the left direction and the right direction in the 3D space, respectively, corresponding to the directions of the sound channels of the sound sources for stereo sound.

FIG. 8 illustrates an embodiment of the method for simultaneously generating configurable three-dimensional sounds without a microphone array system. In this embodiment, the 3D sound processing application simultaneously generates the configurable 3D sounds using sound tracks acquired from sound sources positioned in a 3D space. The method disclosed herein provides 102 the 3D sound processing application on a computing device. The 3D sound processing application acquires 801 sound tracks from multiple sound sources positioned in the 3D space. Each sound track corresponds to one direction in the 3D space. The sound sources are, for example, pre-recorded multiple sound tracks or pre-recorded stereo sound tracks. The microphone array system disclosed in the detailed description of FIG. 7 is replaced by multiple microphones positioned in a 3D space to record multiple sound tracks and stereo sound tracks in this embodiment. The 3D sound processing application can therefore use any existing or pre-recorded sound tracks in this embodiment. The 3D sound processing application generates 703 the configurable sound field on the GUI using the acquired sound tracks, acquires 704 user selections of one or more configurable parameters, for example, a location, an azimuth, a distance, a sound level, a sound effect, etc., of the sound sources via the GUI, and dynamically processes 705 the acquired sound tracks using the acquired user selections to simultaneously generate the configurable 3D sounds, for example, the configurable 3D binaural sound, the configurable 3D surround sound, and the configurable 3D stereo sound as disclosed in the detailed description of FIG. 7.

Figure 9:
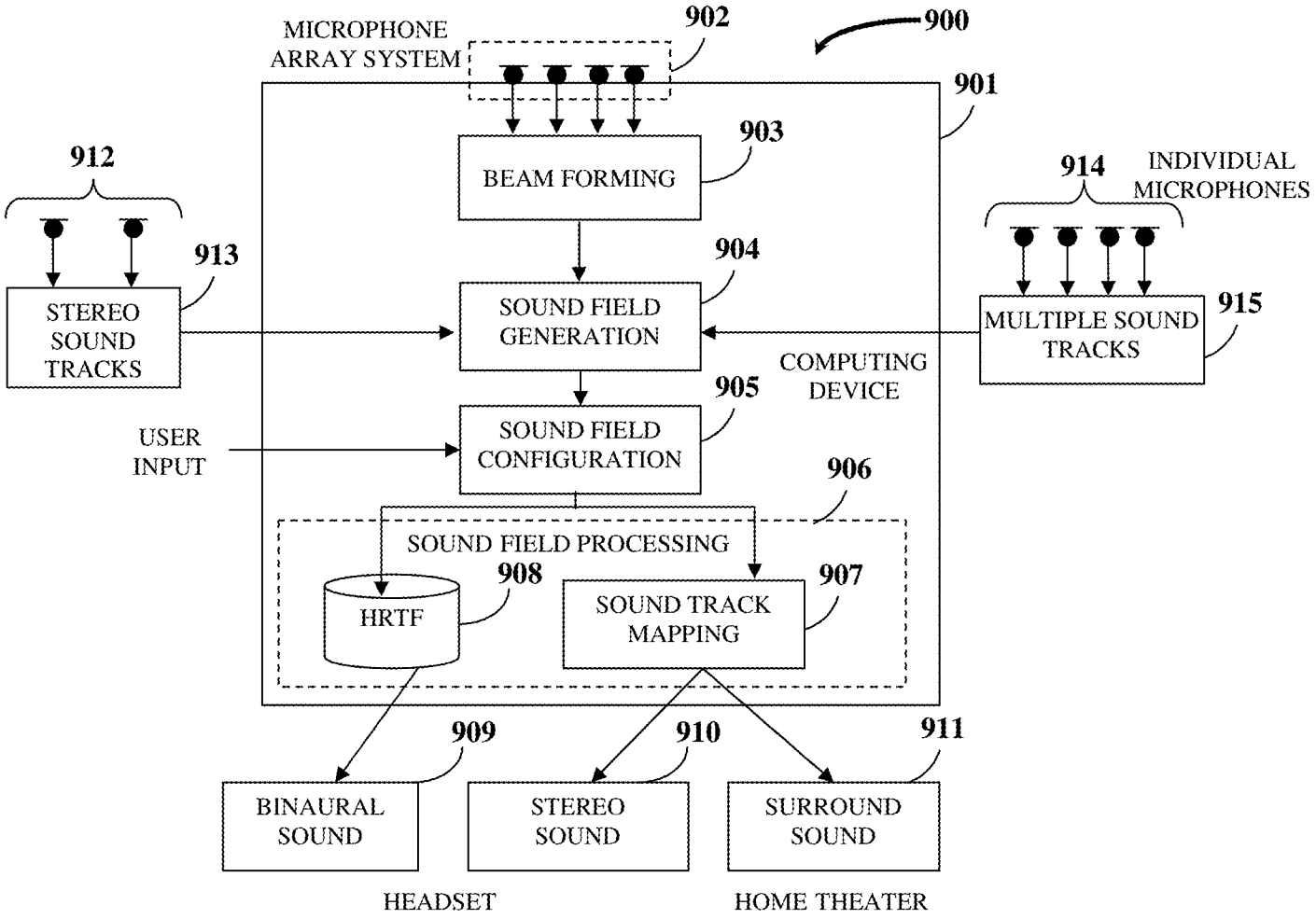
FIG. 9 exemplarily illustrates a process flow diagram comprising the steps performed by a configurable three-dimensional sound system for simultaneously generating configurable three-dimensional sounds.

FIG. 9 exemplarily illustrates a process flow diagram comprising the steps performed by a configurable three-dimensional (3D) sound system 900 for simultaneously generating configurable three-dimensional sounds 909, 910, and 911. FIG. 9 is also an overview of the configurable 3D sound system 900. FIG. 9 exemplarily illustrates the process steps performed by each component of the configurable 3D sound system 900 to generate each kind of configurable 3D sound 909, 910, and 911. The configurable 3D sound system 900 disclosed herein provides the same impact, for example, as 3D video in the multi-media industry. The configurable 3D sound system 900 disclosed herein comprises the 3D sound processing application provided on a computing device 901 embedded with a microphone array system 902. The 3D sound processing application is configured to generate 904, configure 905, and process 906 the configurable sound field. The microphone array system 902 comprises, for example, two or more microphone elements configured to form an array in an arbitrary configuration in a 3D space in the computing device 901 as disclosed in the co-pending non-provisional U.S. patent application Ser. No. 13/049,877 titled "Microphone Array System". The microphone array system 902 forms acoustic beam patterns to record 3D sounds 909, 910, and 911 from multiple directions in the 3D space.

The microphone array system 902 performs beam forming 903 to form acoustic beam patterns pointing in different directions in the 3D space or to different positions of the sound sources. The microphone array system 902 records multiple sound tracks corresponding to the multiple acoustic beam pattern directions. The sound tracks recorded by the microphone array system 902 are stored in a memory or a storage device (not shown). The 3D sound processing application of the configurable 3D sound system 900 performs sound field generation 904 to generate a configurable sound field on a graphical user interface (GUI). Each sound source in the configurable sound field corresponds to one sound track. The 3D sound processing application of the configurable 3D sound system 900 acquires user inputs to configure 905 the configurable sound field based on the user's preferences. The 3D sound processing application synthesizes and reproduces the user preferred sound field using the measured head related transfer functions (HRTFs) stored in a head related transfer function (HRTF) database 908. The 3D sound processing application performs sound track mapping 907 by convolving each of the sound tracks with corresponding HRTFs stored in the HRTF database 908 to synthesis 3D binaural sound 909 for a headset user.

The configuration of the 3D surround sound 911 via the GUI, for example, on a touch screen of the computing device 901 is similar to the configuration of 3D binaural sound 909. The sound tracks 915 are obtained from individual microphones 914 or from the microphone array system 902. The 3D sound processing application maps 907 the sound tracks 915 to a corresponding sound channel of surround sound 911 for home theaters to reproduce 3D surround sound 911. In an embodiment, by using the microphone array system 902, the 3D sound processing application on a portable computing device 901 can be used to record and produce 3D surround sound 911. In another embodiment, the 3D surround sound 911 is generated by positioning multiple microphones 914 in different locations and/or directions in a 3D space, for example, a studio, and recording multiple sound tracks 915. In another embodiment, the 3D surround sound 911 is recorded by merging multiple mono sound tracks 915. The microphone array system 902 forms two acoustic beam patterns to record the 3D stereo sound 910. To generate the 3D stereo sound 910, the 3D sound processing application maps 907 two stereo sound tracks 913 recorded using the two acoustic beam patterns with the corresponding sound channels of stereo sound 910 of the sound sources. In an embodiment, the 3D stereo sound 910 is generated by positioning two separate microphones 912 in the 3D space and recording stereo sound tracks 913. The sound tracks 913 and 915 can be recorded or pre-recorded on the same computing device 901 or on different computing devices. The 3D sound processing application processes existing sound tracks in addition to the recorded sound tracks.

Consider an example where a user is listening to a classical recording of a cellist, accompanied by other instruments, on his/her smart phone. If the user wants to hear the cellist prominently, the user enlarges the cellist's image on the generated configurable sound field via the touch screen of the smart phone and the 3D sound processing application enhances the sound of the cello. If the user wants a sound to virtually move around on the stage, the user draws a path on the generated configurable sound field via the touch screen and the 3D sound processing application synthesizes the sound effect along the selected path. Based on the user's input, the 3D sound processing application reproduces the 3D binaural sound 909, the 3D stereo sound 910, and the 3D surround sound 911. The 3D sound processing application configures 905 the sound field on the touch screen of the user's computing device 901 or a remote control. The 3D sound processing application records both audio and spatial information such that the recorded sound can be processed and reproduced to 3D sound. The configurable 3D sound system 900 is low cost and implementable in most computing devices 901.

Figure 10:
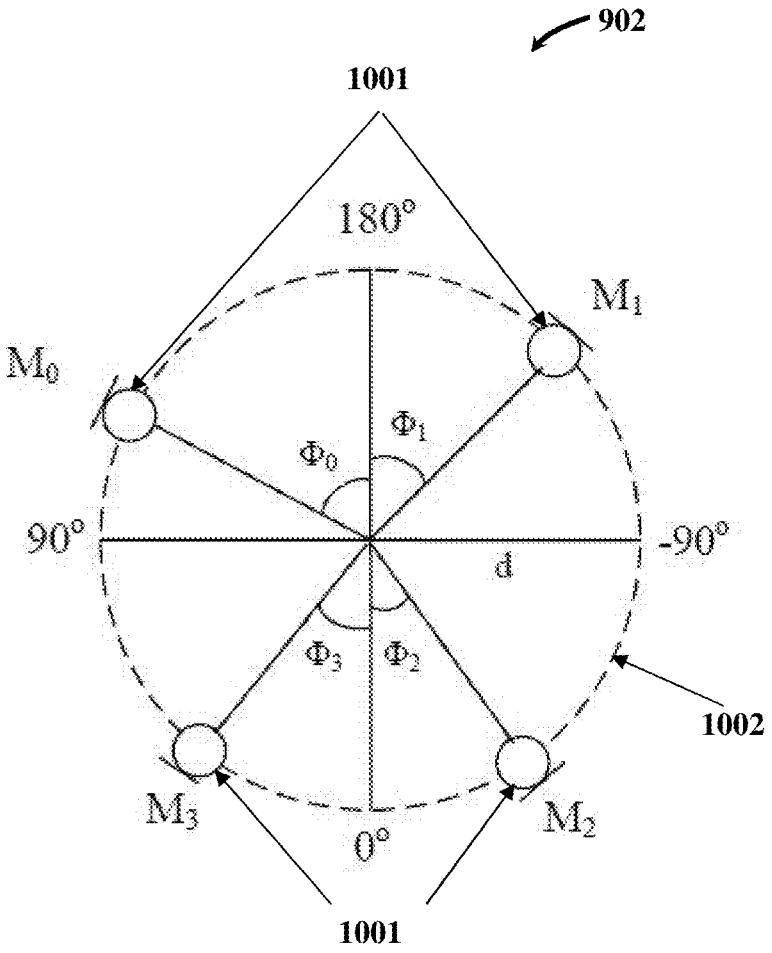
FIG. 10 exemplarily illustrates a microphone array configuration showing a microphone array system having N microphone elements arbitrarily distributed on a circle.
Figure 11A:
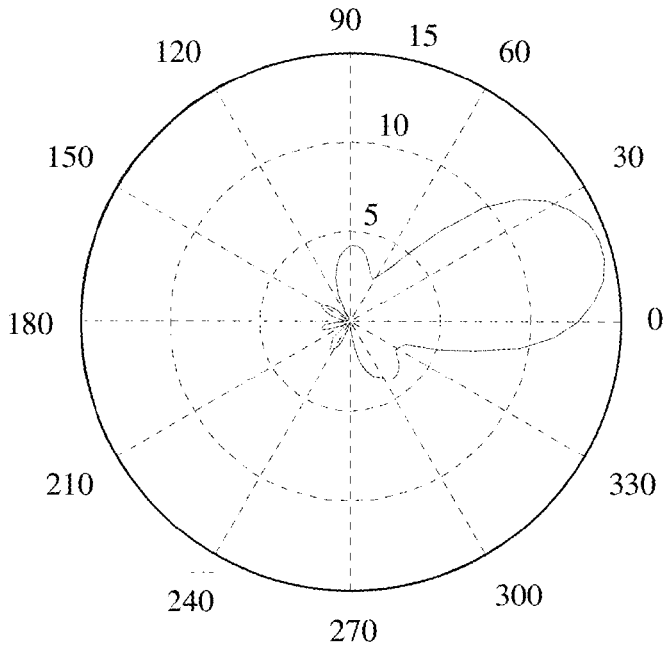
FIGS. 11A-11H exemplarily illustrate results of computer simulations of an eight-sensor microphone array system, showing directional acoustic beam patterns of the eight-sensor microphone array system.
Figure 11B:
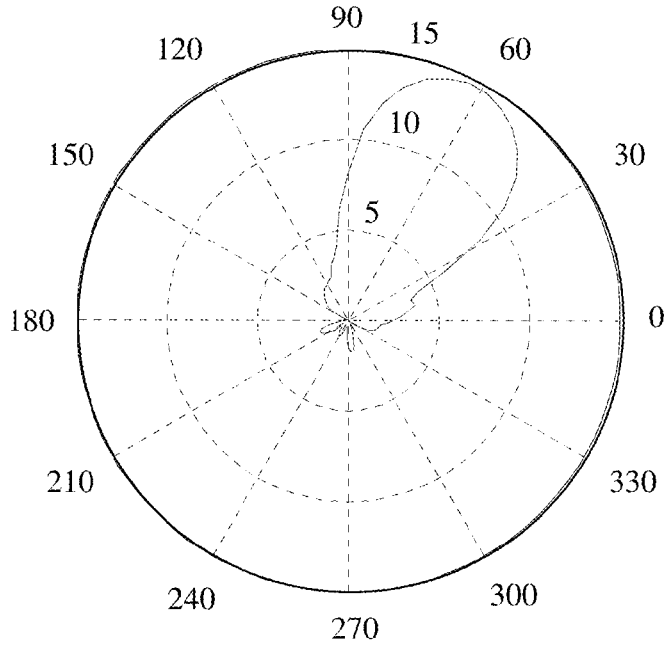
Figure 11C:
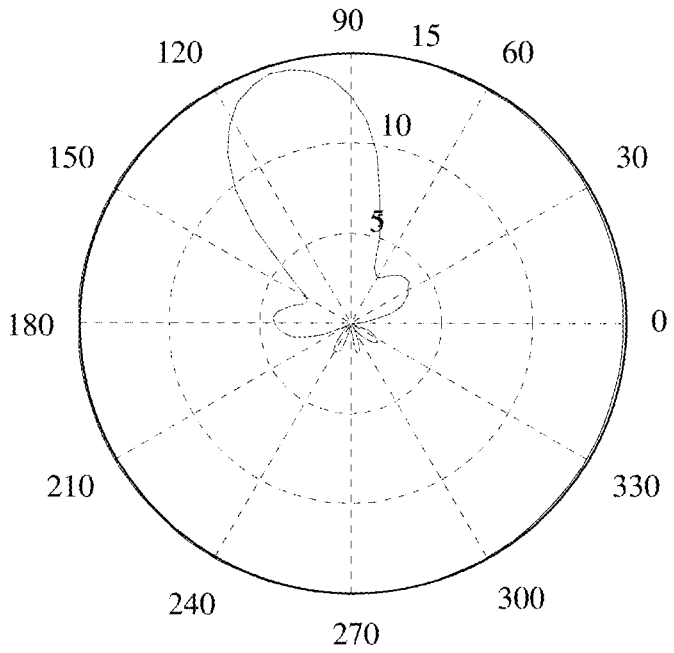
Figure 11D:
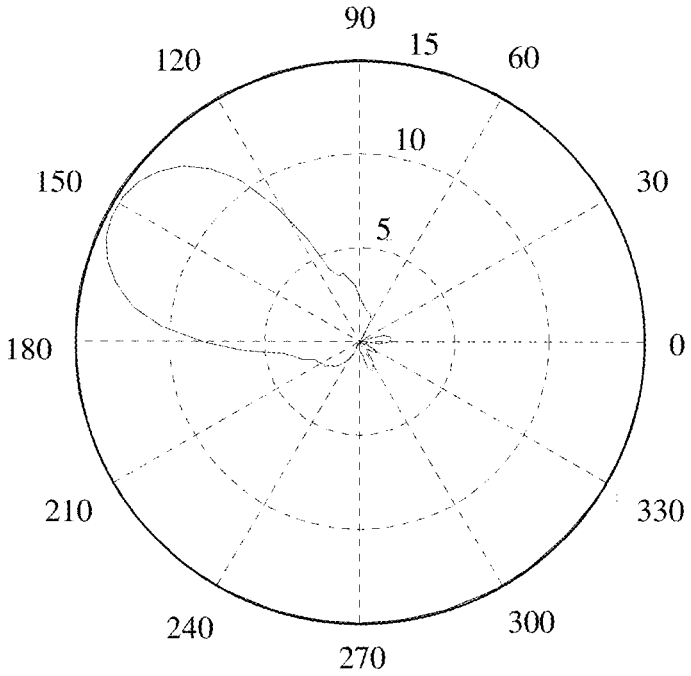
Figure 11E:
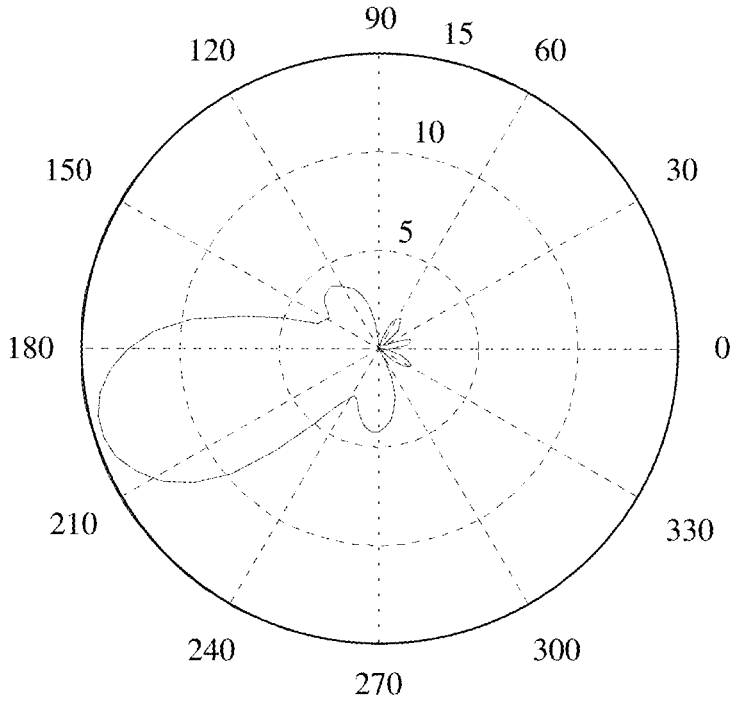
Figure 11F:
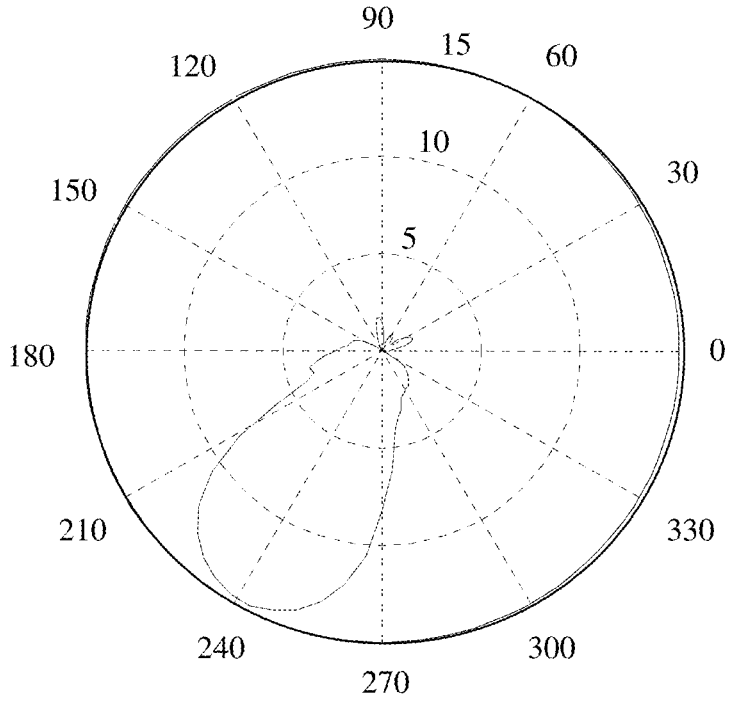
Figure 11G:
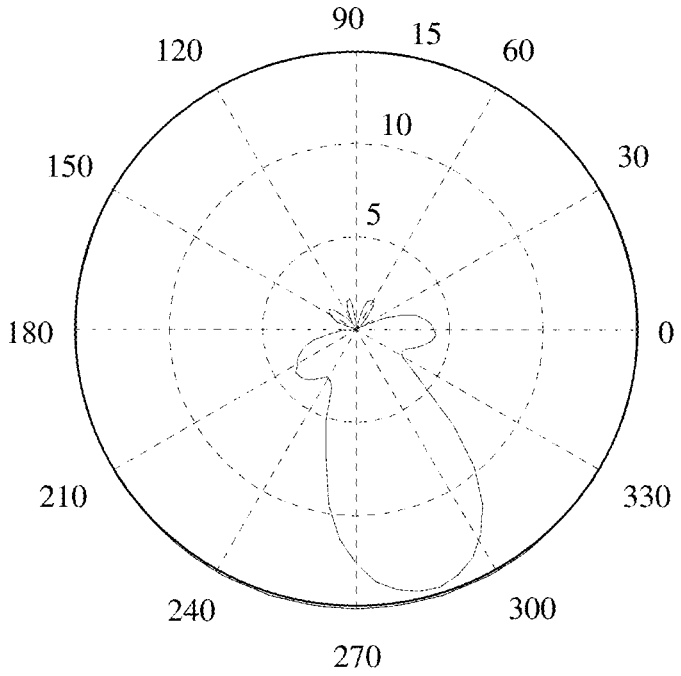
Figure 11H:
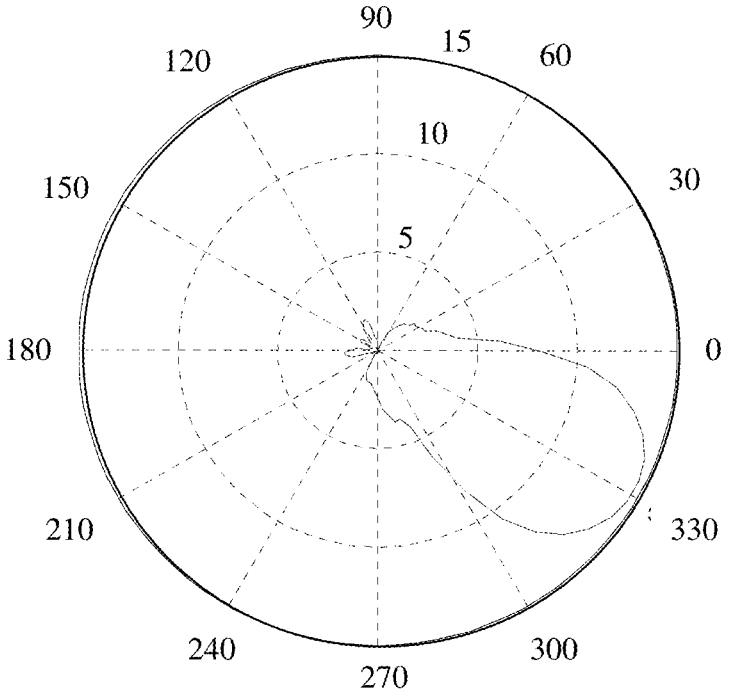

FIG. 10 exemplarily illustrates a microphone array configuration showing a microphone array system 902 having N microphone elements 1001 arbitrarily distributed on a circle 1002 with a diameter "d", where N refers to the number of microphone elements 1001 in the microphone array system 902. Consider an example where N=4, that is, there are four microphone elements 1001 $M_0$, $M_1$, $M_2$, and $M_3$ in the microphone array system 902. Each of the microphone elements 1001 is positioned at an acute angle "$\Phi_n$" from a Y-axis, where $\Phi_n>0$ and n=0, 1, 2, . . . N−1. In an example, the microphone element 1001 $M_0$ is positioned at an acute angle $\Phi_0$ from the Y-axis; the microphone element 1001 $M_1$ is positioned at an acute angle $\Phi_1$ from the Y-axis; the microphone element 1001 $M_2$ is positioned at an acute angle $\Phi_2$ from the Y-axis; and the microphone element 1001 $M_3$ is positioned at an acute angle $\Phi_3$ from the Y-axis. A filter-and-sum beam forming algorithm determines the output "y" of the microphone array system 902 having N microphone elements 1001.

Figure 13A:
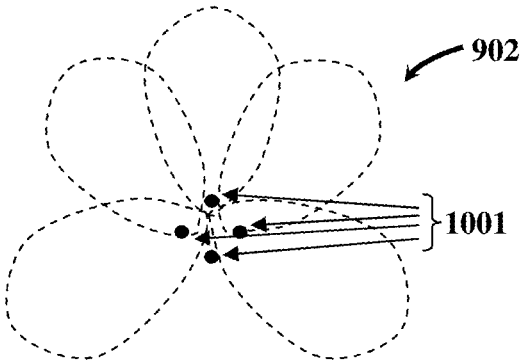
FIG. 13A exemplarily illustrates a four-sensor circular microphone array system that generates five acoustic beam patterns to record a three-dimensional surround sound and to synthesize a three-dimensional binaural sound.
Figure 13B:
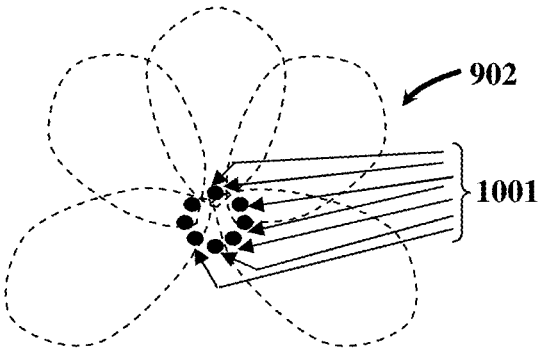
FIG. 13B exemplarily illustrates an eight-sensor circular microphone array system that generates five acoustic beam patterns to record a three-dimensional surround sound and to synthesize a three-dimensional binaural sound.

FIGS. 11A-11H exemplarily illustrate results of computer simulations of an eight-sensor microphone array system 902 exemplarily illustrated in FIG. 13B, showing directional acoustic beam patterns of the eight-sensor microphone array system 902. The microphone array system 902 comprises a set of microphone elements 1001 located in a preconfigured two-dimensional (2D) space or a preconfigured three-dimensional (3D) space as exemplarily illustrated in FIG. 10. The microphone array system 902 can be embedded in a computing device 901 exemplarily illustrated in FIG. 9. As multiple channel codec chips are available, a computing device 901 may comprise, for example, 2 to 8 microphone channels depending on applications. The microphone array system 902 forms multiple acoustic beam patterns pointing in different directions as exemplarily illustrated in FIG. 13B. FIGS. 11A-11H exemplarily illustrate average acoustic beam patterns of the microphone array system 902 for a frequency range of about 300 Hz to about 5000 Hz. The higher the number of microphone elements 1001 in the microphone array system 902, the narrower the acoustic beam patterns formed.

Figure 12:
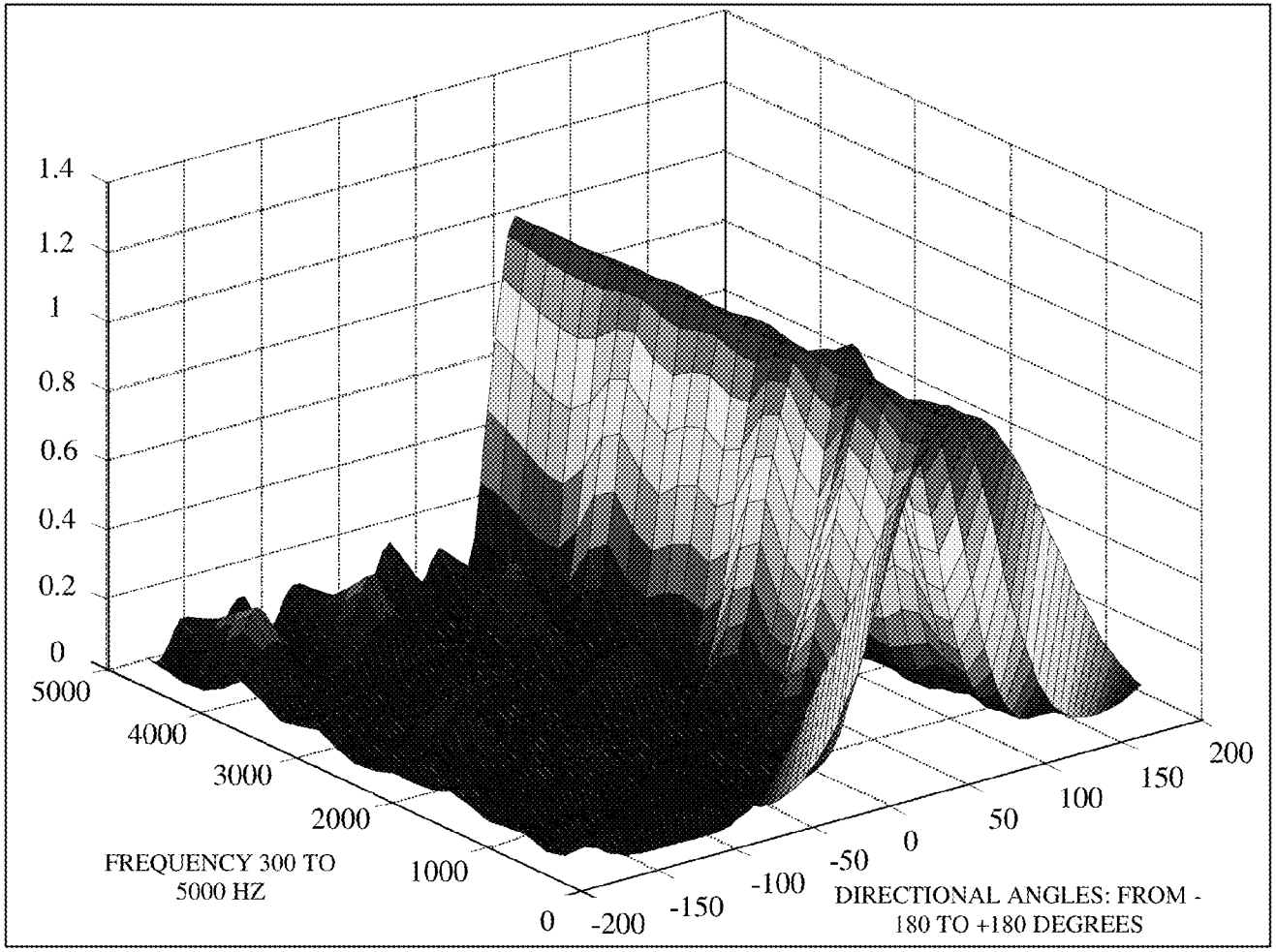
FIG. 12 exemplarily illustrates a graphical representation of a directivity pattern of an eight-sensor microphone array system.

FIG. 12 exemplarily illustrates a graphical representation of a directivity pattern of an eight-sensor microphone array system 902 exemplarily illustrated in FIG. 13B. The directivity pattern exemplarily illustrates the sound from the front of the microphone array system 902 enhanced for a frequency band from about 300 Hz to about 5000 Hz with the sound from the other directions reduced by about 15 dB.

FIG. 13A exemplarily illustrates a four-sensor circular microphone array system 902 that generates five acoustic beam patterns to record a three-dimensional (3D) surround sound and to synthesize a 3D binaural sound. The microphones 1001 are evenly placed on a circle having a diameter of, for example, about 12 cm. The diameter can be adjusted for different applications. The four-sensor microphone array system 902 generates five acoustic beam patterns to record 5.1 channel 3D surround sound. The multiple channel recording is also used to synthesize the 3D binaural sound.

FIG. 13B exemplarily illustrates an eight-sensor circular microphone array system 902 that generates five acoustic beam patterns to record a 3D surround sound and to synthesize a 3D binaural sound. The eight-sensor microphone array system 902 generates five acoustic beam patterns to record 5.1 channel 3D surround sound and to synthesize the 3D binaural sound. In an embodiment, a microphone array system 902 can be configured to have the same number of acoustic beams as the loudspeaker in a theater. One acoustic beam corresponds to the direction of one loudspeaker.

Figure 14A:
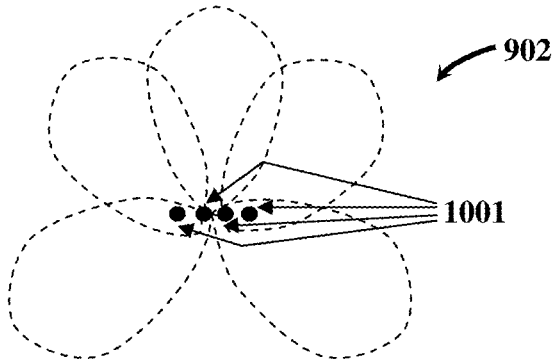
FIG. 14A exemplarily illustrates a four-sensor linear microphone array system that generates five acoustic beam patterns to record a three-dimensional surround sound and to synthesize a three-dimensional binaural sound.
Figure 14B:
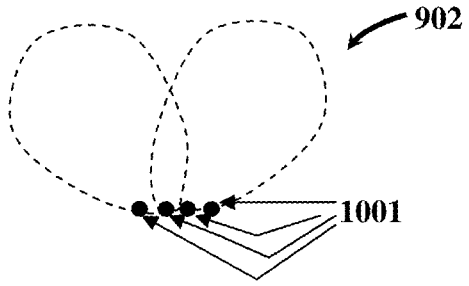
FIG. 14B exemplarily illustrates a four-sensor linear microphone array system that records a three-dimensional stereo sound using two acoustic beam patterns.
Figure 14C:
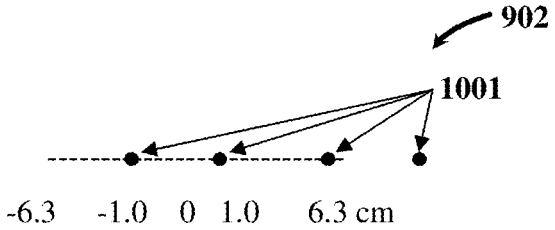
FIGS. 14C-14D exemplarily illustrate a layout of a four-sensor linear microphone array system with four microphone elements.
Figure 14D:
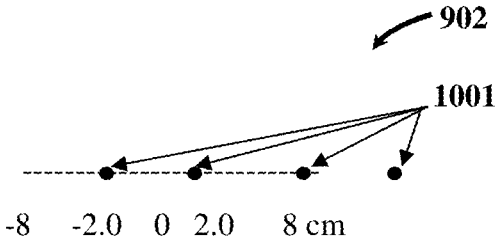

FIG. 14A exemplarily illustrates a four-sensor linear microphone array system 902 that generates five acoustic beam patterns to record a 5.1 channel 3D surround sound and to synthesize a 3D binaural sound. As exemplarily illustrated in FIG. 14A, the microphone elements 1001 are placed in a line. FIG. 14B exemplarily illustrates a four-sensor linear microphone array system 902 that records a 3D stereo sound using two acoustic beam patterns. FIGS. 14C-14D exemplarily illustrate a layout of a four-sensor linear microphone array system 902 with four microphone elements 1001. The array of microphone elements 1001 in the microphone array system 902 is configured as a circle as exemplarily illustrated in FIGS. 13A-13B, as a line as exemplarily illustrated in FIGS. 14A-14D, or as a sphere. Depending on applications and design algorithms, the dimensions and the layout of the microphone elements 1001 in the microphone array system 902 can be different.

Figure 15:
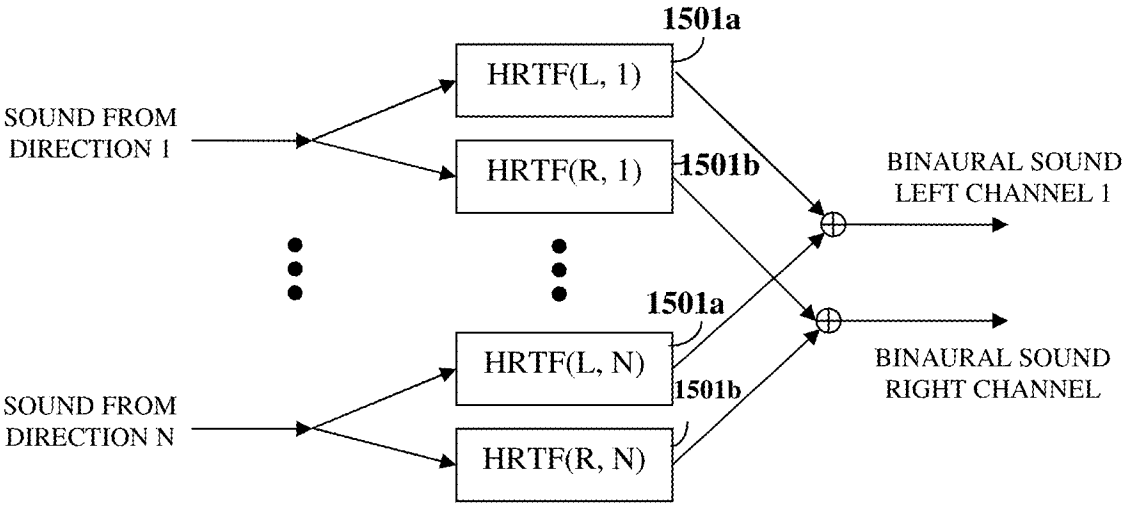
FIG. 15 exemplarily illustrates a method for synthesizing a three-dimensional binaural sound from a sound emitted by sound sources positioned in different directions in a three-dimensional space.

FIG. 15 exemplarily illustrates a method for synthesizing a three-dimensional (3D) binaural sound from a sound emitted by sound sources positioned in different directions in a 3D space. The 3D sound processing application convolutes sound from multiple different directions with the head related impulse responses (HRIRs) or the head related transfer functions (HRTFs) 1501*a* and 1501*b* to generate 3D binaural sound. The terms HRIR and HRTF are interchangeable. The 3D sound processing application facilitates binaural sound reconfiguration. Binaural sound reconfiguration is a process of synthesizing the 3D binaural sound on a computing device 901 exemplarily illustrated in FIG. 9 and FIG. 33, based on the user's preference, whereby the user determines the 3D sound field of the played sounds. The sound tracks are obtained from the microphone array system 902 exemplarily illustrated in FIGS. 9-10 or from a studio. In the studio recording, each sound track represents, for example, one musical instrument or one singer's voice. In order to generate the 3D binaural sound, the 3D sound processing application convolutes each sound track from the microphone array system 902 or from multiple microphones 912 in a studio with a pair of HRTFs 1501*a* and 1501*b*, representing the left ear and the right ear. Sound tracks are associated with a sound source location or the sound from a specific direction. For each sound direction in the 3D space, the simulator apparatus 300 measures a bank of HRTFs 1501*a* and 1501*b* as disclosed in the detailed description of FIGS. 1-2, and stores the HRTFs 1501*a* and 1501*b* in an HRTF database 908 exemplarily illustrated in FIG. 9.

For multiple sound tracks, the 3D sound processing application adds the convoluted results together to generate the final synthesized 3D binaural sound. For example, with respect to music listening, when a user wants a sound track to come from one particular direction, he/she places the icon of the sound source on the corresponding location on a touch screen of his/her computing device 901 and the 3D sound processing application applies the corresponding HRTF for convolution. The user places the musical instruments on corresponding locations on the touch screen, where he/she prefers or imagines, and is able to enjoy the 3D binaural sound on a headset or the 3D surround sound on multiple speakers. The user can have the experience of either sitting in the front row or walking through the stage or sitting among musicians. The configurable 3D sound system 900 provides a user with a listening experience similar to the music experienced by the user surrounded by live instruments in a music hall.

Figure 16:
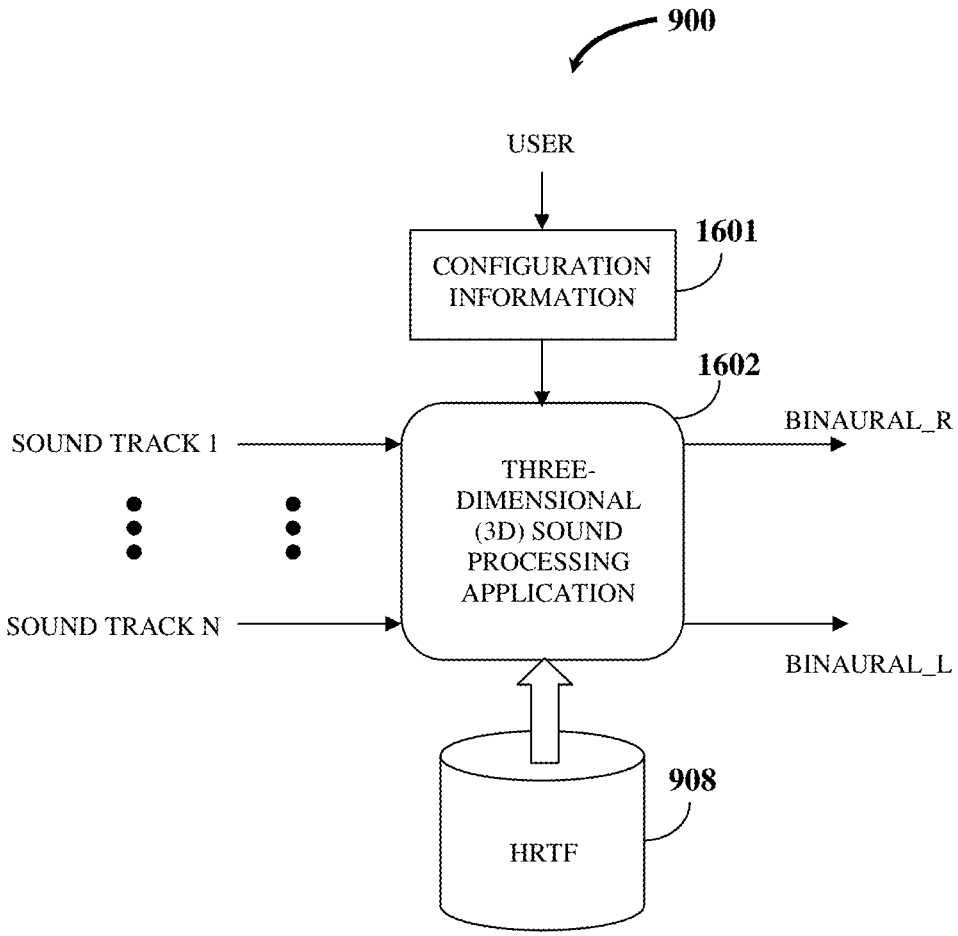
FIG. 16 exemplarily illustrates an embodiment of the configurable three-dimensional sound system for generating a three-dimensional binaural sound.

FIG. 16 exemplarily illustrates an embodiment of the configurable three-dimensional (3D) sound system 900 for generating a three-dimensional (3D) binaural sound. The configurable 3D sound system 900 comprises the 3D sound processing application 1602 that acquires configuration information 1601 from a user. The configuration information 1601 comprises user selections of configurable parameters, for example, an azimuth, an evaluation, a distance, a trace of movement, etc., associated with multiple sound sources as disclosed in the detailed description of FIG. 7. The 3D sound processing application 1602 generates a configurable sound field that provides an interface to give the user the freedom of configuring the positions and movements of multiple sound tracks, in order to render a customized 3D binaural sound. The 3D sound processing application 1602 of the configurable 3D sound system 900 accurately places the acoustic sound source on the exact location that the user prefers using the head related transfer functions (HRTFs) from the HRTF database 908.

The configurable 3D sound system 900 allows a user the freedom to set the sound source locations for music playback instead of only providing the option to listen to a mixed multi-channel music. When a bank of accurate HRTFs are collected in the HRTF database 908, the process of mixing and synthesis introduces an additional factor as the location or spatial cue of different sound sources to obtain the 3D binaural sound. The 3D sound processing application 1602 allows a user to set the sources of each sound in a 3D field by processing the sound tracks through the HRTFs and then to enjoy his/her own style of the 3D binaural sound with regular headphones. The 3D sound processing application 1602 performs the computations exemplarily illustrated in FIG. 15. The configurable 3D sound system 900 therefore covers a full 3D hemisphere around the user, places the sound sources in a full 3D space, and simulates the movement of sound sources.

Figure 17:
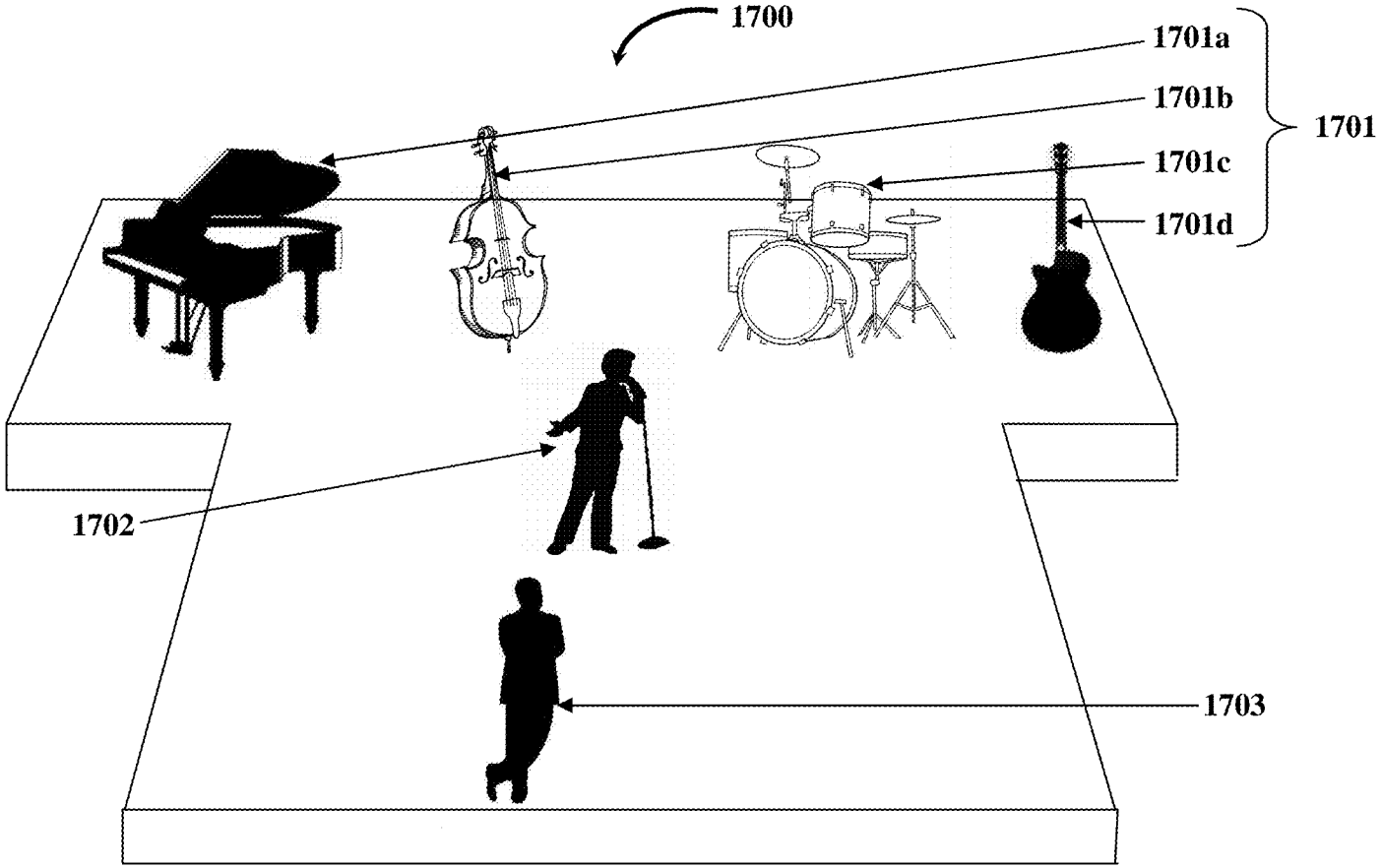
FIG. 17 exemplarily illustrates a configurable sound field generated by the three-dimensional sound processing application, showing a reconstruction of a scene of a concert stage at a music concert.
Figure 33:
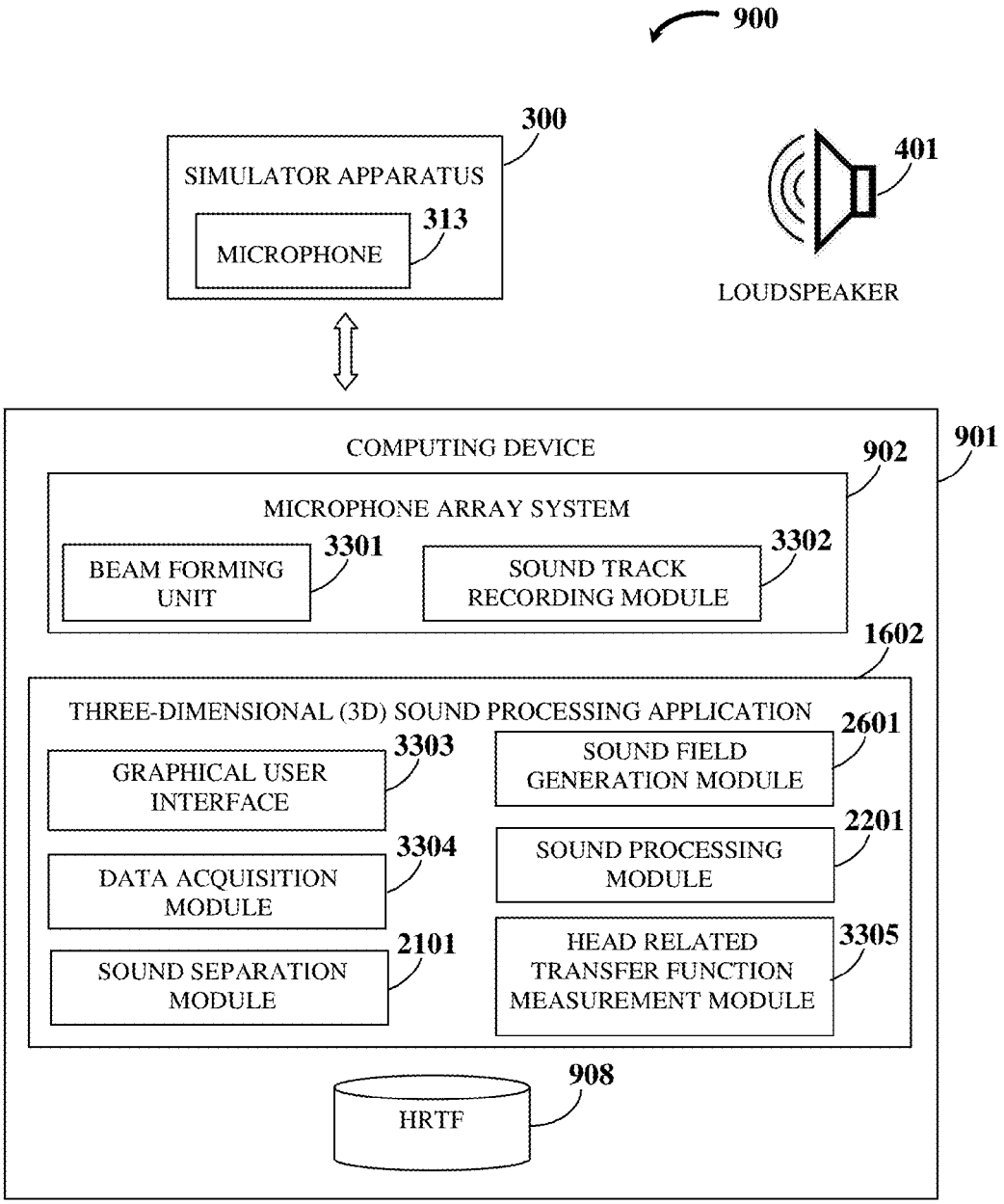
FIG. 33 illustrates a system for generating configurable three-dimensional sounds.

FIG. 17 exemplarily illustrates a configurable sound field 1700 generated by the three-dimensional (3D) sound processing application 1602 exemplarily illustrated in FIG. 16 and FIG. 33, showing a reconstruction of a scene of a concert stage at a music concert. FIG. 17 reconstructs the scene of the concert stage with four different musical instruments 1701, for example, a piano 1701*a*, a cello 1701*b*, drums 1701*c*, and a guitar 1701*d*, and a singer 1702. The scene depicts a user's 1703 sound listening experience from the front of the stage. The user can arrange the position of the four musical instruments 1701 and the singer 1702 on the stage in terms of angle and distance from the user 1703 on the configurable sound field 1700 generated by the 3D sound processing application 1602 via the graphical user interface (GUI) on the user's computing device 901 exemplarily illustrated in FIG. 9 and FIG. 33, to experience the 3D sound recording of a regular concert. The 3D sound processing application 1602 allows arrangement of the four musical instruments 1701 using separated channels of the musical instruments 1701 and corresponding head related transfer functions (HRTFs). As exemplarily illustrated in FIG. 17, the user 1703 has placed himself/herself on the concert stage in front of the music by entering his/her preference on the generated configurable sound field 1700 via the GUI.

Figure 18:
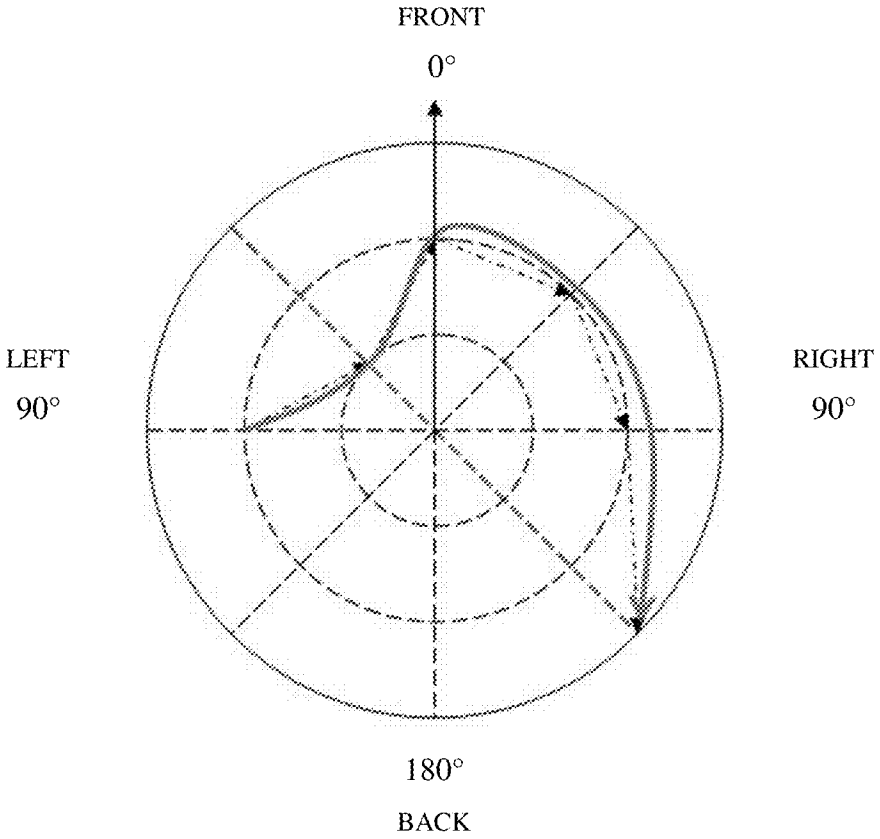
FIG. 18 exemplarily illustrates a graphical representation showing sampling and approximation of a sound source moving on a two-dimensional plane.

FIG. 18 exemplarily illustrates a graphical representation showing sampling and approximation of a sound source moving on a two-dimensional (2D) plane. In a 2D plane, if a moving trace of a sound source with one start point and one end point is given, the three-dimensional (3D) sound processing application 1602, exemplarily illustrated in FIG. 16 and FIG. 33, expresses any point on the trace by a polar coordinate with the user 1703 as a reference center in the configurable sound field 1700 exemplarily illustrated in FIG. 17, generated on the graphical user interface (GUI) of the computing device 901 exemplarily illustrated in FIG. 9 and FIG. 33. At each degree interval, the 3D sound processing application 1602 selects a pair of left and right HRTFs 1501*a* and 1501*b* exemplarily illustrated in FIG. 15, and determines the sound level. The 3D sound processing application 1602 then conducts the computation as exemplarily illustrated in FIG. 15, to synthesize the 3D binaural sound. Each sample point of the polar coordinates corresponds to a pair of HRTFs 1501*a* and 1501*b* and a volume level. FIG. 18 illustrates an example of conceptually sampling on a curve trace of movement, with 45 degrees as the interval. The 3D sound processing application 1602 samples the trace, for example, as dense as 5 degrees, in order to obtain a precise description. The sampling rate is, for example, about 44.1 KHz and above. The process of synthesizing a moving sound source simulates different time periods of the sound track with a set of HRTFs on the trace according to the timeline. In a 3D space, the process of sampling and approximation is implemented with spherical coordinates.

Figure 19:
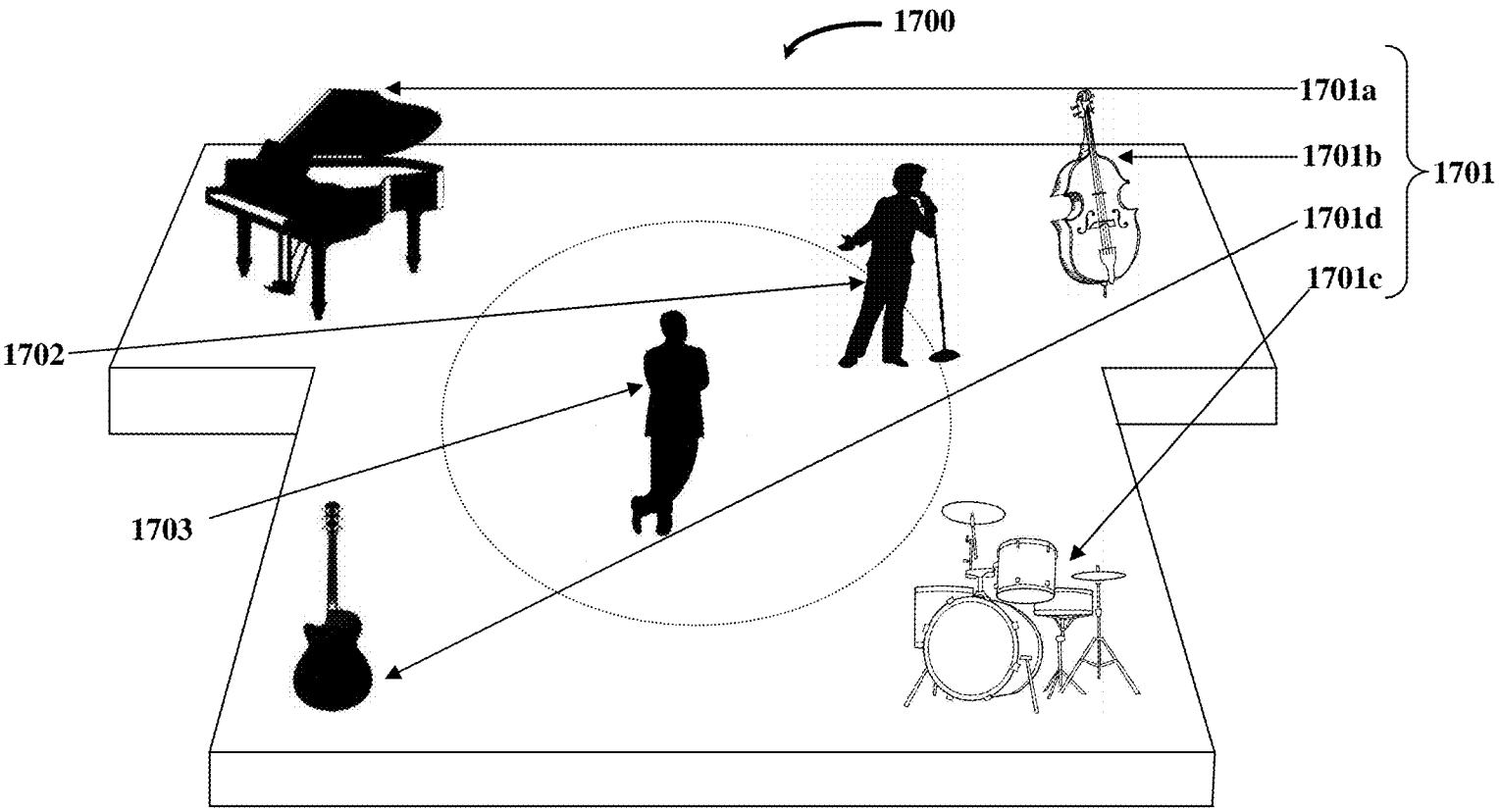
FIG. 19 exemplarily illustrates the configurable sound field generated by the three-dimensional sound processing application, showing a reconstruction of a scene of a concert stage at a music concert with the user standing in the middle of the concert stage.

FIG. 19 exemplarily illustrates the configurable sound field 1700 generated by the 3D sound processing application 1602 exemplarily illustrated in FIG. 16 and FIG. 33, showing a reconstruction of a scene of a concert stage at a music concert with the user 1703 standing in the middle of the concert stage. The configurable 3D sound system 900 exemplarily illustrated in FIG. 9 and FIG. 33, provides the user with a configured 3D audio experience, with the user 1703 standing among the musical instruments 1701 of the band, while a singer 1702 is circling the user 1703. The user may configure the positions and the movements of the sound sources on the generated configurable sound field 1700 to acoustically experience being in the center of the stage at the music concert with sounds of the musical instruments 1701 coming from the actual directions of origination. As exemplarily illustrated in FIG. 19, the user 1703 has placed himself/herself in the middle of the concert stage, surrounded by the musical instruments 1701 and the singer 1702, by entering his/her preference on the generated configurable sound field 1700 via the GUI. Therefore, the configurable 3D sound system 900 disclosed herein allows music artists to present their music to the user in an enhanced manner, and also enhances the performance of radio dramas and conference calls. The 3D binaural sound recording performed by the configurable 3D sound system 900 disclosed herein provides special effects and acoustic experiences to a user, for example, by allowing the user to move the sound source around the user 1703, move the sound source up and down, etc., on the configurable sound field 1700. The configurable 3D sound system 900 enhances the dramatic performance of radio drama shows and podcasts. Moreover, the configurable 3D sound system 900 provides a method of communication among multiple people, for example, in a conference call, by placing different speaking users at different spots to mimic a real conference room environment.

Figure 20:
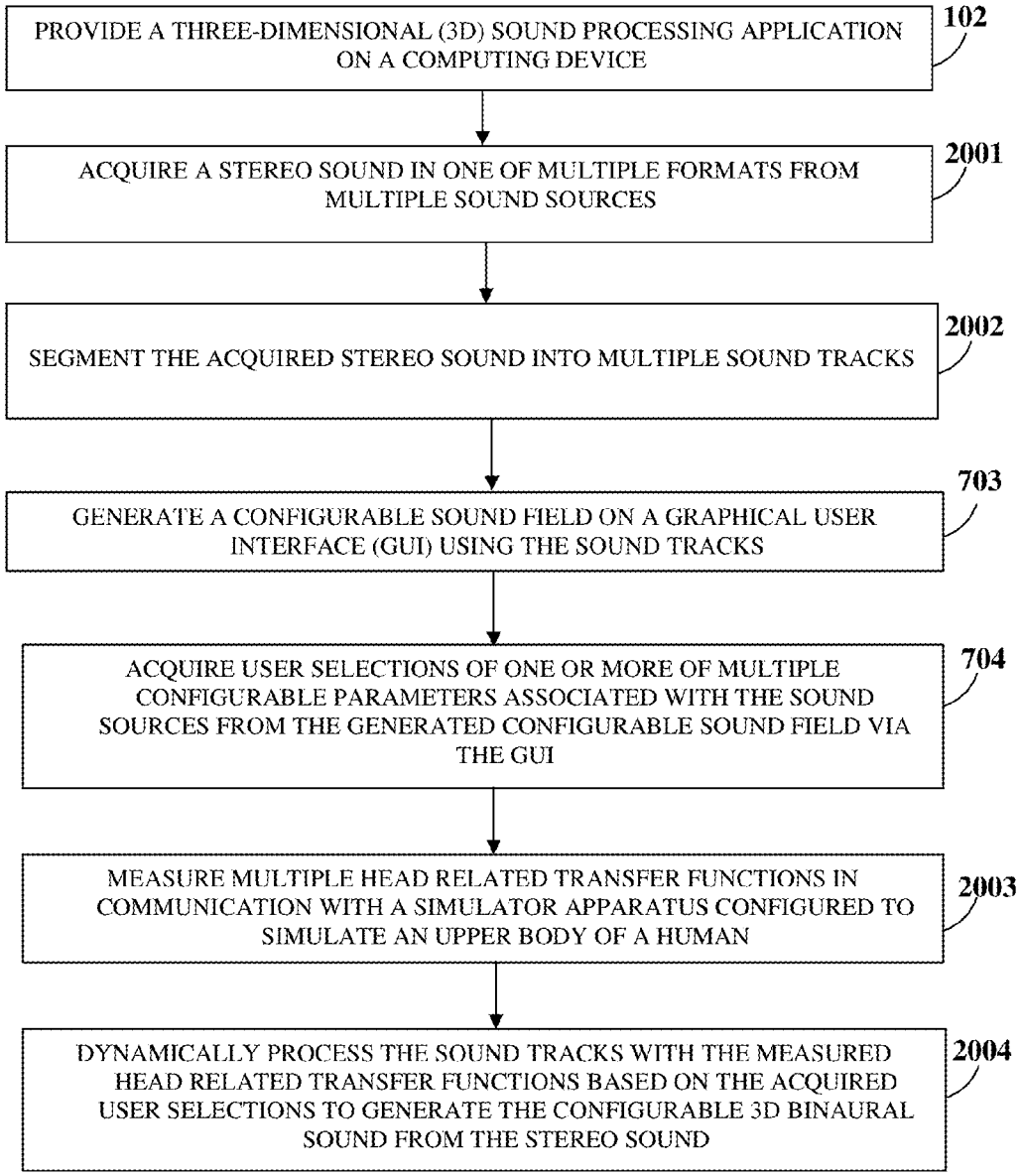
FIG. 20 illustrates a method for generating a configurable three-dimensional binaural sound from a stereo sound.

FIG. 20 illustrates a method for generating a configurable three-dimensional (3D) binaural sound from a stereo sound. Most music production systems currently available are in the stereo sound format. The method disclosed herein provides 102 the 3D sound processing application 1602 exemplarily illustrated in FIG. 16 and FIG. 33. The 3D sound processing application 1602 is executable by at least one processor configured to generate a configurable 3D binaural sound from a stereo sound. In this method, the 3D sound processing application 1602 acquires 2001 a sound input, for example, a stereo sound or stereo music in one of multiple formats from multiple sound sources positioned in a 3D space. In an embodiment, the sound source is a microphone or a microphone element that records a sound input. In an embodiment, microphones 912 positioned in the 3D space exemplarily illustrated in FIG. 9, and operably coupled to the 3D sound processing application 1602 record a sound input, that is, a stereo sound in one of multiple formats. The stereo sound can be acquired by two separated microphones 912 or by a microphone array system 902 as exemplarily illustrated in FIGS. 9-10 and FIGS. 14B-14C. The 3D sound processing application 1602 acquires the recorded stereo sound from the microphones 912 or the microphone array system 902. In another embodiment, the 3D sound processing application 1602 acquires any existing or pre-recorded stereo sound.

The 3D sound processing application 1602 segments 2002 the acquired stereo sound, that is, the recorded or pre-recorded stereo sound into multiple sound tracks, such that each output sound track only has one sound source, for example, one musical instrument. Each of the sound tracks corresponds to one sound source. The 3D sound processing application 1602 generates 703 a configurable sound field on the graphical user interface (GUI) provided by the 3D sound processing application 1602 using the sound tracks. The 3D sound processing application 1602 acquires 704 user selections of one or more of multiple configurable parameters, for example, a location, an azimuth, a distance, a sound level, a sound effect, etc., associated with the sound sources from the generated configurable sound field via the GUI. The 3D sound processing application 1602 measures 2003 multiple head related transfer functions (HRTFs) in communication with the simulator apparatus 300 exemplarily illustrated in FIGS. 3A-3C, as disclosed in the detailed description of FIGS. 1-2 and FIGS. 4-5. The 3D sound processing application 1602 dynamically processes 2004 the sound tracks with the measured HRTFs based on the acquired user selections to generate the configurable 3D binaural sound from the stereo sound.

The configurable 3D sound system 900 exemplarily illustrated in FIG. 9 and FIG. 33 therefore converts the separated source sounds into separate sound tracks and then into 3D binaural sound with configurable binaural rendering technologies, using the collected bank of accurate HRTFs, and allows the user to enjoy the audio or music from an individually customized virtual scene, and to experience the synthesized and personalized 3D binaural sound. Through the configurable sound field provided on the GUI, the user configures the placements and movements of any available sound sources as the inputs in order to obtain a virtual reality scene. The configurable 3D sound system 900 renders the 3D binaural sound from the input configuration to provide the user with the reconstructed virtual audio 3D space he/she designed.

Figure 21:
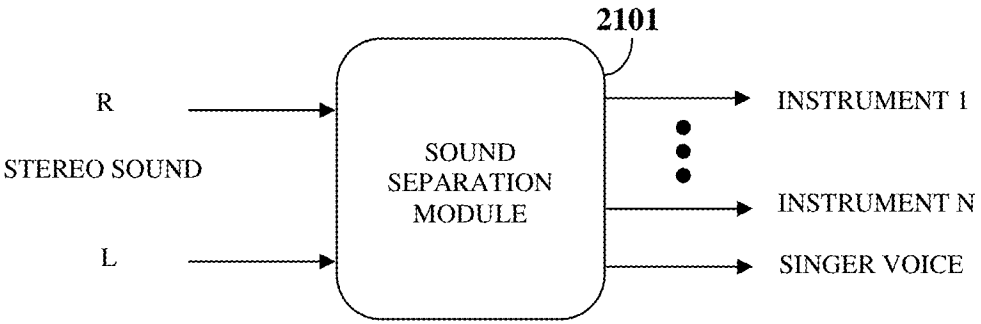
FIG. 21 exemplarily illustrates identification and separation of sound tracks from a stereo sound.

FIG. 21 exemplarily illustrates identification and separation of sound tracks from a stereo sound. The 3D sound processing application 1602 exemplarily illustrated in FIG. 16 and FIG. 33, comprises a sound separation module 2101 configured to identify different sound sources, for example, the guitar 1701*d*, the drum 1701*c*, the singer's 1702 vocal, etc., exemplarily illustrated in FIG. 17, from mixed mono or stereo sound sources by performing sound source separation. The 3D sound processing application 1602 synthesizes 3D binaural sound from popular stereo music formats, for example, music stored in compact discs (CDs), motion pictures experts group format (MPEG) 3, etc., for enabling a user to enjoy music and audio entertainment interactively. The sound separation module 2101 recognizes and separates the musical instruments 1701 and the singer's 1702 voice. The 3D sound processing application 1602 uses configurable spatial alignments with accurate head related transfer functions (HRTFs), to synthesize 3D binaural sound based on the positioning of the identified musical instruments 1701 and the singer 1702 in a 3D space.

Figure 22:
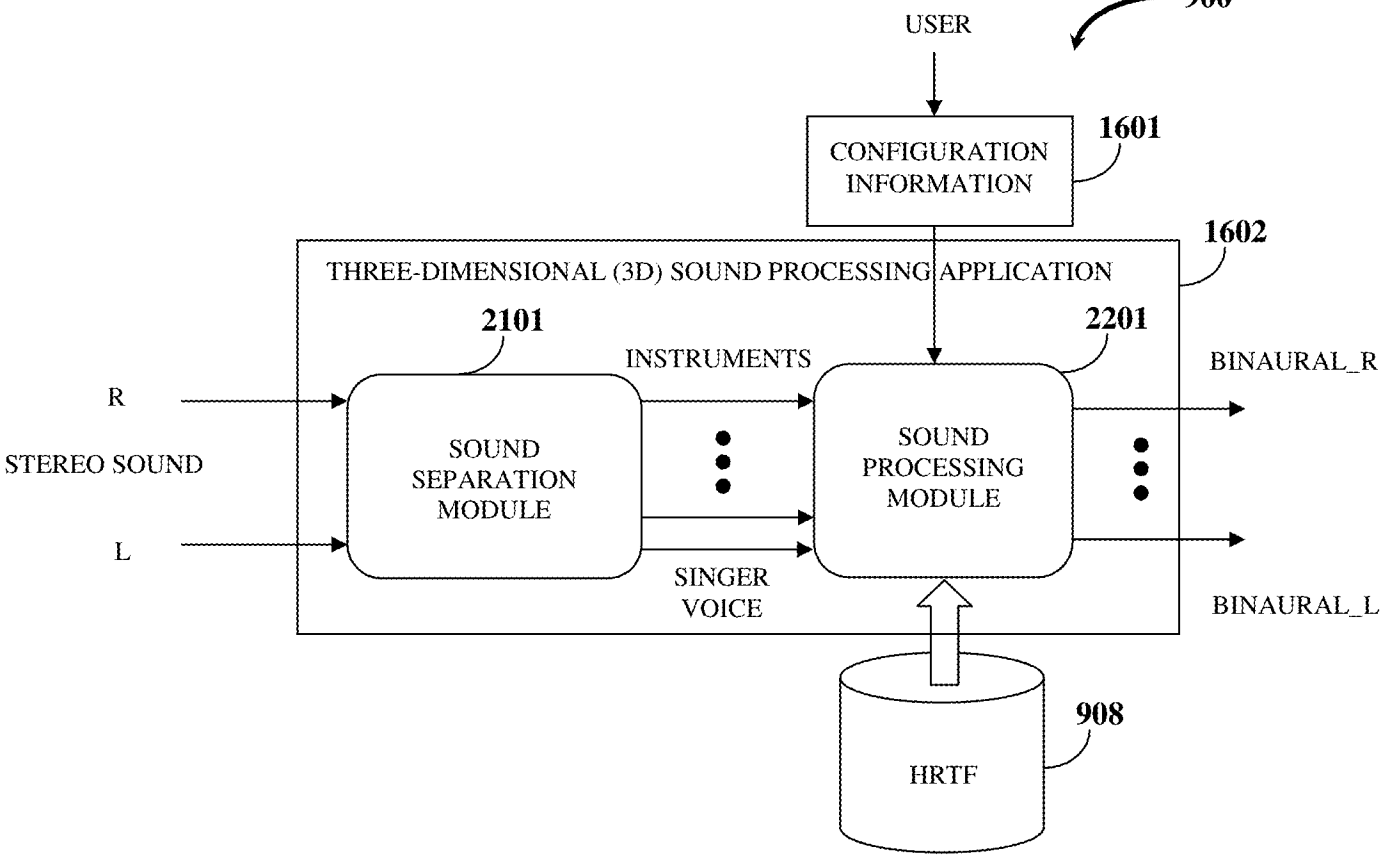
FIG. 22 exemplarily illustrates an embodiment of the configurable three-dimensional sound system for generating a configurable three-dimensional binaural sound from a stereo sound.

FIG. 22 exemplarily illustrates an embodiment of the configurable three-dimensional (3D) sound system 900 for generating a configurable 3D binaural sound from a stereo sound. In this embodiment, the 3D sound processing application 1602 of the configurable 3D sound system 900 comprises the sound separation module 2101 and the sound processing module 2201. The sound separation module 2101 acquires a stereo sound, for example, multi-instrument mixed stereo music as input. The sound separation module 2101 segments the multi-instrument mixed stereo music input into multiple different sound tracks. Each sound track is a synchronized and separated rhythm from one single instrument 1701*a*, 1701*b*, 1701*c*, or 1701*d*, or the singer 1702 exemplarily illustrated in FIG. 17. The sound processing module 2201 receives the sound tracks and the configuration information 1601 from the user and processes the separated sound tracks with the measured HRTFs retrieved from the HRTF database 908 to generate configurable 3D binaural sound from the stereo sound. The configurable 3D sound system 900 provides the user the freedom to arrange the spatial cue, for example, the placements and the movements of any separated sound track on a configurable sound field 1700, and allows the user to enjoy spatial music from regular stereo music.

Figure 23:
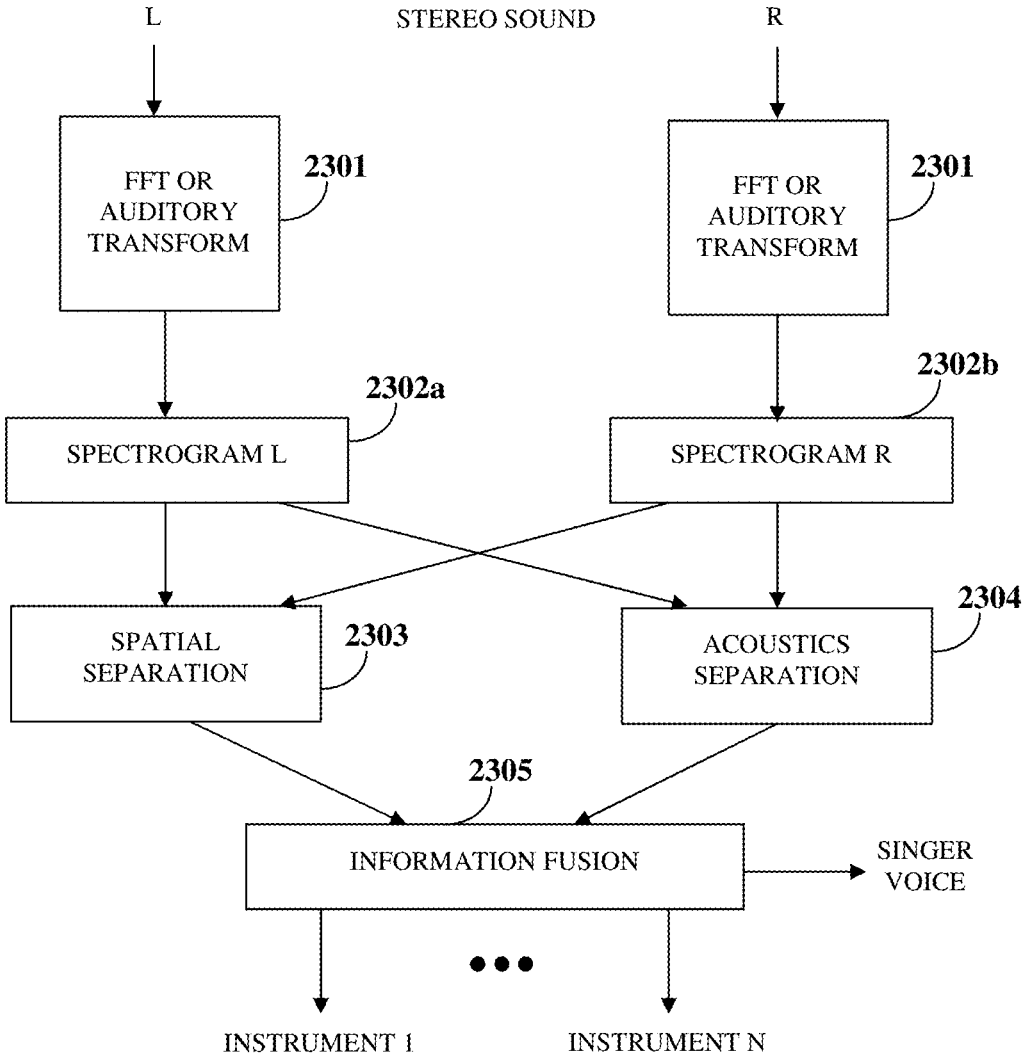
FIG. 23 exemplarily illustrates a process flow diagram comprising the steps performed by the three-dimensional sound processing application for separating sound tracks from a stereo sound.

FIG. 23 exemplarily illustrates a process flow diagram comprising the steps performed by the 3D sound processing application 1602 exemplarily illustrated in FIG. 16 and FIG. 33, for separating sound tracks from a stereo sound. The method for segmenting the stereo sound to separate the sound tracks involves, for example, advanced time-frequency analysis and pattern recognition technologies. The sound separation module 2101 exemplarily illustrated in FIGS. 21-22 receives stereo sound inputs from left (L) and right (R) sound channels and applies, for example, a fast Fourier transform (FFT) or an auditory transform 2301 also referred to as a cochlear transform, to the stereo sound inputs to generate spectrograms 2302*a* and 2301*b*. As used herein, the term "spectrogram" refers to a two-dimensional plot where the x axis represents time and the y axis represents frequency. At a given time, there is a corresponding spectral along the y axis represented as a data vector at the given time point. The sound separation module 2101 exemplarily illustrated in FIGS. 21-22 then performs spatial separation 2303 and acoustics separation 2304. Spatial separation 2303 allows similar sound sources, for example, specific musical instruments or a human singing voice to be recognized and separated into single sound tracks. Acoustics separation 2304 is disclosed in the detailed description of FIG. 21. The sound separation module 2101 is configured to intelligently fuse 2305 the spatial cues processed from time-frequency analysis and pattern recognition methods, and the acoustic cues processed from acoustic pattern recognition. The sound separation module 2101 then separates the instruments and the singer's voice from the fused information.

Figure 24:
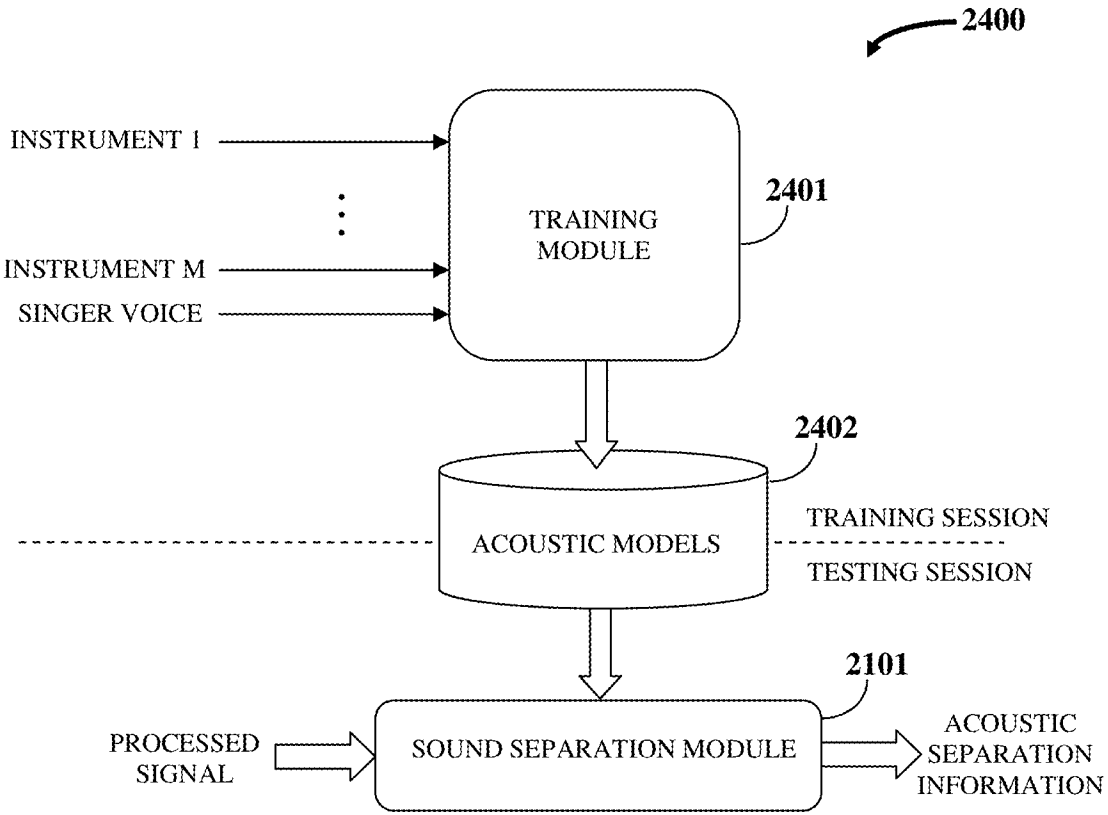
FIG. 24 exemplarily illustrates a block diagram of an acoustic separation unit of the three-dimensional sound processing application.

FIG. 24 exemplarily illustrates a block diagram of an acoustic separation unit 2400. The acoustic separation unit 2400 of the 3D sound processing application 1602 exemplarily illustrated in FIG. 16 and FIG. 33, identifies different sound sources acoustically, for example, using a pattern recognition method. The acoustic separation unit 2400 comprises a training module 2401, an acoustic models database 2402, and the sound separation module 2101. The training module 2401 trains and stores multiple acoustic features of the different sound sources as mathematical models, for example, Gaussian mixture models (GMM) or hidden Markov models (HMM) in the acoustic models database 2402 to identify an incoming sound signal. The sound separation module 2101 applies pre-trained acoustic models to the stereo sound to recognize and separate the stereo sound into sound tracks. The training module 2401 is configured to train the pre-trained acoustic models based on pre-recorded sound sources. The sound separation module 2101 receives a processed signal, identifies the acoustically different sound sources using the acoustic models in the acoustic models database 2402, generates acoustic separation information, and separates stereo sound with two stereo sound tracks to multiple sound tracks. Each sound track contains the sound from one sound source.

Figure 25:
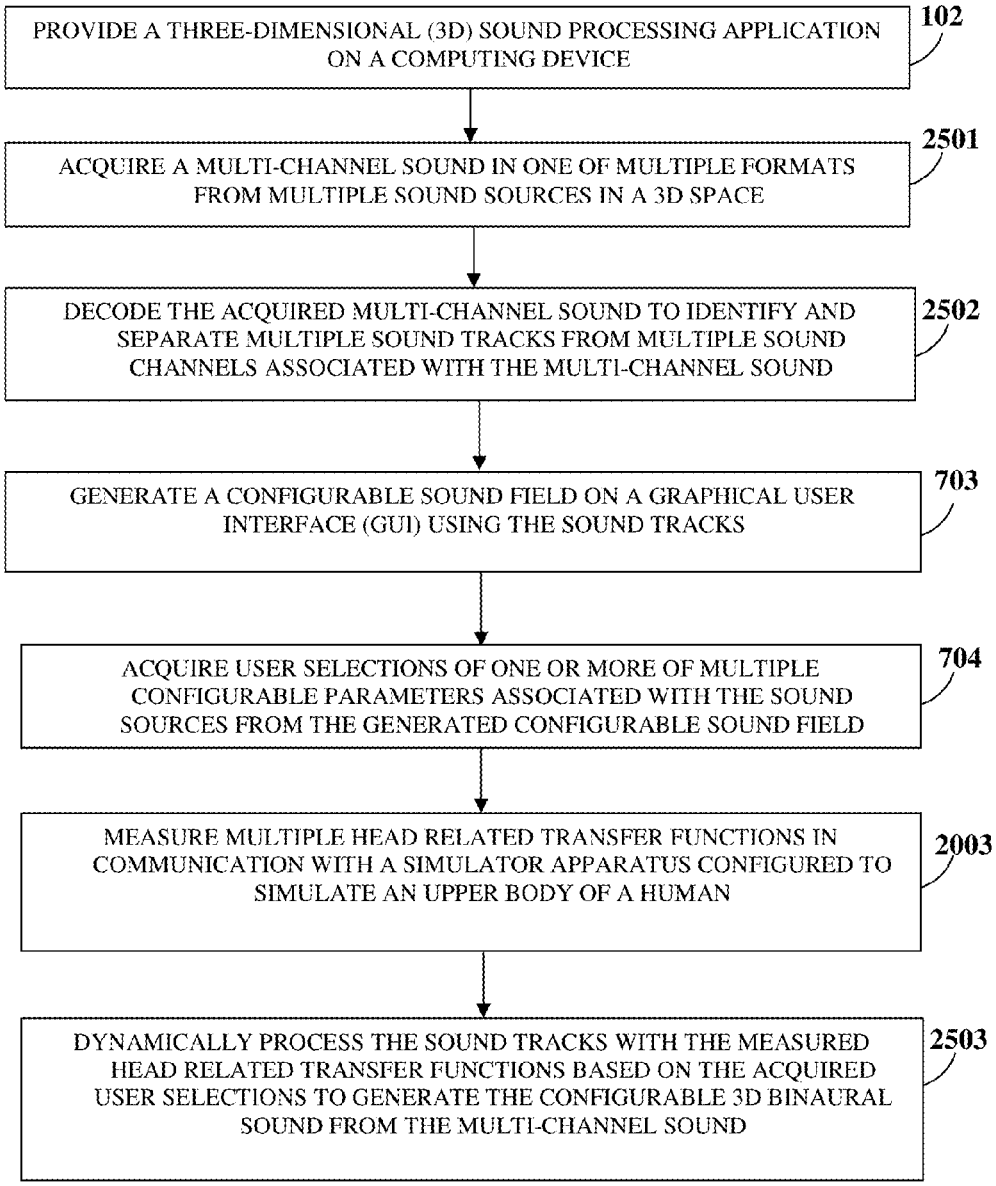
FIG. 25 illustrates a method for generating a configurable three-dimensional binaural sound from a multi-channel sound recording.

FIG. 25 illustrates a method for generating a configurable 3D binaural sound from a multi-channel sound recording. The method disclosed herein provides 102 the 3D sound processing application 1602 exemplarily illustrated in FIG. 16 and FIG. 33. The 3D sound processing application 1602 is executable by at least one processor configured to generate a configurable 3D binaural sound from a multi-channel sound. In this method, the 3D sound processing application 1602 acquires 2501 a sound input, for example, a multi-channel sound in one of multiple formats from multiple sound sources positioned in a 3D space. In an embodiment, the sound source is a microphone or a microphone element that records a sound input. In an embodiment, multiple microphones 914 exemplarily illustrated in FIG. 9 positioned in the 3D space and operably coupled to the 3D sound processing application 1602 record a multi-channel sound in one of multiple formats. If multiple channels are recorded as one channel with one sound source such as recorded by multiple microphones 914 in a studio, no processing is necessary and the multiple channels can be used as multiple sound tracks directly. If multiple channels are recorded with mixed sound sources, a process similar to that disclosed in FIG. 24 may be applied if it is required by applications. The multi-channel sound can be stored in one media file in a computing device 901. In another embodiment, the 3D sound processing application 1602 acquires any existing or pre-recorded multiple track sound.

The 3D sound processing application 1602 decodes 2502 the acquired multi-channel sound, that is, the recorded or pre-recorded multi-channel sound to identify and separate multiple sound tracks from multiple sound channels associated with the multi-channel sound, for example, a left sound channel, a right sound channel, a center sound channel, a low frequency effects sound channel, a left surround sound channel, and a right surround sound channel associated with the multi-channel sound. The 3D sound processing application 1602 generates 703 a configurable sound field on the graphical user interface (GUI) using the identified and/or separated sound tracks. The 3D sound processing application 1602 acquires 704 user selections of one or more of multiple configurable parameters, for example, a location, an azimuth, a distance, a sound level, a sound effect, etc., associated with the sound sources from the generated configurable sound field via the GUI. The 3D sound processing application 1602 measures 2003 multiple head related transfer functions (HRTFs) to synthesize multiple sound tracks to 3D binaural sound. The 3D sound processing application 1602 dynamically processes 2503 the identified and separated sound tracks with the measured head related transfer functions (HRTFs) based on the acquired user selections to generate the configurable 3D binaural sound from the multi-channel sound.

Figure 26:
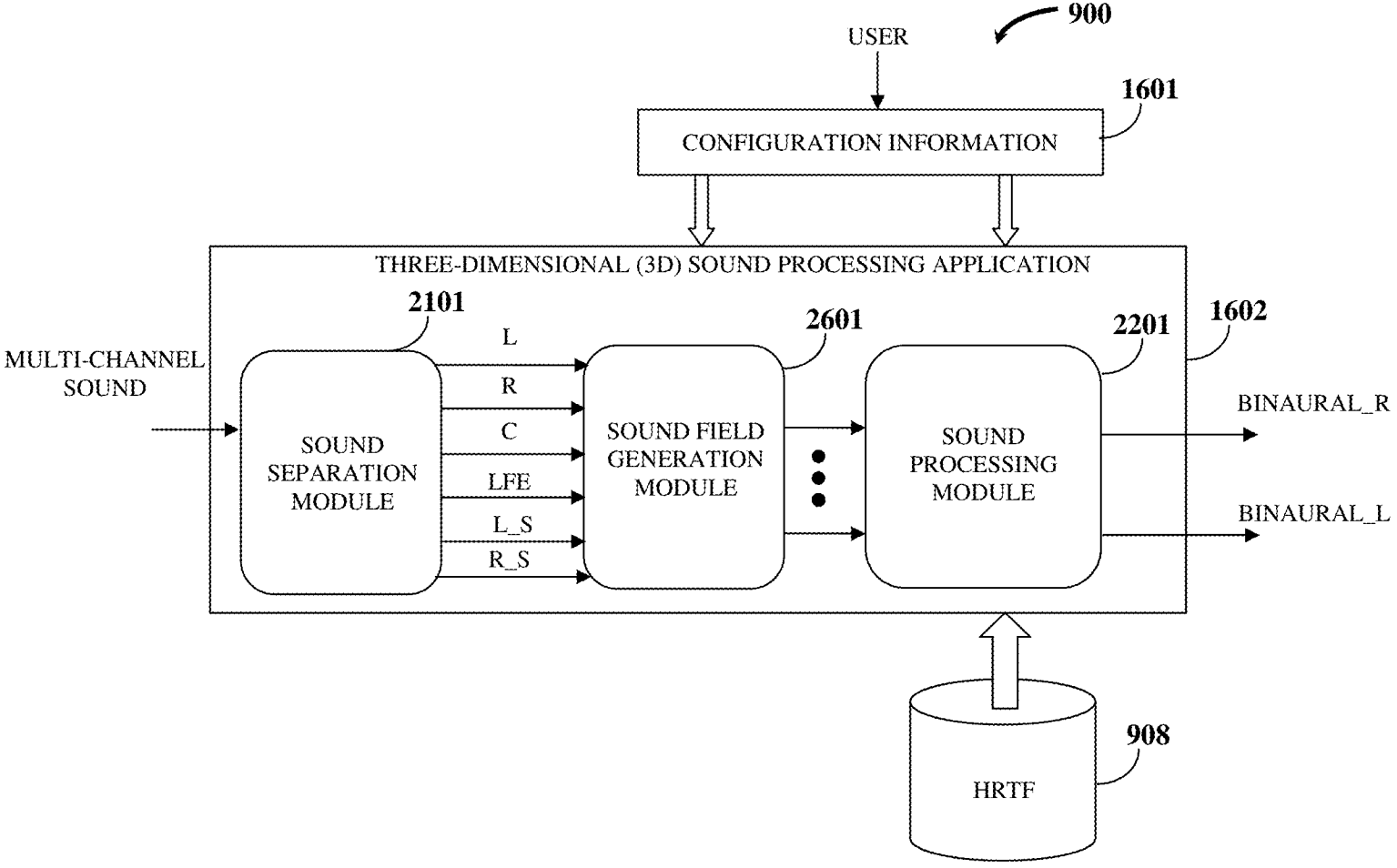
FIG. 26 illustrates an embodiment of the configurable three-dimensional sound system for generating a configurable three-dimensional binaural sound from a multi-channel sound.

FIG. 26 exemplarily illustrates an embodiment of the configurable three-dimensional (3D) sound system 900 for generating a configurable 3D binaural sound from a multi-channel sound. The 3D sound processing application 1602 of the configurable 3D sound system 900 acquires configuration information 1601 comprising user selections of one or more configurable parameters, for example, positions, movements, etc., of the sound sources from a user. The 3D sound processing application 1602 comprises the sound separation module 2101, a sound field generation module 2601, and the sound processing module 2201. The sound separation module 2101 receives a multi-channel sound input and identifies and separates multiple sound tracks from the sound channels, for example, a left (L) sound channel, a right (R) sound channel, a center (C) sound channel, a low frequency effects (LFE) sound channel, a left surround (L_S) sound channel, and a right surround (R_S) sound channel associated with the multi-channel sound input. One sound channel corresponds to one sound source. A musician can use a headset to listen to one channel and to record another channel. The sound field generation module 2601 generates a configurable sound field on the graphical user interface (GUI) on the user's computing device 901 exemplarily illustrated in FIG. 9 and FIG. 33. For example, the sound field generation module 2601 builds virtual sound sources that can be configured by a user on the GUI. The virtual sound source refers to a sound source in a 3D space that can be positioned by a user through the GUI. The user can assign the sound source and/or the sound track to any position in the 3D space. The sound processing module 2201 synthesizes 3D binaural sound using a bank of HRTFs from the HRTF database 908 and the assigned sound tracks representing the configurable sound field.

Figure 27:
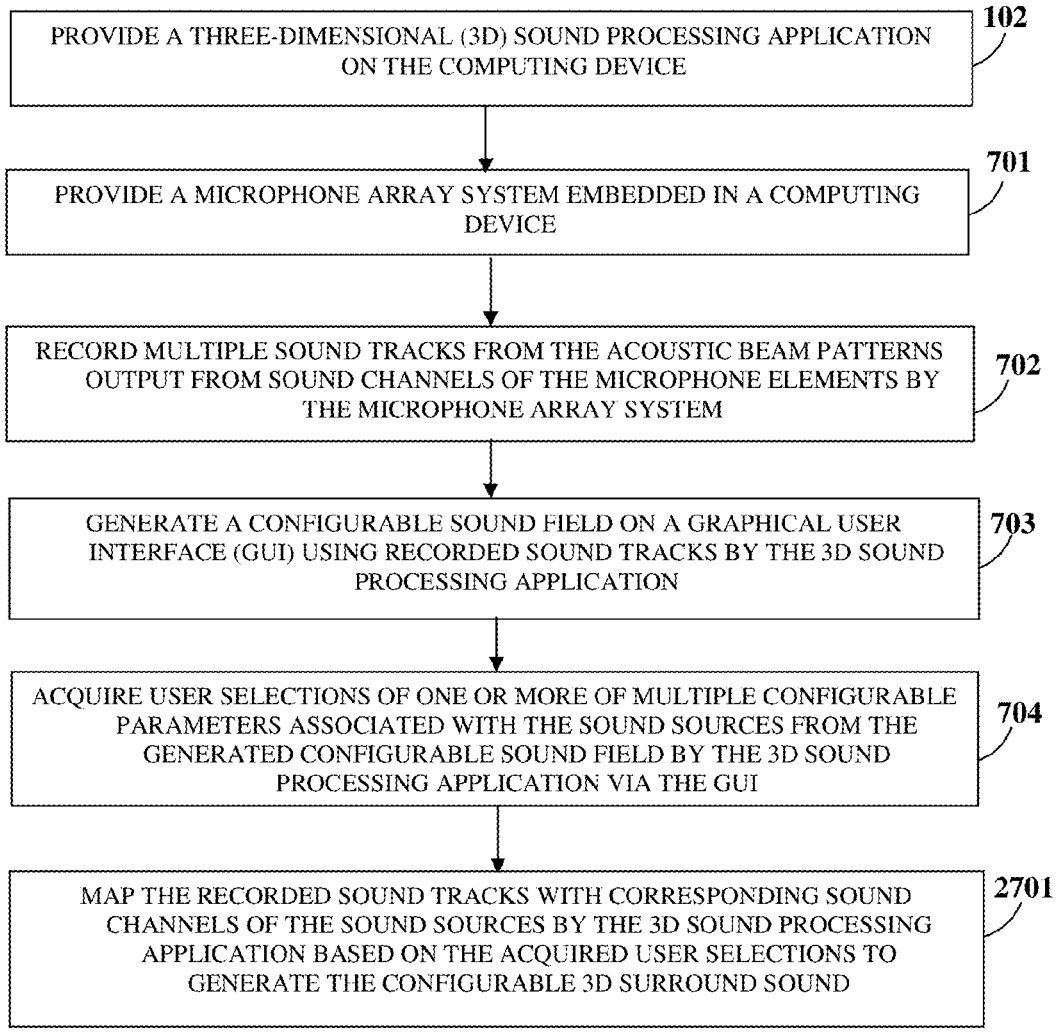
FIG. 27 illustrates a method for generating a configurable three-dimensional surround sound.

FIG. 27 illustrates a method for generating a configurable three-dimensional (3D) surround sound. Surround sound refers to sound coming from multiple directions. Surround sound uses multiple audio tracks or sound tracks to envelop a movie watching or music listening user, and provides the user the experience of being in the middle of the action or a concert. A surround sound system is a multichannel audio system having loudspeakers in front of and behind the user to create a surrounding envelope of sound and to simulate directional audio or sound sources. The surround sound system comprises a collection of loudspeakers that creates a 3D sound space for a home theater or a computer. The method for generating a configurable 3D surround sound disclosed herein provides 102 the 3D sound processing application 1602 exemplarily illustrated in FIG. 16 and FIG. 33 on a computing device 901. The 3D sound processing application 1602 is executable by at least one processor configured to generate the configurable 3D surround sound. The method disclosed herein also provides 701 the microphone array system 902 embedded in the computing device 901 as exemplarily illustrated in FIG. 9. The microphone array system 902 is in operative communication with the 3D sound processing application 1602 in the computing device 901. The microphone array system 902 comprises an array of microphone elements 1001 as exemplarily illustrated in FIG. 10, positioned in an arbitrary configuration in a 3D space as disclosed in the co-pending non-provisional U.S. patent application Ser. No. 13/049,877.

The microphone array system 902 is configured to form multiple acoustic beam patterns that point in different directions in the 3D space as exemplarily illustrated in FIGS. 11A-11H. The microphone array system 902 is also configured to form multiple acoustic beam patterns that point to the positions of multiple sound sources in the 3D space. The microphone array system 902 constructs the acoustic beam patterns. The acoustic beam patterns in the microphone array system 902 are configured to point in different directions configured by the 3D surround sound definition or specification, as exemplarily illustrated in FIGS. 13A-13B and FIGS. 14A-14D. In an embodiment, the microphone array system 902 comprises preconfigured acoustic beam patterns pointing in different directions. In another embodiment, the microphone array system 902 detects sound sources and constructs acoustic beam patterns pointing to the sound sources respectively by an adaptive beam forming method.

The microphone array system 902 records 702 multiple sound tracks from the acoustic beam patterns formed by the array of microphone elements 1001 in the microphone array system 902 exemplarily illustrated in FIG. 10, FIGS. 13A-13B and FIGS. 14A-14D. Each of the recorded sound tracks corresponds to one of the positions of the sound sources in the 3D space. The 3D sound processing application 1602 generates 703 a configurable sound field on the graphical user interface (GUI) using the recorded sound tracks. The 3D sound processing application 1602 acquires 704 user selections of one or more of multiple configurable parameters, for example, a location, an azimuth, a distance, a sound level, a sound effect, etc., associated with the sound sources from the generated configurable sound field via the GUI. The 3D sound processing application 1602 maps 2701 the recorded sound tracks based on the acquired user selections to generate the configurable 3D surround sound. In an embodiment, the sound tracks from the acoustic beam patterns are mapped to the corresponding surround sound channel directly when the acoustic beam pattern points in the direction of the surround sound channel. Each acoustic beam pattern of the microphone array system 902 is preconfigured to associate with each sound channel of the 3D surround sound.

Figure 28:
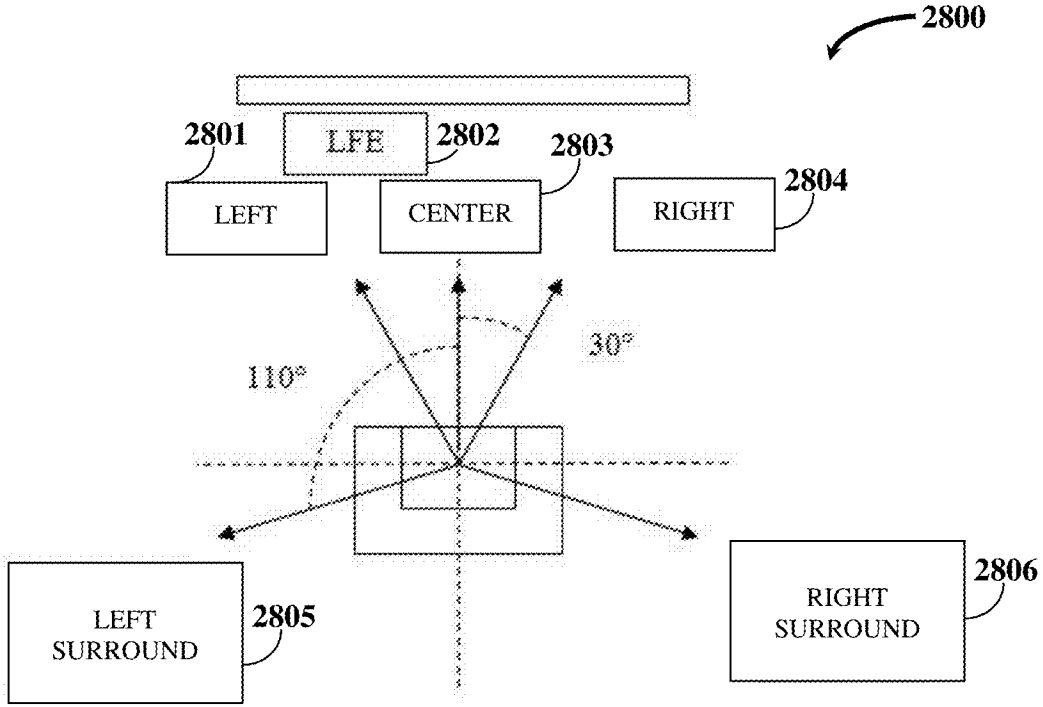
FIG. 28 exemplarily illustrates a loudspeaker arrangement of a 5.1 channel home theater system for generating a 5.1 channel three-dimensional surround sound.

FIG. 28 exemplarily illustrates a loudspeaker arrangement of a 5.1 channel home theater system 2800 for generating a 5.1 channel three-dimensional (3D) surround sound. FIG. 28 exemplarily illustrates the locations of the loudspeakers 2801, 2802, 2803, 2804, 2805, and 2806 in a 3D surround sound home theater system 2800. The 5.1 channel home theater system 2800 comprises six channels comprising a left speaker 2801, a low frequency effects (LFE) speaker 2802, a center speaker 2803, a right speaker 2804, a left surround speaker 2805, and a right surround speaker 2806 as exemplarily illustrated in FIG. 28. The microphone array system 902 forms acoustic beam patterns as disclosed in the co-pending non-provisional U.S. patent application Ser. No. 13/049,877, for each angle of the loudspeakers 2801, 2802, 2803, 2804, 2805, and 2806, as exemplarily illustrated in FIGS. 13A-13B and FIGS. 14A-14D. The microphone array system 902 forms five acoustic beams corresponding to each direction of the loudspeakers 2801, 2802, 2803, 2804, 2805, and 2806 to record the sound tracks as exemplarily illustrated in FIG. 28.

Figure 29:
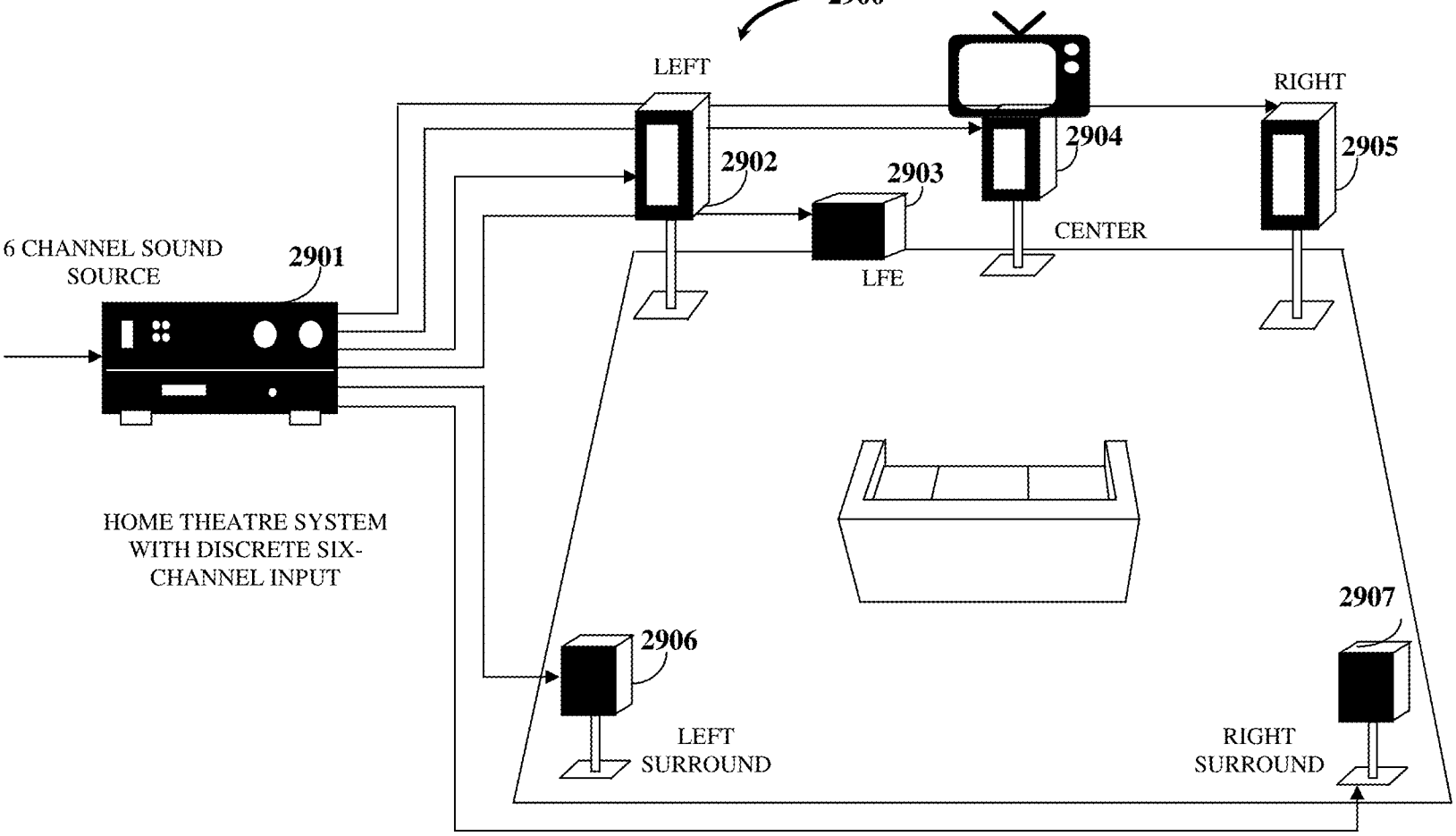
FIG. 29 exemplarily illustrates a configurable sound field generated by the three-dimensional sound processing application, showing a virtual three-dimensional home theater system.

FIG. 29 exemplarily illustrates a configurable sound field generated by the three-dimensional (3D) sound processing application 1602 exemplarily illustrated in FIG. 16 and FIG. 33, showing a virtual three-dimensional (3D) home theater system 2900. The virtual 3D home theater system 2900 comprises a power amplifier 2901, a left speaker 2902, a low frequency effects (LFE) speaker 2903, a center speaker 2904, a right speaker 2905, a left surround speaker 2906, and a right surround speaker 2907. The power amplifier 2901 amplifies the sound signal from a sound source and drives the output to the channels of the speakers 2902, 2903, 2904, 2905, 2906, and 2907 of the configurable virtual 3D home theater system 2900. The virtual 3D home theater system 2900 allows a user to customize the number and 3D alignment of the speaker channels in order to achieve suitable rendering effects based on the user's preference.

Figure 30A:
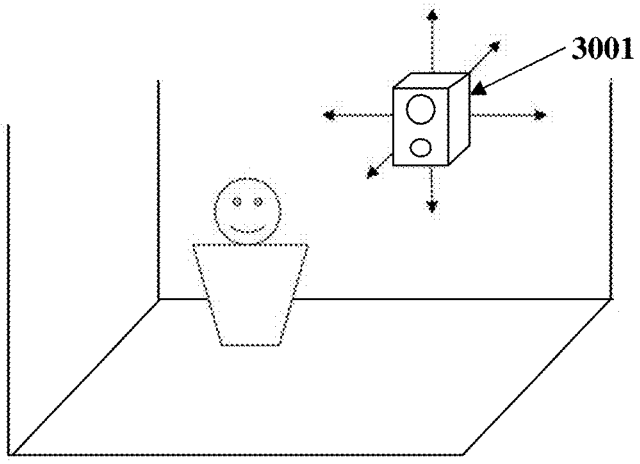
FIGS. 30A-30B exemplarily illustrate movement and alignment of a sound source in a virtual three-dimensional space.
Figure 30B:
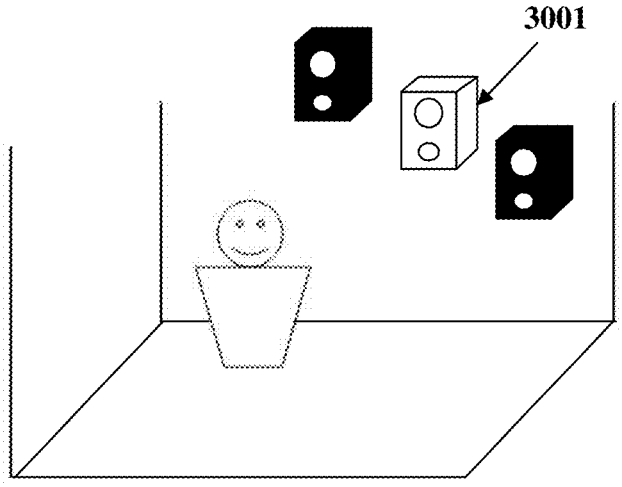

FIGS. 30A-30B exemplarily illustrate movement and alignment of a sound source 3001 in a virtual 3D space. The 3D sound system 900 disclosed herein and exemplarily illustrated in FIG. 9 and FIG. 33, allows a user to select the volume and placement of the virtual sound sources 3001, for example, virtual speakers on the configurable sound field generated by the 3D sound processing application 1602 exemplarily illustrated in FIG. 16 and FIG. 33, via the GUI. The 3D sound system 900 disclosed herein moves the sound source 3001 in a virtual 3D space as exemplarily illustrated in FIG. 30A using binaural rendering with accurate head related transfer functions (HRTFs). The 3D sound system 900 disclosed herein further facilitates duplication of the sound source 3001 and then alignment of the sound source 3001 on a user defined location as exemplarily illustrated in FIG. 30B, to obtain a more immersive audio field in a virtual 3D space.

Figure 31:
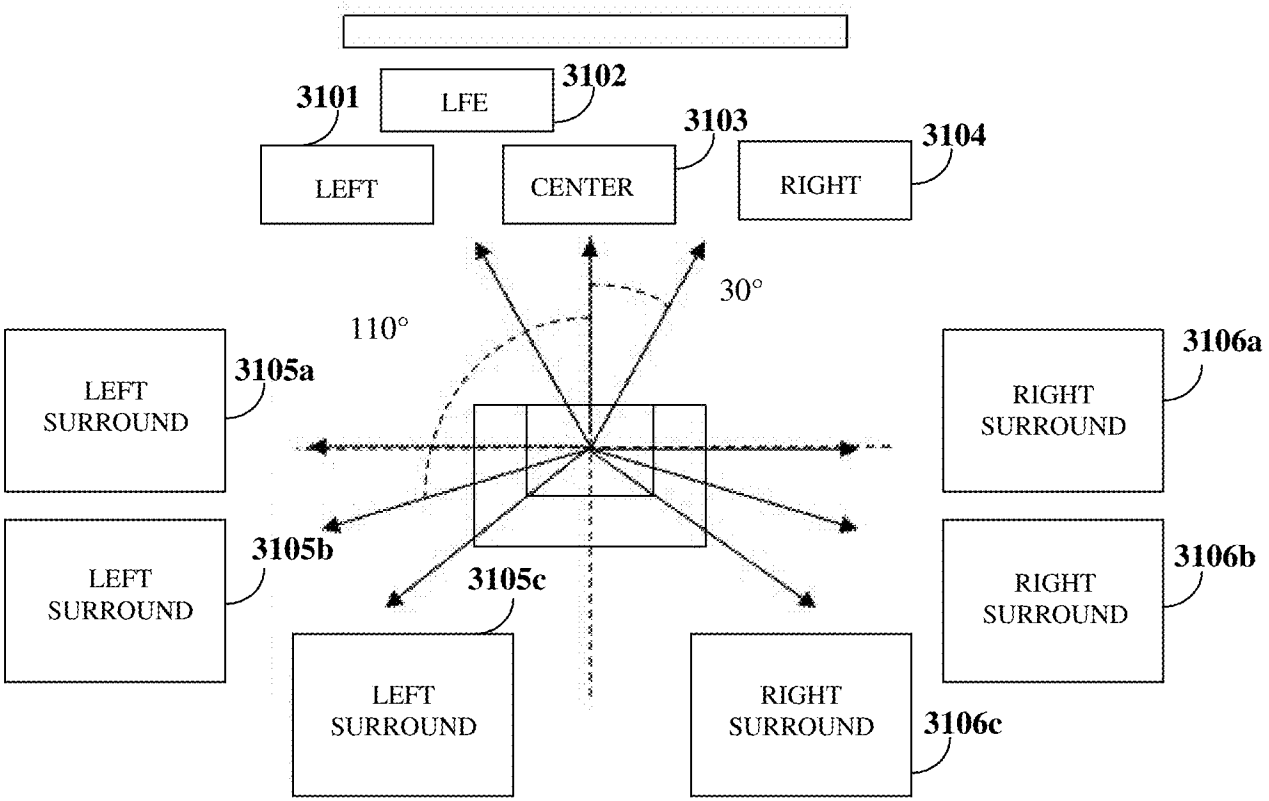
FIG. 31 exemplarily illustrates virtual sound source alignment configured to simulate a movie theater environment.

FIG. 31 exemplarily illustrates virtual sound source alignment configured to simulate a movie theater environment. The alignment of virtual sound sources, for example, loudspeakers such as a left speaker 3101, a low frequency effects (LFE) speaker 3102, a center speaker 3103, a right speaker 3104, left surround sound speakers 3105*a*, 3105*b*, and 3105*c*, and right surround sound speakers 3106*a*, 3106*b*, and 3106*c* to simulate a movie theater environment is exemplarily illustrated in FIG. 31. A microphone array system 902 forms acoustic beam patterns as disclosed in the co-pending non-provisional U.S. patent application Ser. No. 13/049,877, for each angle of the loudspeakers 3101, 3102, 3103, 3104, 3105*a*, 3105*b*, 3105*c*, 3106*a*, 3106*b*, and 3106*c*, as exemplarily illustrated in FIGS. 13A-13B and FIGS. 14A-14D.

Figure 32:
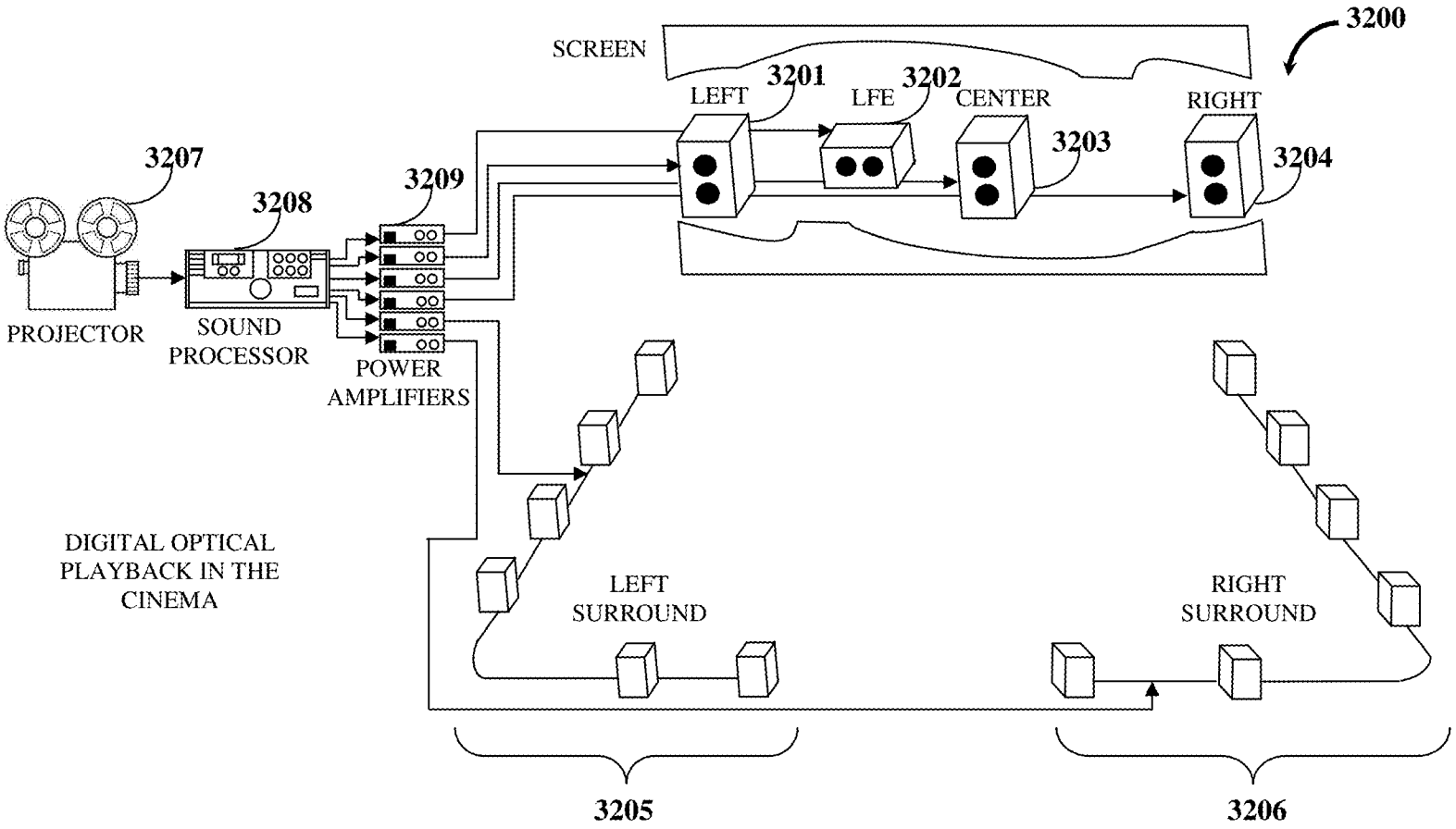
FIG. 32 exemplarily illustrates a configurable sound field generated by the three-dimensional sound processing application, showing loudspeaker alignment in a theater.

FIG. 32 exemplarily illustrates a configurable sound field generated by the three-dimensional sound processing application 1602 exemplarily illustrated in FIG. 16 and FIG. 33, showing a loudspeaker alignment in a theater. The generated configurable sound field constitutes a configurable virtual 3D movie theater system 3200 comprising multiple loudspeakers 3201, 3202, 3203, 3204, 3205, and 3206 aligned in different directions to simulate a movie theater environment. The configurable virtual 3D movie theater system 3200 comprises a left speaker 3201, a low frequency effects (LFE) speaker 3202, a center speaker 3203, a right speaker 3204, left surround speakers 3205, and right surround speakers 3206. In an embodiment, the microphone array system 902 exemplarily illustrated in FIG. 9, forms the same number of acoustic beams as the number of loudspeakers 3201, 3202, 3203, 3204, 3205, and 3206 in a theater. One acoustic beam corresponds to the direction of one loudspeaker. FIG. 32 also illustrates the auralization of a cinema theater comprising a projector 3207, a sound processor 3208, and power amplifiers 3209, for spatial effects enhancement using the multi-channel sound sources. The configurable 3D sound system 900 exemplarily illustrated in FIG. 9 and FIG. 33 uses sound from multiple loudspeakers 3201, 3202, 3203, 3204, 3205, and 3206 for generating a theater auralization for 3D surround sound. The configurable 3D sound system 900 disclosed herein allows the user to build his/her own virtual theater, to enjoy immersive audio. The configurable 3D sound system 900 allows a user to customize the number and 3D alignment of the loudspeakers 3201, 3202, 3203, 3204, 3205, and 3206 to achieve suitable rendering effects based on the user's preference.

FIG. 33 illustrates a system 900 for generating configurable three-dimensional (3D) sounds. The system 900 disclosed herein, also referred to as the "configurable 3D sound system", comprises the 3D sound processing application 1602. The 3D sound processing application 1602 comprises a data acquisition module 3304, a sound field generation module 2601, and a sound processing module 2201. The data acquisition module 3304 is configured to acquire sound tracks from either the microphone array system 902 embedded in the computing device 901, or multiple sound sources positioned in a 3D space, or individual microphones 912 and 914 positioned in the 3D space exemplarily illustrated in FIG. 9. The sound field generation module 2601 is configured to generate a configurable sound field on a graphical user interface (GUI) 3303 provided by the 3D sound processing application 1602 using the acquired sound tracks. The configurable sound field comprises a graphical simulation of the sound sources in the 3D space on the GUI 3303. The configurable sound field is configured to allow a configuration of positions and movements of the sound sources. The data acquisition module 3304 is configured to acquire user selections of one or more of multiple configurable parameters, for example, a location, an azimuth, a distance, an evaluation, a quantity, a volume, a sound level, a sound effect, a trace of movement, etc., associated with the sound sources from the generated configurable sound field via the GUI 3303.

The sound processing module 2201 is configured to dynamically process the sound tracks using the acquired user selections to generate a configurable 3D binaural sound, a configurable 3D surround sound, and/or a configurable 3D stereo sound. The sound processing module 2201 of the 3D sound processing application 1602 is also configured to dynamically process the sound tracks with the head related transfer functions (HRTFs) computed by a head related transfer function (HRTF) measurement module 3305 of the 3D sound processing application 1602 in communication with the simulator apparatus 300 based on the acquired user selections to generate a configurable 3D binaural sound. The sound processing module 2201 is also configured to map the sound tracks to corresponding sound channels of the sound sources based on the acquired user selections to generate the configurable 3D surround sound. The sound processing module 2201 is also configured to map two of the sound tracks to corresponding sound channels of the sound sources based on the acquired user selections to generate the 3D stereo sound.

The system 900 disclosed herein further comprises the microphone array system 902 embedded in a computing device 901 as disclosed in the detailed description of FIG. 7 and FIG. 9. The microphone array system 902 is in operative communication with the 3D sound processing application 1602 in the computing device 901. The microphone array system 902 comprises a beam forming unit 3301 and a sound track recording module 3302. The beam forming unit 3301 is configured to form multiple acoustic beam patterns that point in different directions in the 3D space or to different positions of the sound sources in the 3D space. The sound track recording module 3302 is configured to record the sound tracks from the acoustic beam patterns. Each of the sound tracks corresponds to one of the different directions and one of the positions of the sound sources in the 3D space.

The system 900 disclosed herein further comprises the simulator apparatus 300 configured to simulate an upper body of a human as disclosed in the detailed description of FIG. 1 and FIGS. 3A-3C and FIG. 4. The system 900 disclosed herein further comprises a loudspeaker 401 and a microphone 313. The loudspeaker 401 is adjustably mounted at predetermined elevations and at a predetermined distance from a center of the head 301 of the simulator apparatus 300. The loudspeaker 401 is configured to emit a swept sine sound signal. The microphone 313 is positioned in an ear canal of each of the ears 303 of the simulator apparatus 300. The microphone 313 is configured to record responses of each of the ears 303 to the swept sine sound signal reflected from the head 301, the neck 302, the shoulders 309, and the anatomical torso 310 of the simulator apparatus 300 for multiple varying azimuths and multiple positions of the simulator apparatus 300 mounted and automatically rotated on a turntable 311. The microphone 313 is operably coupled to the 3D sound processing application 1602. The data acquisition module 3304 of the 3D sound processing application 1602 is configured to receive the recorded responses from each microphone 313. The 3D sound processing application 1602 further comprises the head related transfer function measurement module 3305 is configured to compute head related impulse responses (HRIRs) and transform the computed HRIRs to head related transfer functions (HRTFs).

As exemplarily illustrated in FIG. 33, in an embodiment, the 3D sound processing application 1602 further comprises a sound separation module 2101 configured to segment a stereo sound in one of multiple formats acquired from the sound sources into multiple sound tracks. The data acquisition module 3304 acquires the stereo sound from multiple microphones 912 positioned in the 3D space as exemplarily illustrated in FIG. 9, from any existing or pre-recorded stereo sound, or from any sound source positioned in the 3D space. The sound separation module 2101 is configured to apply pre-trained acoustic models to the stereo sound to recognize and separate the stereo sound into sound tracks. The 3D sound processing application 1602 further comprises a training module 2401 as exemplarily illustrated in FIG. 24, configured to train the pre-trained acoustic models based on pre-recorded sound sources as disclosed in the detailed description of FIG. 24. The sound processing module 2201 is configured to dynamically process the sound tracks with the head related transfer functions (HRTFs) computed by the head related transfer function measurement module 3305 of the 3D sound processing application 1602 in communication with the simulator apparatus 300 based on the acquired user selections to generate the configurable 3D binaural sound from the stereo sound.

The sound separation module 2101 is also configured to decode multi-channel sound of one or more of multiple formats to identify and separate multiple sound tracks from multiple sound channels associated with the multi-channel sound. The data acquisition module 3304 acquires the multi-channel sound from the sound sources positioned in the 3D space, for example, from multiple microphones 914 positioned in the 3D space as exemplarily illustrated in FIG. 9, or from any existing or pre-recorded multiple track sound. The sound processing module 2201 is further configured to dynamically process the sound tracks with the head related transfer functions (HRTFs) computed by the head related transfer function measurement module 3305 of the 3D sound processing application 1602 in communication with the simulator apparatus 300 based on the acquired user selections to generate the configurable 3D binaural sound from the multi-channel sound.

Figure 34:
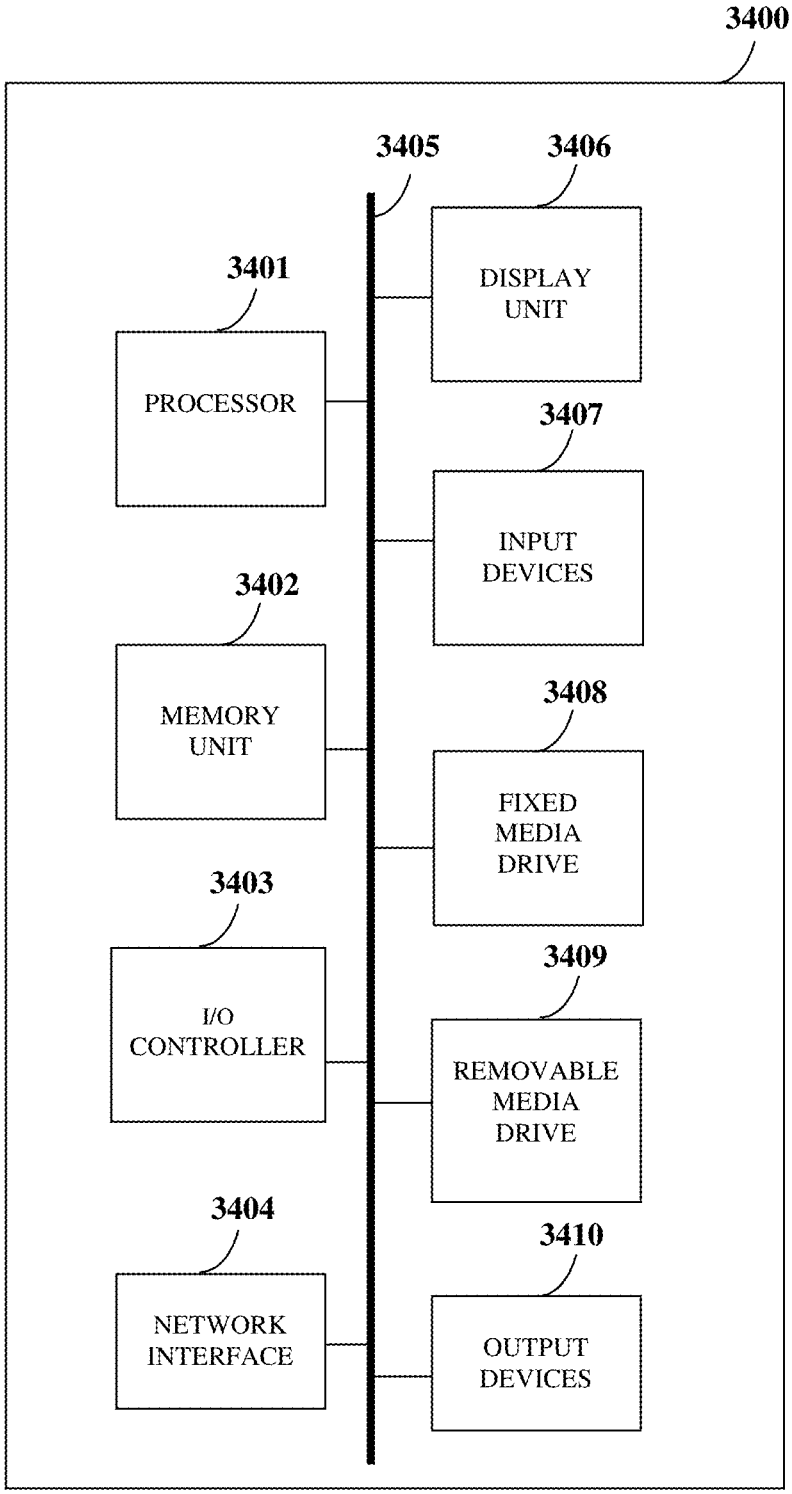
FIG. 34 exemplarily illustrates an architecture of a computer system employed by the three-dimensional sound processing application for generating configurable three-dimensional sounds.

FIG. 34 exemplarily illustrates an architecture of a computer system 3400 employed by the three-dimensional (3D) sound processing application 1602 for generating configurable 3D sounds. The 3D sound processing application 1602 of the configurable 3D sound system 900 exemplarily illustrated in FIG. 33, employs the architecture of the computer system 3400 exemplarily illustrated in FIG. 34. The computer system 3400 comprises, for example, a processor 3401, a memory unit 3402 for storing programs and data, an input/output (I/O) controller 3403, a network interface 3404, a data bus 3405, a display unit 3406, input devices 3407, a fixed media drive 3408, a removable media drive 3409 for receiving removable media, output devices 3410, etc.

The processor 3401 is an electronic circuit that executes computer programs. The memory unit 3402 stores programs, applications, and data. For example, the beam forming unit 3301, the sound track recording module 3302, the data acquisition module 3304, the sound separation module 2101, the sound field generation module 2601, the sound processing module 2201, and the head related transfer function (HRTF) measurement module 3305 as exemplarily illustrated in FIG. 33, are stored in the memory unit 3402 of the computer system 3400. The memory unit 3402 is, for example, a random access memory (RAM) or another type of dynamic storage device that stores information and instructions for execution by the processor 3401. The memory unit 3402 also stores temporary variables and other intermediate information used during execution of the instructions by the processor 3401. The computer system 3400 further comprises a read only memory (ROM) or another type of static storage device that stores static information and instructions for the processor 3401.

In an example, the computer system 3400 communicates with other interacting devices, for example, the simulator apparatus 300 via the network interface 3404. The network interface 3404 comprises, for example, a Bluetooth® interface, an infrared (IR) interface, an interface that implements Wi-Fi® of the Wireless Ethernet Compatibility Alliance, Inc., a universal serial bus (USB) interface, a local area network (LAN) interface, a wide area network (WAN) interface, etc. The I/O controller 3403 controls input actions and output actions performed by the user. The data bus 3405 permits communication between the modules, for example, 3301 and 3302 of the microphone array system 902, and between the modules, for example, 3303, 3304, 2101, 2601, 2201, and 3305 of the 3D sound processing application 1602.

The display unit 3406 displays the configurable sound field generated by the sound field generation module 2601 via a graphical user interface (GUI) 3303 of the 3D sound processing application 1602. The display unit 3406, for example, displays icons, user interface elements such as text fields, menus, display interfaces, etc., for accessing the generated configurable sound field. The input devices 3407 are used for inputting data, for example, user selections, into the computer system 3400. The input devices 3407 are, for example, a keyboard such as an alphanumeric keyboard, a joystick, a computer mouse, a touch pad, a light pen, a digital pen, a microphone, a digital camera, etc. The output devices 3410 output the results of the actions computed by the 3D sound processing application 1602.

Computer applications and programs are used for operating the computer system 3400. The programs are loaded onto the fixed media drive 3408 and into the memory unit 3402 of the computer system 3400 via the removable media drive 3409. In an embodiment, the computer applications and programs may be loaded directly via a network 3404, for example, a Wi-Fi® network. Computer applications and programs are executed by double clicking a related icon displayed on the display unit 3406 using one of the input devices 3407. The computer system 3400 employs an operating system for performing multiple tasks. The operating system is responsible for management and coordination of activities and sharing of resources of the computer system 3400. The operating system further manages security of the computer system 3400, peripheral devices connected to the computer system 3400, and network connections. The operating system employed on the computer system 3400 recognizes, for example, inputs provided by a user using one of the input devices 3407, the output display, files, and directories stored locally on the fixed media drive 3408, for example, a hard drive.

The operating system on the computer system 3400 executes different programs using the processor 3401. The processor 3401 retrieves the instructions for executing the modules, for example, 3301 and 3302 of the microphone array system 902, and the modules, for example, 3303, 3304, 2101, 2601, 2201, and 3305 of the 3D sound processing application 1602. A program counter determines the location of the instructions in the memory unit 3402. The program counter stores a number that identifies a current position in a program of each of the modules, for example, 3301 and 3302 of the microphone array system 902, and the modules, for example, 3303, 3304, 2101, 2601, 2201, and 3305 of the 3D sound processing application 1602.

The instructions fetched by the processor 3401 from the memory unit 3402 after being processed are decoded. The instructions are placed in an instruction register in the processor 3401. After processing and decoding, the processor 3401 executes the instructions. For example, the beam forming unit 3301 of the microphone array system 902 defines instructions for forming multiple acoustic beam patterns, where the acoustic beam patterns point in different directions in the 3D space or to different positions of the sound sources in the 3D space. The sound track recording module 3302 of the microphone array system 902 defines instructions for recording sound tracks from the acoustic beam patterns. The data acquisition module 3304 defines instructions for acquiring sound tracks from either the microphone array system 902 embedded in the computing device 901, or multiple sound sources positioned in the 3D space, or individual microphones 912 and 914 positioned in the 3D space exemplarily illustrated in FIG. 9. The sound field generation module 2601 defines instructions for generating a configurable sound field on the graphical user interface (GUI) 3303 provided by the 3D sound processing application 1602 using the sound tracks. The data acquisition module 3304 defines instructions for acquiring user selections of one or more of multiple configurable parameters associated with sound sources from the generated configurable sound field via the GUI 3303. The sound processing module 2201 defines instructions for dynamically processing the sound tracks using the acquired user selections to generate one or more of a configurable 3D binaural sound, a configurable 3D surround sound, and/or a configurable 3D stereo sound.

The head related transfer function (HRTF) measurement module 3305 defines instructions for computing head related impulse responses and for transforming the computed head related impulse responses to head related transfer functions (HRTFs). The sound processing module 2201 defines instructions for dynamically processing the sound tracks with the HRTFs based on the acquired user selections to generate a configurable 3D binaural sound. The sound processing module 2201 further defines instructions for mapping the sound tracks to corresponding sound channels of the sound sources based on the acquired user selections to generate the configurable 3D surround sound. The sound processing module 2201 defines instructions for mapping two sound tracks to corresponding sound channels of the sound sources based on the acquired user selections to generate the configurable 3D stereo sound.

The sound separation module 2101 defines instructions for segmenting the stereo sound of one of multiple formats acquired from multiple sound sources, for example, from microphones 912 positioned in the 3D space or acquired from existing or pre-recorded stereo sound into multiple sound tracks. The sound separation module 2101 defines instructions for applying pre-trained acoustic models to the stereo sound to recognize and separate the stereo sound into the sound tracks. The training module 2401, exemplarily illustrated in FIG. 24, defines instructions for training the pre-trained acoustic models based on pre-recorded sound sources. The sound separation module 2101 defines instructions for decoding multi-channel sound of one of multiple formats to identify and separate multiple sound tracks from multiple sound channels associated with the multi-channel sound. The sound processing module 2201 defines instructions for dynamically processing the sound tracks with the measured head related transfer functions (HRTFs) based on the acquired user selections to generate the configurable 3D binaural sound from the stereo sound or the multi-channel sound.

The processor 3401 of the computer system 3400 employed by the microphone array system 902 retrieves the instructions defined by the beam forming unit 3301 and the sound track recording module 3302 of the microphone array system 902, and executes them. The processor 3401 of the computer system 3400 employed by the 3D sound processing application 1602 retrieves the instructions defined by the data acquisition module 3304, the sound separation module 2101, the sound field generation module 2601, the sound processing module 2201, the training module 2401, and the head related transfer function measurement module 3305, and executes the instructions.

At the time of execution, the instructions stored in the instruction register are examined to determine the operations to be performed. The processor 3401 then performs the specified operations. The operations comprise arithmetic operations and logic operations. The operating system performs multiple routines for performing a number of tasks required to assign the input devices 3407, the output devices 3410, and memory for execution of the modules, for example, 3301 and 3302 of the microphone array system 902, and the modules, for example, 3303, 3304, 2101, 2601, 2201, and 3305 of the 3D sound processing application 1602. The tasks performed by the operating system comprise, for example, assigning memory to the modules, for example, 3301 and 3302 of the microphone array system 902, and the modules, for example, 3303, 3304, 2101, 2601, 2201, and 3305 of the 3D sound processing application 1602, and data, moving data between the memory unit 3402 and disk units, and handling input/output operations. The operating system performs the tasks on request by the operations and after performing the tasks, the operating system transfers the execution control back to the processor 3401. The processor 3401 continues the execution to obtain one or more outputs. The outputs of the execution of the modules, for example, 3301 and 3302 of the microphone array system 902, and the modules, for example,

3303, 3304, 2101, 2601, 2201, and 3305 of the 3D sound processing application 1602 are displayed to the user on the display unit 3406.

For purposes of illustration, the detailed description refers to the 3D sound processing application 1602 disclosed herein being run locally on the computing device 901; however the scope of the method and the configurable 3D sound system 900 disclosed herein is not limited to the 3D sound processing application 1602 being run locally on the computer system 3400 via the operating system and the processor 3401 but may be extended to run remotely over a network, for example, by employing a web browser and a remote server, a mobile phone, or other electronic devices.

Disclosed herein is also a computer program product comprising a non-transitory computer readable storage medium that stores computer program codes comprising instructions executable by at least one processor 3401 of the computer system 3400 for generating configurable 3D sounds. The non-transitory computer readable storage medium is communicatively coupled to the processor 3401. The non-transitory computer readable storage medium is configured to store the modules, for example, 3301 and 3302 of the microphone array system 902, and the modules, for example, 3303, 3304, 2101, 2601, 2201, and 3305 of the 3D sound processing application 1602. As used herein, the term "non-transitory computer readable storage medium" refers to all computer readable media, for example, non-volatile media such as optical disks or magnetic disks, volatile media such as a register memory, a processor cache, etc., and transmission media such as wires that constitute a system bus coupled to the processor 3401, except for a transitory, propagating signal.

The computer program product disclosed herein comprises multiple computer program codes for generating configurable 3D sounds. For example, the computer program product disclosed herein comprises a first computer program code for acquiring sound tracks from a microphone array system 902 embedded in a computing device 901, multiple sound sources positioned in the 3D space, or individual microphones 912 and 914 positioned in the 3D space as exemplarily illustrated in FIG. 9, where each of the sound tracks corresponds to one multiple directions and to one of the sound sources in the 3D space; a second computer program code for generating a configurable sound field on the GUI 3303 using the sound tracks; a third computer program code for acquiring user selections of one or more of multiple configurable parameters associated with the sound sources from the generated configurable sound field via the GUI 3303; and a fourth computer program code for dynamically processing the sound tracks using the acquired user selections to generate a configurable 3D binaural sound, a configurable 3D stereo sound, and/or a configurable 3D surround sound.

The computer program product disclosed herein further comprises a fifth computer program code for receiving responses to an impulse sound reflected from the head 301, the neck 302, the shoulders 309, and the anatomical torso 310 of the simulator apparatus 300, recorded by each microphone 313 positioned in each ear canal of each ear 303 of the simulator apparatus 300 exemplarily illustrated in FIGS. 3A-3C; a sixth computer program code for computing head related impulse responses, a seventh computer program code for transforming the computed head related impulse responses to the head related transfer functions (HRTFs). The computer program product disclosed herein further comprises an eighth computer program code for dynamically processing the sound tracks with the HRTFs based on the acquired user selections to generate the configurable 3D binaural sound. The computer program product disclosed herein further comprises a ninth computer program code for segmenting a stereo sound in one of multiple formats acquired from sound sources positioned in the 3D space or acquired from existing or pre-recorded stereo sound, into multiple sound tracks; and a tenth computer program code for dynamically processing the sound tracks with HRTFs based on the acquired user selections to generate the configurable three-dimensional binaural sound from the stereo sound.

The computer program product disclosed herein further comprises an eleventh computer program code for applying pre-trained acoustic models to the stereo sound to recognize and separate the recorded stereo sound into the sound tracks; and a twelfth computer program code for training the pre-trained acoustic models based on pre-recorded sound sources. The computer program product disclosed herein further comprises a thirteenth computer program code for decoding a multi-channel sound in one of multiple formats acquired from the sound sources positioned in the 3D space to identify and separate the sound tracks from multiple sound channels associated with the multi-channel sound. The computer program product disclosed herein further comprises a fourteenth computer program code for dynamically processing the sound tracks with HRTFs based on the acquired user selections to generate the configurable three-dimensional binaural sound from the multi-channel sound. The computer program product disclosed herein further comprises a fifteenth computer program code for mapping the sound tracks to corresponding sound channels of the sound sources based on the acquired user selections to generate the configurable three-dimensional surround sound. The computer program product disclosed herein further comprises a sixteenth computer program code for mapping two sound tracks to corresponding sound channels of the sound sources based on the acquired user selections to generate the configurable three-dimensional stereo sound.

The computer program product disclosed herein further comprises additional computer program codes for performing additional steps that may be required and contemplated for generating configurable 3D sounds. In an embodiment, a single piece of computer program code comprising computer executable instructions performs one or more steps of the method disclosed herein for generating configurable 3D sounds. The computer program codes comprising the computer executable instructions are embodied on the non-transitory computer readable storage medium. The processor 3401 of the computer system 3400 retrieves these computer executable instructions and executes them. When the computer executable instructions are executed by the processor 3401, the computer executable instructions cause the processor 3401 to perform the method steps for generating configurable 3D sounds.

The configurable 3D sound system 900 disclosed herein enables simultaneous recording of binaural sound, stereo sound, and surround sound. The configurable 3D sound system 900 can be used in portable devices, for example, smart phones, tablet computing devices, etc. The microphone array system 902 can be configured in a computing device 901 with a universal serial bus (USB) interface for applications in 3D sound recording. The multiple channel sound can be saved in one file in a portable device. Using the 3D sound processing application 1602, users can play the recorded audio as a 3D binaural sound or a 3D surround sound. The 3D sound processing application 1602 can be configured for use by movie and sound editors, where a recorded multiple channel sound can be synthesized to a binaural sound or a surround sound as required by the user. Users can perform professional or home movie, video, and music editing via the GUI 3303 of the 3D sound processing application 1602. Moreover, users can reconfigure the configurable sound field generated by the 3D sound processing application 1602 based on their preferences for binaural sound and surround sound. The head related transfer functions (HRTFs) computed by the 3D sound processing application 1602 in communication with the simulator apparatus 300 can also be used in the gaming industry to compute 3D sound in real time. The configurable 3D sound system 900 can be utilized in different fields and source formats, which provide a user with the ability to reconstruct his or her own virtual audio reality with corresponding audio and music binaural effects.

It will be readily apparent that the various methods and algorithms disclosed herein may be implemented on computer readable media appropriately programmed for general purpose computers and computing devices. As used herein, the term "computer readable media" refers to non-transitory computer readable media that participate in providing data, for example, instructions that may be read by a computer, a processor or a like device. Non-transitory computer readable media comprise all computer readable media, for example, non-volatile media, volatile media, and transmission media, except for a transitory, propagating signal. Non-volatile media comprise, for example, optical disks or magnetic disks and other persistent memory volatile media including a dynamic random access memory (DRAM), which typically constitutes a main memory. Volatile media comprise, for example, a register memory, a processor cache, a random access memory (RAM), etc. Transmission media comprise, for example, coaxial cables, copper wire and fiber optics, including wires that constitute a system bus coupled to a processor. Common forms of computer readable media comprise, for example, a floppy disk, a flexible disk, a hard disk, magnetic tape, any other magnetic medium, a compact disc-read only memory (CD-ROM), a digital versatile disc (DVD), any other optical medium, a flash memory card, punch cards, paper tape, any other physical medium with patterns of holes, a random access memory (RAM), a programmable read only memory (PROM), an erasable programmable read only memory (EPROM), an electrically erasable programmable read only memory (EEPROM), a flash memory, any other memory chip or cartridge, or any other medium from which a computer can read. A "processor" refers to any one or more microprocessors, central processing unit (CPU) devices, computing devices, microcontrollers, digital signal processors or like devices. Typically, a processor receives instructions from a memory or like device and executes those instructions, thereby performing one or more processes defined by those instructions. Further, programs that implement such methods and algorithms may be stored and transmitted using a variety of media, for example, the computer readable media in a number of manners. In an embodiment, hard-wired circuitry or custom hardware may be used in place of, or in combination with, software instructions for implementation of the processes of various embodiments. Therefore, the embodiments are not limited to any specific combination of hardware and software. In general, the computer program codes comprising computer executable instructions may be implemented in any programming language. Some examples of languages that can be used comprise C, C++, C#, Perl, Python, or Java. The computer program codes or software programs may be stored on or in one or more mediums as object code. The computer program product disclosed herein comprises computer executable instructions embodied in a non-transitory computer readable storage medium, wherein the computer program product comprises one or more computer program codes for implementing the processes of various embodiments.

Where databases are described such as the head related transfer function (HRTF) database 908, it will be understood by one of ordinary skill in the art that (i) alternative database structures to those described may be readily employed, and (ii) other memory structures besides databases may be readily employed. Any illustrations or descriptions of any sample databases disclosed herein are illustrative arrangements for stored representations of information. Any number of other arrangements may be employed besides those suggested by tables illustrated in the drawings or elsewhere. Similarly, any illustrated entries of the databases represent exemplary information only; one of ordinary skill in the art will understand that the number and content of the entries can be different from those disclosed herein. Further, despite any depiction of the databases as tables, other formats including relational databases, object-based models, and/or distributed databases may be used to store and manipulate the data types disclosed herein. Likewise, object methods or behaviors of a database can be used to implement various processes such as those disclosed herein. In addition, the databases may, in a known manner, be stored locally or remotely from a device that accesses data in such a database. In embodiments where there are multiple databases in the system, the databases may be integrated to communicate with each other for enabling simultaneous updates of data linked across the databases, when there are any updates to the data in one of the databases.

The present invention can be configured to work in a network environment including a computer that is in communication with one or more devices via a communication network. The computer may communicate with the devices directly or indirectly, via a wired medium or a wireless medium such as the Internet, a local area network (LAN), a wide area network (WAN) or the Ethernet, token ring, or via any appropriate communications means or combination of communications means. Each of the devices may comprise computers such as those based on the Intel® processors, AMD® processors, UltraSPARC® processors, IBM® processors, processors of Apple Inc., etc., that are adapted to communicate with the computer. The computer executes an operating system, for example, the Linux® operating system, the Unix® operating system, any version of the Microsoft® Windows® operating system, the Mac OS of Apple Inc., the IBM® OS/2, or any other operating system. While the operating system may differ depending on the type of computer, the operating system will continue to provide the appropriate communications protocols to establish communication links with the network. Any number and type of machines may be in communication with the computer.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

We claim:

1. A method for simultaneously generating configurable three-dimensional sounds, comprising:

providing a three-dimensional sound processing application on a computing device, wherein said three-dimensional sound processing application is executable by at least one processor configured to simultaneously generate said configurable three-dimensional sounds;

providing a microphone array system embedded in said computing device, said microphone array system in operative communication with said three-dimensional sound processing application in said computing device, wherein said microphone array system comprises an array of microphone elements positioned in a three-dimensional space, wherein said microphone array system is configured to form a plurality of acoustic beam patterns, wherein each of said plurality of said acoustic beam patterns point to a different direction in said three-dimensional space, and wherein said each of said plurality of said acoustic beam patterns point to different positions of a plurality of sound sources in said three-dimensional space;

recording sound tracks from said acoustic beam patterns by said microphone array system, wherein each of said recorded sound tracks corresponds to one of said directions in said three-dimensional space;

generating a configurable sound field on a graphical user interface provided by said three-dimensional sound processing application using said recorded sound tracks, wherein said configurable sound field comprises a graphical simulation of said sound sources in said three-dimensional space on said graphical user interface, and wherein said configurable sound field is configured to allow a configuration of positions and movements of said sound sources;

acquiring user selections of one or more of a plurality of configurable parameters associated with said sound sources from said generated configurable sound field by said three-dimensional sound processing application via said graphical user interface; and dynamically processing said recorded sound tracks using said acquired user selections by said three-dimensional sound processing application to generate one or more of a configurable three-dimensional binaural sound, a configurable three-dimensional surround sound, and a configurable three-dimensional stereo sound.

2. The method of claim 1, further comprising measuring a plurality of head related transfer functions by said three-dimensional sound processing application in communication with a simulator apparatus configured to simulate an upper body of a human.

3. The method of claim 2, wherein said simulator apparatus comprises a head with detailed facial characteristics, ears, a neck, and an anatomical torso with shoulders, and wherein said simulator apparatus is configured to texturally conform to flesh, skin, and contours of said upper body of said human, and wherein a microphone is positioned in an ear canal of each of said ears of said simulator apparatus.

4. The method of claim 3, further comprising:

recording responses of said each of said ears to an impulse sound reflected from said head, said neck, said shoulders, and said anatomical torso of said simulator apparatus by each said microphone for a plurality of varying azimuths and a plurality of positions of said simulator apparatus mounted and automatically rotated on a turntable;

receiving said recorded responses from said each said microphone and computing head related impulse responses by said three-dimensional sound processing application; and transforming said computed head related impulse responses to said head related transfer functions by said three-dimensional sound processing application.

5. The method of claim 4, further comprising dynamically processing said recorded sound tracks with said head related transfer functions based on said acquired user selections by said three-dimensional sound processing application to generate said configurable three-dimensional binaural sound.

6. The method of claim 1, further comprising mapping said recorded sound tracks to corresponding sound channels of said sound sources by said three-dimensional sound processing application based on said acquired user selections to generate said configurable three-dimensional surround sound.

7. The method of claim 1, further comprising mapping two of said recorded sound tracks to corresponding sound channels of said sound sources by said three-dimensional sound processing application based on said acquired user selections to generate said configurable three-dimensional stereo sound.

8. The method of claim 1, wherein said configurable parameters associated with said sound sources comprise one or more of a location, an azimuth, a distance, an evaluation, a quantity, a volume, a sound level, a sound effect, and a trace of movement of each of said sound sources.

9. A method for simultaneously generating configurable three-dimensional sounds, comprising:

providing a three-dimensional sound processing application on a computing device, wherein said three-dimensional sound processing application is executable by at least one processor configured to simultaneously generate said configurable three-dimensional sounds;

acquiring sound tracks from sound sources positioned in a three-dimensional space by said three-dimensional sound processing application, wherein each of said acquired sound tracks corresponds to one of a plurality of directions in said three-dimensional space;

generating a configurable sound field on a graphical user interface provided by said three-dimensional sound processing application using said acquired sound tracks, wherein said configurable sound field comprises a graphical simulation of said sound sources in said three-dimensional space on said graphical user interface, and wherein said configurable sound field is configured to allow a configuration of positions and movements of said sound sources;

acquiring user selections of one or more of a plurality of configurable parameters associated with said sound sources from said generated configurable sound field by said three-dimensional sound processing application via said graphical user interface; and dynamically processing said acquired sound tracks using said acquired user selections by said three-dimensional sound processing application to generate one or more of a configurable three-dimensional binaural sound, a configurable three-dimensional surround sound, and a configurable three-dimensional stereo sound.

10. The method of claim 9, further comprising measuring a plurality of head related transfer functions by said three-dimensional sound processing application in communication with a simulator apparatus configured to simulate an upper body of a human.

11. The method of claim 10, wherein said simulator apparatus comprises a head with detailed facial characteristics, ears, a neck, and an anatomical torso with shoulders, and wherein said simulator apparatus is configured to texturally conform to flesh, skin, and contours of said upper body of said human, and wherein a microphone is positioned in an ear canal of each of said ears of said simulator apparatus.

12. The method of claim 11, further comprising:

recording responses of said each of said ears to an impulse sound reflected from said head, said neck, said shoulders, and said anatomical torso of said simulator apparatus by each said microphone for a plurality of varying azimuths and a plurality of positions of said simulator apparatus mounted and automatically rotated on a turntable;

receiving said recorded responses from said each said microphone and computing head related impulse responses by said three-dimensional sound processing application; and transforming said computed head related impulse responses to said head related transfer functions by said three-dimensional sound processing application.

13. The method of claim 12, further comprising dynamically processing said acquired sound tracks with said head related transfer functions based on said acquired user selections by said three-dimensional sound processing application to generate said configurable three-dimensional binaural sound.

14. The method of claim 9, further comprising mapping said acquired sound tracks to corresponding sound channels of said sound sources by said three-dimensional sound processing application based on said acquired user selections to generate said configurable three-dimensional surround sound.

15. The method of claim 9, further comprising mapping two of said acquired sound tracks to corresponding sound channels of said sound sources by said three-dimensional sound processing application based on said acquired user selections to generate said configurable three-dimensional stereo sound.

16. The method of claim 9, wherein said configurable parameters associated with said sound sources comprise one or more of a location, an azimuth, a distance, an evaluation, a quantity, a volume, a sound level, a sound effect, and a trace of movement of each of said sound sources.

17. The method of claim 9, wherein said sound sources from which said sound tracks are acquired by said three-dimensional sound processing application comprise one or more of a plurality of pre-recorded sound tracks and pre-recorded stereo sound tracks.

18. A method for generating a configurable three-dimensional binaural sound, comprising:

providing a three-dimensional sound processing application on a computing device, wherein said three-dimensional sound processing application is executable by at least one processor configured to generate said configurable three-dimensional binaural sound from one of a stereo sound and a multi-channel sound;

acquiring a sound input in one of a plurality of formats from a plurality of sound sources positioned in a three-dimensional space by said three-dimensional sound processing application, wherein said sound input is said one of said stereo sound and said multi-channel sound;

segmenting said acquired sound input into a plurality of sound tracks by said three-dimensional sound processing application, wherein each of said sound tracks corresponds to one of said sound sources;

generating a configurable sound field on a graphical user interface provided by said three-dimensional sound processing application using said sound tracks, wherein said configurable sound field comprises a graphical simulation of said sound sources in said three-dimensional space on said graphical user interface, and wherein said configurable sound field is configured to allow a configuration of positions and movements of said sound sources;

acquiring user selections of one or more of a plurality of configurable parameters associated with said sound sources from said generated configurable sound field by said three-dimensional sound processing application via said graphical user interface;

measuring a plurality of head related transfer functions by said three-dimensional sound processing application in communication with a simulator apparatus configured to simulate an upper body of a human; and dynamically processing said sound tracks with said measured head related transfer functions by said three-dimensional sound processing application based on said acquired user selections to generate said configurable three-dimensional binaural sound from said one of said stereo sound and said multi-channel sound.

19. The method of claim 18, wherein said configurable parameters associated with said sound sources comprise one or more of a location, an azimuth, a distance, an evaluation, a quantity, a volume, a sound level, a sound effect, and a trace of movement of each of said sound sources.

20. The method of claim 18, wherein said simulator apparatus comprises a head with detailed facial characteristics, ears, a neck, and an anatomical torso with shoulders, and wherein said simulator apparatus is configured to texturally conform to flesh, skin, and contours of said upper body of said human, and wherein a microphone is positioned in an ear canal of each of said ears of said simulator apparatus.

21. The method of claim 20, further comprising:

recording responses of said each of said ears to an impulse sound reflected from said head, said neck, said shoulders, and said anatomical torso of said simulator apparatus by each said microphone for a plurality of varying azimuths and a plurality of positions of said simulator apparatus mounted and automatically rotated on a turntable;

receiving said recorded responses from said each said microphone and computing head related impulse responses by said three-dimensional sound processing application; and transforming said computed head related impulse responses to said head related transfer functions by said three-dimensional sound processing application.

22. The method of claim 18, wherein said segmentation of said stereo sound acquired from said sound sources into said sound tracks by said three-dimensional sound processing application comprises applying pre-trained acoustic models to said stereo sound by said three-dimensional sound processing application to recognize and separate said stereo sound into said sound tracks, wherein said three-dimensional sound processing application is configured to train said pre-trained acoustic models based on pre-recorded sound sources.

23. The method of claim 18, wherein said three-dimensional sound processing application is configured to decode said multi-channel sound acquired from said sound sources to identify and separate said sound tracks from a plurality of sound channels associated with said multi-channel sound, wherein each of said sound channels corresponds to one of said sound sources.

24. A method for generating a configurable three-dimensional surround sound, comprising:

providing a three-dimensional sound processing application on a computing device, wherein said three-dimensional sound processing application is executable by at least one processor configured to generate said configurable three-dimensional surround sound;

providing a microphone array system embedded in a computing device, said microphone array system in operative communication with said three-dimensional sound processing application in said computing device, wherein said microphone array system comprises an array of microphone elements positioned in a three-dimensional space, wherein said microphone array system is configured to form a plurality of acoustic beam patterns, wherein each of said plurality of said acoustic beam patterns point to a different direction in said three-dimensional space, and wherein said each of said plurality of said acoustic beam patterns point to different positions of a plurality of sound sources in said three-dimensional space;

recording a plurality of sound tracks from said acoustic beam patterns output from sound channels of said microphone elements by said microphone array system, wherein each of said recorded sound tracks corresponds to one of said positions of said sound sources;

generating a configurable sound field on a graphical user interface provided by said three-dimensional sound processing application using said recorded sound tracks, wherein said configurable sound field comprises a graphical simulation of said sound sources in said three-dimensional space on said graphical user interface, and wherein said configurable sound field is configured to allow a configuration of positions and movements of said sound sources;

acquiring user selections of one or more of a plurality of configurable parameters associated with said sound sources from said generated configurable sound field by said three-dimensional sound processing application via said graphical user interface; and mapping said recorded sound tracks with corresponding sound channels of said sound sources by said three-dimensional sound processing application based on said acquired user selections to generate said configurable three-dimensional surround sound.

25. The method of claim 24, wherein said configurable parameters associated with said sound sources comprise one or more of a location, an azimuth, a distance, an evaluation, a quantity, a volume, a sound level, a sound effect, and a trace of movement of each of said sound sources.

26. A method for measuring head related transfer functions, comprising:

providing a simulator apparatus configured to simulate an upper body of a human, said simulator apparatus comprising a head with detailed facial characteristics, ears, a neck, and an anatomical torso with shoulders, wherein said simulator apparatus is configured to texturally conform to flesh, skin, and contours of said upper body of said human;

providing a three-dimensional sound processing application on a computing device operably coupled to a microphone, said microphone positioned in an ear canal of each of said ears of said simulator apparatus, wherein said three-dimensional sound processing application is executable by at least one processor configured to measure said head related transfer functions;

adjustably mounting a loudspeaker at predetermined elevations and at a predetermined distance from a center of said head of said simulator apparatus, wherein said loudspeaker is configured to emit an impulse sound;

recording responses of said each of said ears to said impulse sound reflected from said head, said neck, said shoulders, and said anatomical torso of said simulator apparatus by each said microphone for a plurality of varying azimuths and a plurality of positions of said simulator apparatus mounted and automatically rotated on a turntable;

receiving said recorded responses from said each said microphone and computing head related impulse responses by said three-dimensional sound processing application; and transforming said computed head related impulse responses to said head related transfer functions by said three-dimensional sound processing application.

27. The method of claim 26, wherein said impulse sound emitted by said loudspeaker is a swept sine sound signal.

28. The method of claim 26, further comprising truncating said computed head related impulse responses using a filter by said three-dimensional sound processing application prior to said measurement of said head related transfer functions.

29. A system for generating configurable three-dimensional sounds, comprising:

at least one processor;

a non-transitory computer readable storage medium communicatively coupled to said at least one processor, said non-transitory computer readable storage medium configured to store modules of a three-dimensional sound processing application of said system that are executable by said at least one processor;

said modules of said three-dimensional sound processing application comprising:

a data acquisition module configured to acquire sound tracks from one of a microphone array system embedded in a computing device, a plurality of sound sources positioned in a three-dimensional space, and individual microphones positioned in said three-dimensional space, wherein each of said sound tracks corresponds to one of a plurality of directions and to one of said sound sources in said three-dimensional space;

a sound field generation module configured to generate a configurable sound field on a graphical user interface provided by said three-dimensional sound processing application using said sound tracks, wherein said configurable sound field comprises a graphical simulation of said sound sources in said three-dimensional space on said graphical user interface, and wherein said configurable sound field is configured to allow a configuration of positions and movements of said sound sources;

said data acquisition module configured to acquire user selections of one or more of a plurality of configurable parameters associated with said sound sources from said generated configurable sound field via said graphical user interface; and a sound processing module configured to dynamically process said sound tracks using said acquired user selections to generate one or more of a configurable three-dimensional binaural sound, a configurable three-dimensional surround sound, and a configurable three-dimensional stereo sound.

30. The system of claim 29, wherein said microphone array system is in operative communication with said three-dimensional sound processing application, and wherein said microphone array system comprises an array of microphone elements positioned in a three-dimensional space, and wherein said microphone array system comprises:

a beam forming unit configured to form a plurality of acoustic beam patterns, wherein each of said plurality of said acoustic beam patterns point to a different direction in said three-dimensional space, and wherein said each of said plurality of said acoustic beam patterns point to different positions of a plurality of sound sources in said three-dimensional space; and a sound track recording module configured to record said sound tracks from said acoustic beam patterns, wherein each of said recorded sound tracks corresponds to one of said directions and one of said positions of said sound sources in said three-dimensional space.

31. The system of claim 29, further comprising:

a simulator apparatus configured to simulate an upper body of a human, said simulator apparatus comprising a head with detailed facial characteristics, ears, a neck, and an anatomical torso with shoulders, wherein said simulator apparatus is configured to texturally conform to flesh, skin, and contours of said upper body of said human;

a loudspeaker adjustably mounted at predetermined elevations and at a predetermined distance from a center of said head of said simulator apparatus, wherein said loudspeaker is configured to emit an impulse sound;

a microphone positioned in an ear canal of each of said ears of said simulator apparatus, wherein said microphone is configured to record responses of said each of said ears to said impulse sound reflected from said head, said neck, said shoulders, and said anatomical torso of said simulator apparatus for a plurality of varying azimuths and a plurality of positions of said simulator apparatus mounted and automatically rotated on a turntable; and said microphone operably coupled to said three-dimensional sound processing application, wherein said data acquisition module of said three-dimensional sound processing application is configured to receive said recorded responses from said each said microphone, and wherein said three-dimensional sound processing application further comprises a head related transfer function measurement module configured to compute head related impulse responses and transform said computed head related impulse responses to said head related transfer functions.

32. The system of claim 31, wherein said sound processing module of said three-dimensional sound processing application is configured to dynamically process said sound tracks with said head related transfer functions based on said acquired user selections to generate a configurable three-dimensional binaural sound.

33. The system of claim 29, wherein said sound processing module of said three-dimensional sound processing application is configured to map said sound tracks to corresponding sound channels of said sound sources based on said acquired user selections to generate said configurable three-dimensional surround sound.

34. The system of claim 29, wherein said sound processing module of said three-dimensional sound processing application is configured to map two of said sound tracks to corresponding sound channels of said sound sources based on said acquired user selections to generate said configurable three-dimensional stereo sound.

35. The system of claim 29, wherein said configurable parameters associated with said sound sources comprise one or more of a location, an azimuth, a distance, an evaluation, a quantity, a volume, a sound level, a sound effect, and a trace of movement of each of said sound sources.

36. The system of claim 29, wherein said sound sources from which said sound tracks are acquired comprise one or more of a plurality of pre-recorded sound tracks and prerecorded stereo sound tracks.

37. The system of claim 29, wherein said modules of said three-dimensional sound processing application further comprise a sound separation module configured to segment a sound input in one of a plurality of formats acquired from a plurality of said sound sources positioned in said three-dimensional space into a plurality of sound tracks, wherein said sound input is one of a stereo sound and a multi-channel sound, and wherein each of said sound tracks corresponds to one of said sound sources, and wherein said sound processing module is configured to dynamically process said sound tracks with head related transfer functions computed by said three-dimensional sound processing application in communication with a simulator apparatus, based on said acquired user selections to generate said configurable three-dimensional binaural sound from said one of said stereo sound and said multi-channel sound.

38. The system of claim 37, wherein said sound separation module is configured to apply pre-trained acoustic models to said stereo sound to recognize and separate said stereo sound into said sound tracks, wherein said stereo sound is acquired by said data acquisition module of said three-dimensional sound processing application from said sound sources positioned in said three-dimensional space.

39. The system of claim 38, wherein said modules of said three-dimensional sound processing application further comprise a training module configured to train said pre-trained acoustic models based on pre-recorded sound sources.

40. The system of claim 37, wherein said sound separation module is configured to decode said multi-channel sound acquired from said sound sources to identify and separate said sound tracks from a plurality of sound channels associated with said multi-channel sound, wherein each of said sound channels corresponds to one of said sound sources, and wherein said multi-channel sound is acquired by said data acquisition module of said three-dimensional sound processing application from said sound sources positioned in said three-dimensional space.

* * * * *